US012440778B2

(12) United States Patent
Hafendorfer

(10) Patent No.: US 12,440,778 B2
(45) Date of Patent: Oct. 14, 2025

(54) FRAMING SYSTEM FOR A CONSTRUCTION SET

(71) Applicant: Jungle Jim's Accessory Products, Inc., Louisville, KY (US)

(72) Inventor: James Thomas Hafendorfer, Louisville, KY (US)

(73) Assignee: JUNGLE JIM'S ACCESSORY PRODUCTS, INC., Louisville, KY (US)

( * ) Notice: Subject to any disclaimer, the term of this patent is extended or adjusted under 35 U.S.C. 154(b) by 307 days.

(21) Appl. No.: 18/134,686

(22) Filed: Apr. 14, 2023

(65) Prior Publication Data

US 2024/0342624 A1 Oct. 17, 2024

(51) Int. Cl.

| | |
|---|---|
| ***A63H 33/08*** | (2006.01) |
| ***A63H 33/04*** | (2006.01) |
| ***A63H 33/10*** | (2006.01) |

(52) U.S. Cl.

CPC ..... *A63H 33/044* (2013.01); *A63H 33/086* (2013.01); *A63H 33/088* (2013.01); *A63H 33/108* (2013.01)

(58) Field of Classification Search

CPC ... A63H 33/044; A63H 33/086; A63H 33/108
See application file for complete search history.

(56) References Cited

U.S. PATENT DOCUMENTS 1,608,592 A * 11/1926 Funk ..... A63H 33/107 211/189

3,002,315 A * 10/1961 Kuhn ..... A63H 33/044 52/264

(Continued)

FOREIGN PATENT DOCUMENTS

| | | |
|---|---|---|
| CN | 303670981 | 5/2016 |
| CN | 303671028 | 5/2016 |

(Continued)

OTHER PUBLICATIONS

The United Patent and Trademark Office (As Searching Authority); Notification of Transmittal of the International Search Report and the Written Opinion of the International Searching Authority, or the Declaration; Search Report and Written Opinion of PCT/US23/18608; Jul. 10, 2023; pp. 1-14; The United States Patent and Trademark Office; US.

(Continued)

*Primary Examiner* — John A Ricci
(74) *Attorney, Agent, or Firm* — Wyatt, Tarrant & Combs, LLP; Max E. Bridges; Matthew A. Williams

(57) ABSTRACT

A framing system for a construction set comprising a number of interchangeable elements which can be arranged to construct a variety of three-dimensional structures, as well as individual, stand-alone floors, which in turn are adapted to be stacked on one another. In some embodiments, the system comprises at least one central unit, a plurality of outer mid-columns, at least one tie beam corner unit, and/or at least one curved beam unit which cooperate to form a variety of stand-alone floors. The system comprises additional components which increase the stability of the construction set, including but not limited to internal corner brackets, cross pins, cross studs, square panels, and rectangular panels.

18 Claims, 47 Drawing Sheets

(56) References Cited

U.S. PATENT DOCUMENTS

| | | | | |
|---|---|---|---|---|
| 4,084,344 | A | 4/1978 | Asano | |
| 5,470,139 | A * | 11/1995 | Hsiao | A47F 3/12 312/138.1 |
| D374,258 | S | 10/1996 | Schmidt et al. | |
| 5,647,181 | A | 7/1997 | Hunts | |
| 5,947,787 | A | 9/1999 | Cyrus et al. | |
| 5,993,283 | A | 11/1999 | Cyrus et al. | |
| 6,682,385 | B2 | 1/2004 | Atzen et al. | |
| 7,310,920 | B2 * | 12/2007 | Hovey, Jr. | E04B 1/24 52/656.1 |
| 8,011,156 | B1 * | 9/2011 | Schwan | A63H 33/088 52/655.1 |
| D685,861 | S | 7/2013 | Holman | |
| D688,753 | S | 8/2013 | Holm | |
| D711,977 | S | 8/2014 | Norman et al. | |
| 8,961,058 | B2 | 2/2015 | Haimoff et al. | |
| 9,044,690 | B2 | 6/2015 | Uttley et al. | |
| 9,308,464 | B1 | 4/2016 | Torres | |
| 9,579,589 | B1 * | 2/2017 | Lee | A63H 33/105 |
| 9,821,241 | B2 | 11/2017 | Haner | |
| 9,821,245 | B2 | 11/2017 | Larsen et al. | |
| 9,839,860 | B2 | 12/2017 | Rakhsha | |
| 10,130,892 | B2 | 11/2018 | Chesser et al. | |
| D858,652 | S | 9/2019 | Wilson | |
| 10,518,193 | B2 | 12/2019 | You | |
| 10,625,173 | B2 | 4/2020 | Kærsgaard et al. | |
| 10,821,372 | B2 | 11/2020 | Bertrand et al. | |
| D910,778 | S | 2/2021 | Hwang et al. | |
| 10,953,340 | B2 | 3/2021 | Beaulieu et al. | |
| 11,214,955 | B2 | 1/2022 | Joyce | |
| 11,311,817 | B1 | 4/2022 | Nam et al. | |
| D975,198 | S | 1/2023 | Mazur | |
| 2008/0200091 | A1 | 8/2008 | Blaivas | |
| 2015/0259910 | A1 * | 9/2015 | Montiel Reyes | E04B 2/18 52/604 |
| 2018/0256997 | A1 | 9/2018 | Barwald et al. | |
| 2020/0179819 | A1 | 6/2020 | Vucinovic | |
| 2020/0282323 | A1 | 9/2020 | MacArthur | |
| 2021/0339157 | A1 | 11/2021 | Pofahl et al. | |
| 2021/0348384 | A1 | 11/2021 | Savushkin et al. | |
| 2022/0165177 | A1 * | 5/2022 | Park | G06F 30/17 |
| 2024/0299857 | A1 * | 9/2024 | Yeh | A63H 33/086 |
| 2024/0335761 | A1 * | 10/2024 | Kærsgaard | A63H 33/086 |

FOREIGN PATENT DOCUMENTS

| | | | |
|---|---|---|---|
| CN | 205613051 | U | 10/2016 |
| CN | 304293864 | | 9/2017 |
| CN | 304635758 | | 5/2018 |
| CN | 207545836 | U | 6/2018 |
| CN | 304899341 | | 11/2018 |
| CN | 305982510 | | 8/2020 |
| CN | 306191087 | | 11/2020 |
| CN | 306303781 | | 1/2021 |
| CN | 306951072 | | 11/2021 |
| CN | 307143187 | | 3/2022 |
| CN | 307225413 | | 4/2022 |
| CN | 307682428 | | 11/2022 |
| CN | 307682432 | | 11/2022 |
| DE | 202014102487 | U1 | 7/2014 |
| DE | 202016009002 | U1 | 6/2021 |
| GB | 2037113 | | 2/1994 |
| GB | 2042236 | | 9/1994 |
| GB | 2063850 | | 9/1996 |
| GB | 80885130019000 | | 9/2015 |
| GB | 90038466170001 | | 4/2017 |
| GB | 2555642 | A | 5/2018 |
| GB | 90062688500005 | | 2/2019 |
| HK | 21187080001 | | 11/2021 |
| IN | 3454900010001 | | 6/2021 |
| IN | 3546100010001 | | 1/2023 |
| JP | D1681905 | | 3/2021 |
| JP | D1728243 | | 10/2022 |
| JP | D1734607 | | 1/2023 |
| KR | 3007588180000 | | 8/2014 |
| KR | 3007840940000 | | 2/2015 |
| KR | 3009199630000 | | 8/2017 |
| KR | 3010855560000 | | 12/2019 |
| KR | 20210055892 | A | 5/2021 |
| KR | 3011324140000 | | 10/2021 |
| KR | 301192387 | | 11/2022 |
| WO | 2010023404 | | 3/2010 |
| WO | 2021171214 | | 9/2021 |
| WO | 2021245177 | | 12/2021 |
| WO | 2022008588 | | 1/2022 |
| WO | 2022112335 | | 6/2022 |

OTHER PUBLICATIONS

Thames & Kosmos—Structural Engineering: Bridges & Skyscrapers, Oct. 30, 2020; copyright 2023; pp. 1-2; https://store.thamesandkosmos.com/products/structural-engineering-bridges-skyscrapers; Publication date of 2020 taken from https://web.archive.org/web/20201101000000*/https://store.thamesandkosmos.com/products/structural-engineering-bridges-skyscrapers.

MyBrick—Lego Technic Pins Tutorial; Youtube website; Jan. 11, 2020; pp. 1-5; https://www.youtube.com/watch?v=8sihp7zsSRI.

* cited by examiner

FRAMING SYSTEM FOR A CONSTRUCTION SET

FIELD OF INVENTION

The embodiments described herein relate to a framing system for a construction set. According to multiple embodiments and alternatives, the framing system comprises a number of interchangeable elements which can be arranged to construct a variety of individual, stand-alone floors and three-dimensional structures, as desired.

BACKGROUND

Building block sets for constructing toy buildings and other structures are well known and widely popular. However, conventional toy construction sets often lack the stability needed to construct large structures, lack the ability to add cladding, and typically lack the capability to construct a structure both vertically and/or horizontally. In addition, traditional toy construction sets lack the components necessary to easily create stand-alone floor units which makes construction of such conventional toy structures cumbersome and inefficient.

Accordingly, there is a significant need for a framing system for construction sets which provides greater support, stability, and more capabilities that easily permit the construction of a variety of large structures-both vertically and horizontally. There is also a significant need for a construction set comprising stand-alone floor units which, in turn, can be arranged and stacked to construct numerous structures. This ability would permit the user to construct a toy building, or any type of three-dimensional structure, floor by floor, and/or remove individual floors or components, as desired. There is a significant need for a framing system which can be used to construct larger toy structures with less components, provides more secure coupling arrangements, and greater flexibility for constructing a variety of different structures vertically and horizontally. In addition, there is a significant need for a framing system that can create free-standing skeletal structures and frames that are adapted to receive cladding and other exterior features. Along with other features and advantages outlined herein, the framing system for a construction set, according to multiple embodiments and alternatives, meet these and other needs.

SUMMARY OF EMBODIMENTS

According to multiple embodiments and alternatives, the framing system for a construction set (referred to herein as the "system" for brevity) comprises a number of interlocking and interchangeable components that are adapted to construct a variety of three-dimensional structures. In some embodiments, the framing system permits a user (herein the term "user" refers to an individual utilizing the system) to create a skeletal structure or frame which is adapted to receive additional components as desired. The system is further adapted to construct numerous individual, stand-alone floors, which in turn, can be arranged on top of one another to construct a variety of three-dimensional shapes and structures, including but not limited to buildings, as desired by the user.

According to multiple embodiments and alternatives, the system comprises at least one central unit and a plurality of tie beam corner units and/or a plurality of curved beam units which are adapted to form a stand-alone floor. It will be appreciated by one of ordinary skill in the art that a single floor may comprise a plurality of tie beam corner units connected to at least one central unit, a plurality of curved beam units connected to the at least one central unit, or a combination of at least one tie beam corner unit and at least one curved beam unit connected to at least one central unit. In turn, the individual floors can be stacked on additional, corresponding floors to construct a variety of different structures. The components of the system further define a plurality of studs and various borings which are adapted to receive other components such as cross pins, cross studs, square panels and rectangular panels (discussed below). The components of the system are further adapted to receive any number of known elements such as cladding, wall panels, windows, and other components of various geometric sizes and shapes that are adapted to secure to the components as desired by the user.

According to multiple embodiments and alternatives, the system comprises a central unit having a center column extending upwards, a center connector that removably secures to the bottom of the center column, and at least one tie beam removably connected to one of the sides of the center connector and extending outwards from said connector. In some embodiments, at least one outer mid-column is removably connected to the opposing side of the at least one tie beam and extending upwards.

According to multiple embodiments and alternatives, a plurality of central units interlock to form a central portion of a floor. In further embodiments, a plurality of outer mid-columns are interlocked with the plurality of the central units along the perimeter of said central portion. Moreover, tie beams and front cross beams span between the plurality of outer mid-columns, such that the plurality of outer-mid columns, tie beams, and front cross beams form the perimeter of the floor. In turn, at least one tie beam corner unit and/or at least one curved beam unit are adapted to interlock with two, adjacent outer-mid columns on adjacent sides of said central portion to form the corners of said floor.

In some embodiments, each of the sides of the center connector define at least one cross stud receiving bore, or other bores of various geometric shapes as appreciated by one of ordinary skill in the art, and the sides of the center connector are adapted to engage the end of a tie beam. Each of the tie beams comprise a pair of opposing sides and a pair of opposing ends, wherein the opposing ends of the tie beam define at least one cross stud receiving bore and said opposing ends are adapted to engage the center connector or an outer mid-column. Each of the opposing sides of the tie beam define a pair of studs, positioned adjacent to the opposing ends, which are adapted to engage an internal corner bracket (discussed in more detail below).

According to multiple embodiments and alternatives, the outer mid-columns comprise a bottom portion integrally connected to a vertical portion which extends upwards. In further embodiments, the outer mid-columns lack the bottom portion and comprise only the vertical portion. The front and opposing sides of the bottom portion of the outer mid-column define at least one cross stud receiving bore, the front side of the bottom portion is adapted to engage a tie beam, and the opposing sides are adapted to engage a tie beam or a curved beam. The top surface of the bottom portion further defines at least one stud which is adapted to engage other components of the system (such as a square panel as a non-limiting example). The vertical portion of the outer mid-column comprises a pair of lateral sides and an external face. In some embodiments, the pair of lateral sides of the vertical portion of the outer mid-column define a series of cross stud receiving bores. In further embodiments, the external face of said vertical portion defines a series of studs, a series of borings, and a pair of half studs extending from the top of said external face. The top surface of the outer mid-column defines a pair of studs being adapted to receive a front cross beam or a curved cross beam as desired. Herein, the term "stud" refers to a small, cylindrical bump that is adapted to engage components having a stud receiving bore and/or corresponding recess. The term "half stud" refers to a protrusion comprising one half of the cylindrical bump (i.e. one half of a full stud) such that a half stud mates with another half stud to form a full, circular stud that is adapted to receive a component having a stud receiving bore and/or corresponding recess.

According to multiple embodiments and alternatives, the system further comprises a tie beam corner unit being adapted to form a corner of a floor. In some embodiments, a tie beam corner unit comprises a pair of tie beams wherein an end of each of the pair of tie beams engage a bottom portion of a single corner column (or a vertical portion of a corner column in some embodiments) and the other ends of the tie beams engage the bottom portions (or vertical portions in some embodiments) of separate, adjacent outer mid-columns. The tie beam corner unit further comprises a pair of front cross beams which span between the top surfaces of said adjacent, outer mid-columns and the top surface of the corner column. In some embodiments, the front cross beams comprise a top surface, an outer face, an inner face, a pair of opposing ends, and a bottom surface being adapted to engage one of the studs located on the top surface of an outer mid-column or the top surface of the corner column. Each of the ends of the outer face of said front cross beam define a half stud, wherein one of the half studs mates with one of the half studs on the top surface of the outer mid-column to form a full stud and the other half stud on the front cross beam mates with one of the half studs on the top surface of the corner column to form a full stud. In some embodiments, a pair of studs extend from the ends of the top surface of the front cross beam, said studs being adapted to receive a portion of a subsequent floor which can be stacked upon the existing floor.

According to multiple embodiments and alternatives, the corner column comprises a bottom portion integrally connected to a vertical portion which extends upwards. In further embodiments, the corner column comprises only the vertical portion. The corner column defines a pair of external faces having a series of studs and a series of borings extending the entire length of the external faces. The corner column further comprises a pair of internal faces defining a series of cross stud receiving bores, and a recess positioned between said internal faces. A corner block extends upwards from a top surface of the corner column and a single stud extends from the top of said corner block. In this manner, the top surface of the corner column and the corner block are adapted to receive and mate with one or more front cross beams, and cooperate to form a flat surface which is adapted to receive a portion of an additional floor. In some embodiments, the bottom portion of the corner column comprises a top surface having a single stud (being adapted to engage other components such as a square panel, as a non-limiting example) and a pair of internal faces which further define at least one cross stud receiving bore. The pair of internal faces of the bottom portion are adapted to engage and receive a tie beam. In further embodiments, the internal faces of the vertical portion are adapted to engage and receive a tie beam. It will be appreciated that the pair of tie beams, the pair of front cross beams, and the corner column interlock to form a tie beam corner unit which is adapted to engage two adjacent outer mid-columns to form a corner of a floor.

According to multiple embodiments and alternatives, the system further comprises a curved beam unit being adapted to form a curved corner of a floor. In some embodiments, the curved beam unit comprises a curved beam removably connected to the bottom portions (or vertical portions) of separate, adjacent outer mid-columns and a curved cross beam removably connected to the top surface of said separate, adjacent outer mid-columns (and positioned directly above said curved beam). In some embodiments, the curved beam comprises a pair of end portions having a cuboid shape and being integrally connected to a curved main body. The pair of end portions define a pair of end faces being adapted to engage the sides of the bottom portion or the vertical portion of an outer mid-column and each end face having at least one cross pin receiving bore. The pair of sides of the end portions of the curved beam each have a stud which is adapted to engage an internal corner bracket. The main body of the curved beam is sized to span between the bottom portions of two adjacent, outer-mid beams. A series of studs extend from the top surface of the curved beam, wherein said studs are positioned in such a manner to correspond with the studs of adjacent components (such as tie beams or outer mid-columns as non-limiting examples) and being adapted to receive additional items such as a floor surface that spans between an adjacent tie beam and the curved beam (as a non-limiting example).

In some embodiments, the curved cross beam comprises a curved main body integrally connected to a pair of end portions and being adapted to span between the top surfaces of separate, adjacent outer mid-columns. Similar to the cross beam of the tie beam corner unit, the curved cross beam comprises a top surface, an outer face, an inner face, and a bottom surface being adapted to engage the one or more studs located on the top surface of said outer mid-columns. The curved cross beam further comprises a pair of end portions integrally connected to a curved main body. Each of the outer faces of said end portions define a half stud which mates with the half stud on the top surface of the outer mid-column to form a full stud. It will be appreciated that the curved beam and the curved cross beam interlock to form a curved beam unit which is adapted to engage two adjacent outer mid-columns of a central unit.

In some embodiments, the connections between the tie beams, the outer mid-columns, the curved beams, the corner columns, and the center connector are held together by a plurality of cross pins which are positioned within the cross stud receiving bores and said cross pins span between the various components (similar to a dowel as a non-limiting example) to prevent motion or slipping. According to multiple embodiments and alternatives, a cross pin comprises a peg having an extended cross shape and a cross stud comprises a stud integrally connected to one end of a cross pin. The system comprises a number of cross stud receiving bores and cross pin receiving bores, wherein the bores, the cross pins, and the cross studs provide both structural support (as discussed in further detail below) and connection points for mounting other components.

In further embodiments, the internal connections between abutting beams (such as two tie beams or a tie beam and a curved beam) are further secured by internal corner brackets. The internal corner bracket comprises a pair of walls integrally connected at about a ninety degree angle and further comprising a pair of external faces with a recess being adapted to receive at least one stud and/or at least one cross stud (which extend from the ends of the sides of the beams).

A block member is integrally connected to the pair of internal faces of the internal corner bracket, and a single stud extends from the top surface of said block member. In this manner, the pair of external faces of the internal corner bracket are adapted to engage the system's internal beam connections to provide additional stability.

In further embodiments, the system comprises at least one square panel, and/or at least one rectangular panel to provide additional support between connections. As a non-limiting example, when a pair of tie beams engage a corner column, a pair of sides of the square panel may engage the pair of internal faces of the corner column. Furthermore, the bottom surface of the square panel mates with both the single stud on the top surface of the bottom portion of the corner beam and the corresponding studs on the top surface of the pair of tie beams positioned adjacent to the corner beam. When an internal corner bracket is received between said pair of tie beams, the remaining opening on the bottom surface of the square panel mates with the single stud on the top surface of the block member of said internal bracket. Accordingly, the square panel provides support for the connection between the pair of tie beams and the corner beam, and the internal corner bracket in some embodiments.

According to multiple embodiments and alternatives, a rectangular panel may also provide additional support between the system's various connections. As a non-limiting example, a rectangular panel may span across the outer surface of a connection between a pair of tie beams removably secured to the opposing sides of an outer-mid column. The cross pins, cross studs, internal corner brackets, square panels, and rectangular panels provide additional stability and support for the connections between the system's components.

Accordingly, the system provides a number of advantages over conventional toy construction sets including but not limited to the ability to construct and remove stand-alone floors, providing greater stability and support which permits the construction of larger buildings, and the use of less pieces than conventional approaches, along with other features disclosed herein.

BRIEF DESCRIPTION OF THE FIGURES

The drawings and embodiments described herein are illustrative of multiple alternative structures, aspects, and features of the present embodiments, and they are not to be understood as limiting the scope of present embodiments. It will be further understood that the drawing Figures described and provided herein are not to scale, and that the embodiments are not limited to the precise arrangements and instrumentalities shown.

MULTIPLE EMBODIMENTS AND ALTERNATIVES

Figure 1A:
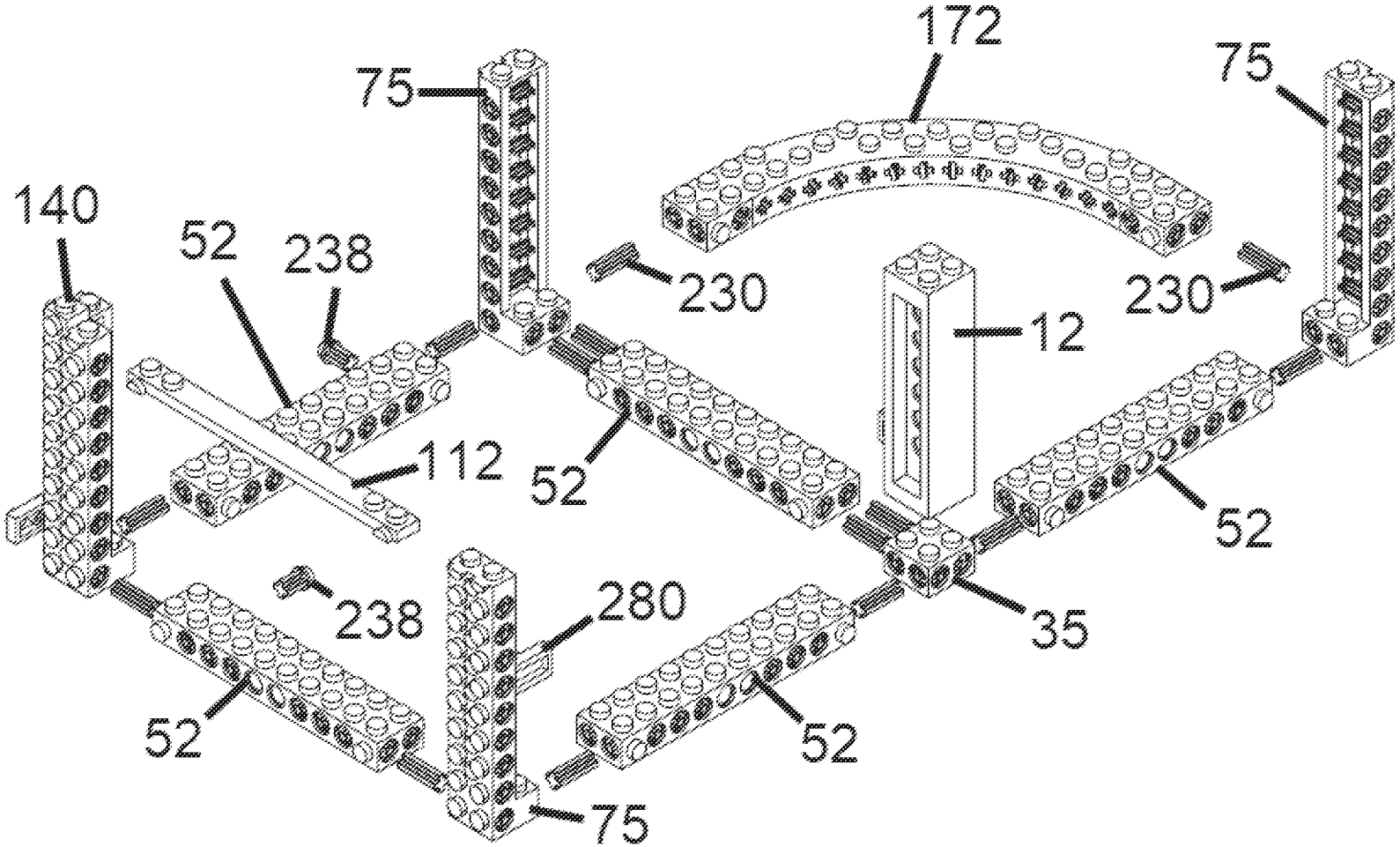
FIGS. 1A-1C are perspective, exploded views of a portion of a framing system for a construction set, according to multiple embodiments and alternatives.
Figure 1B:
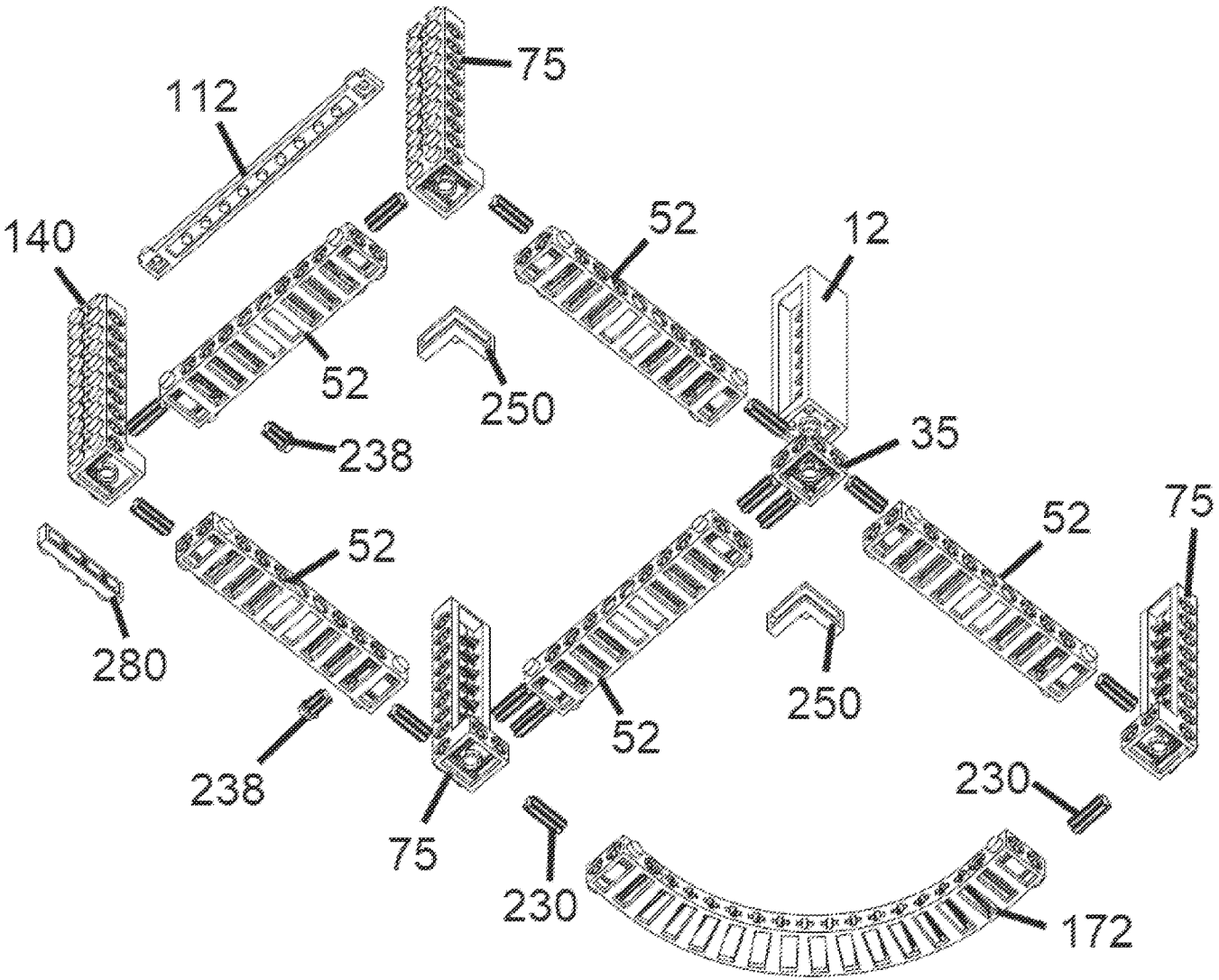
Figure 1C:
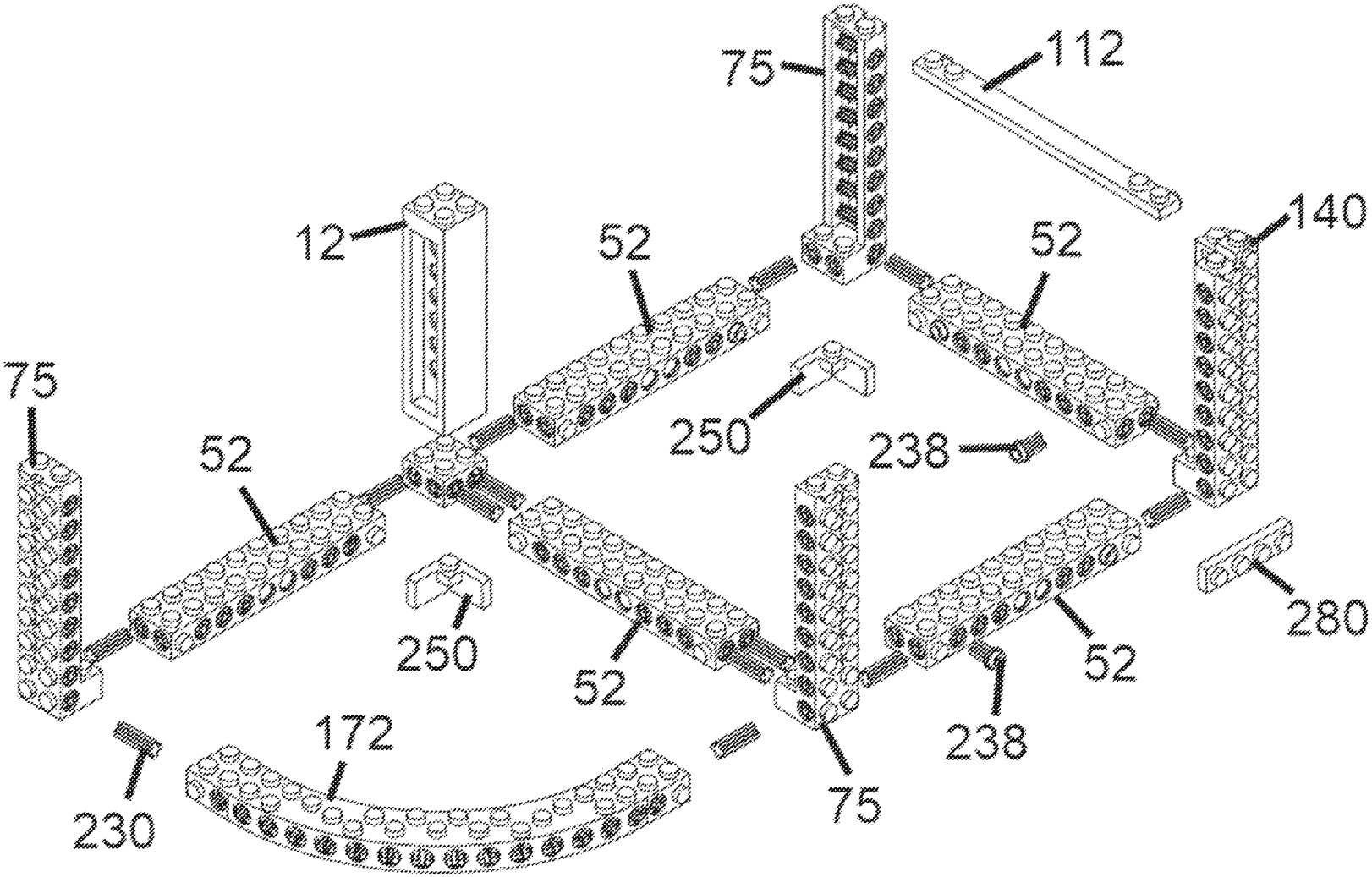
Figure 1D:
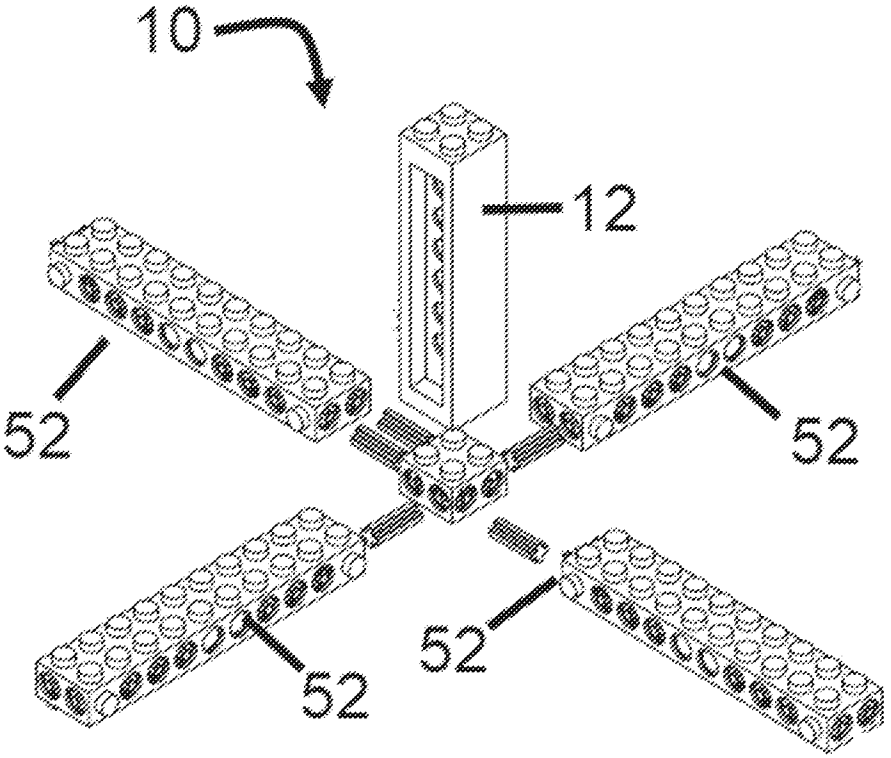
FIG. 1D is a perspective, exploded view of a central unit, according to multiple embodiments and alternatives.
Figure 2:
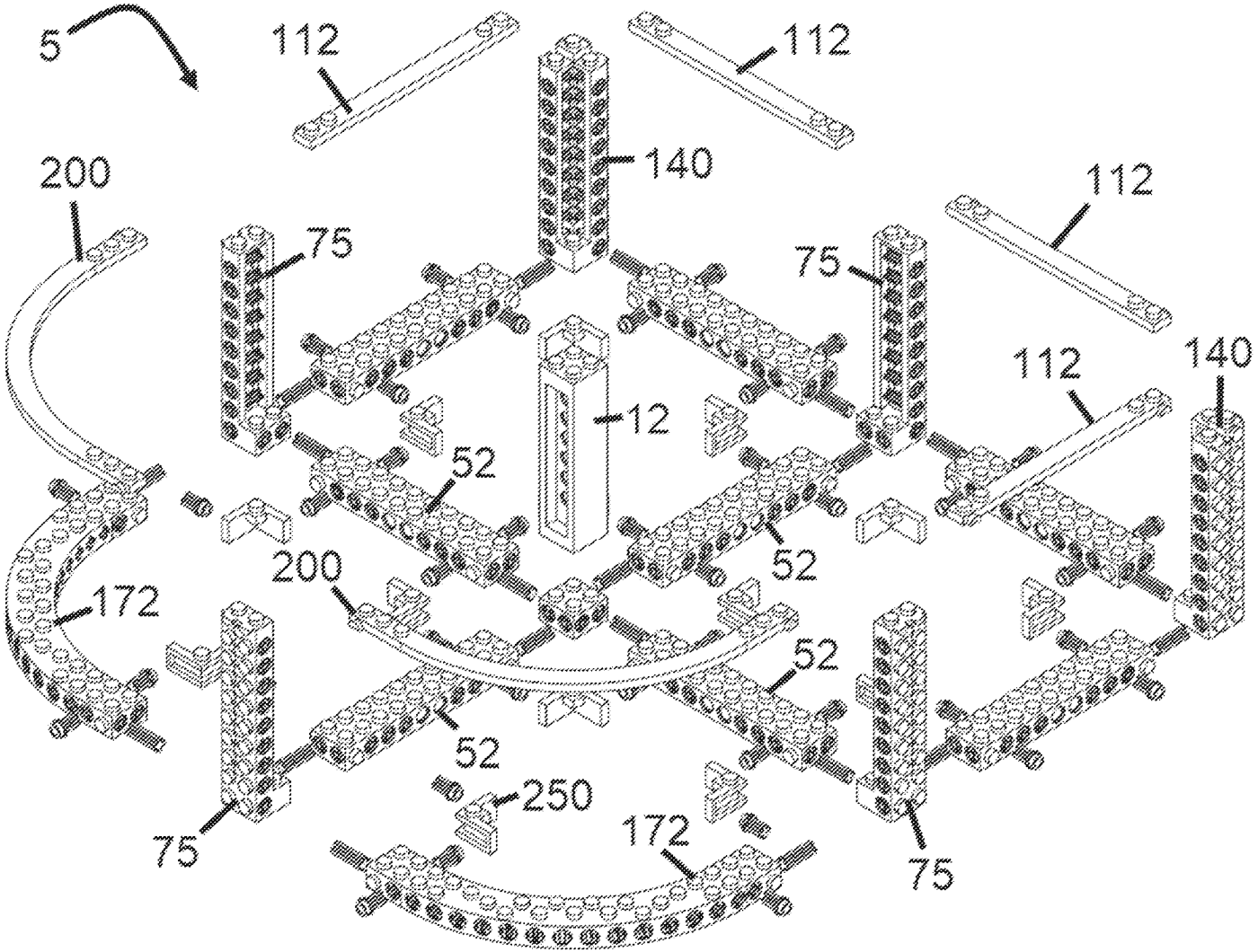
FIG. 2 is an exploded view of a framing system for a construction set, according to multiple embodiments and alternatives.
Figure 3A:
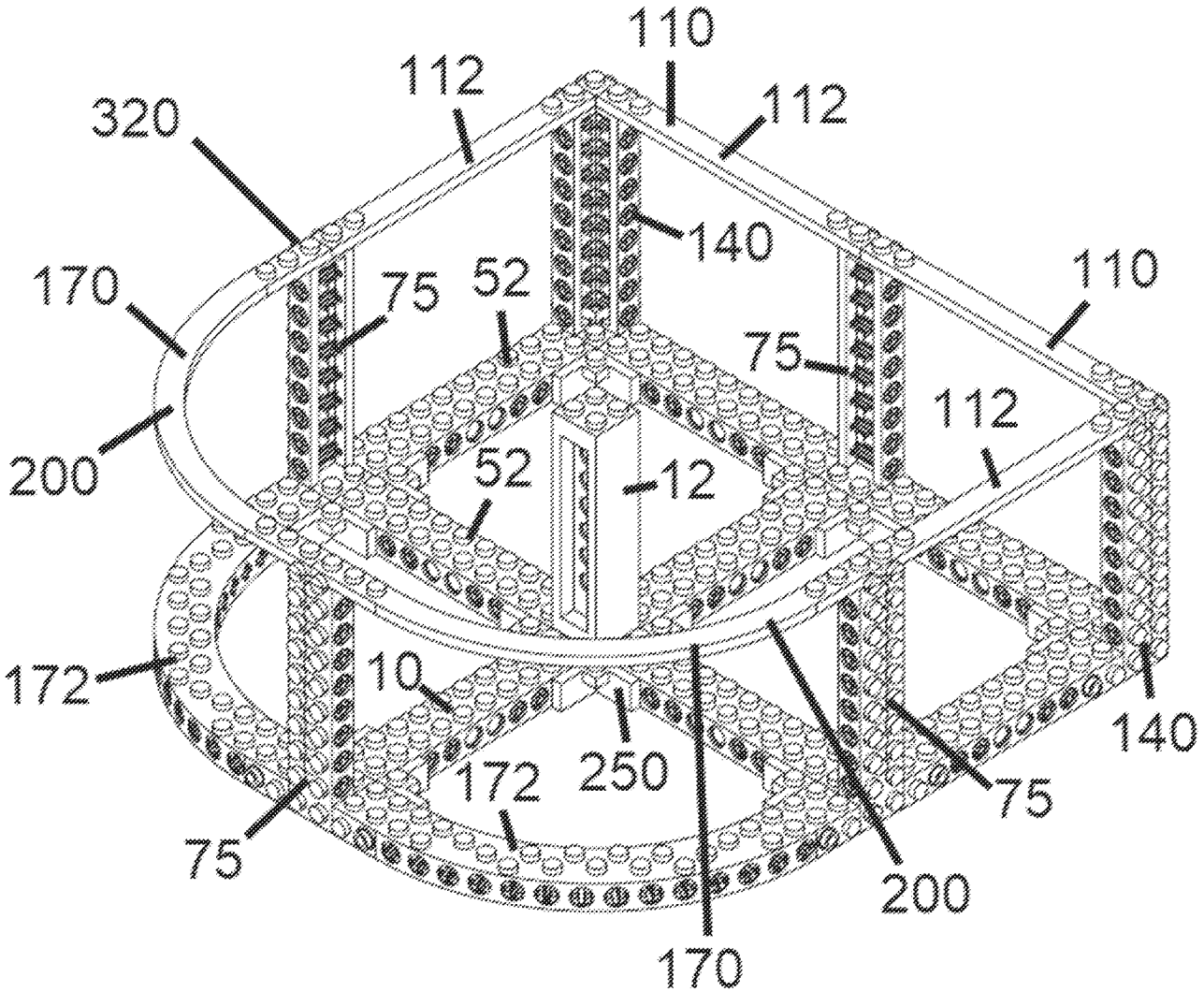
FIGS. 3A-3B are perspective views of a floor comprising a pair of curved beam units and a pair of tie beam corner units removably secured to a central unit, according to multiple embodiments and alternatives.
Figure 3B:
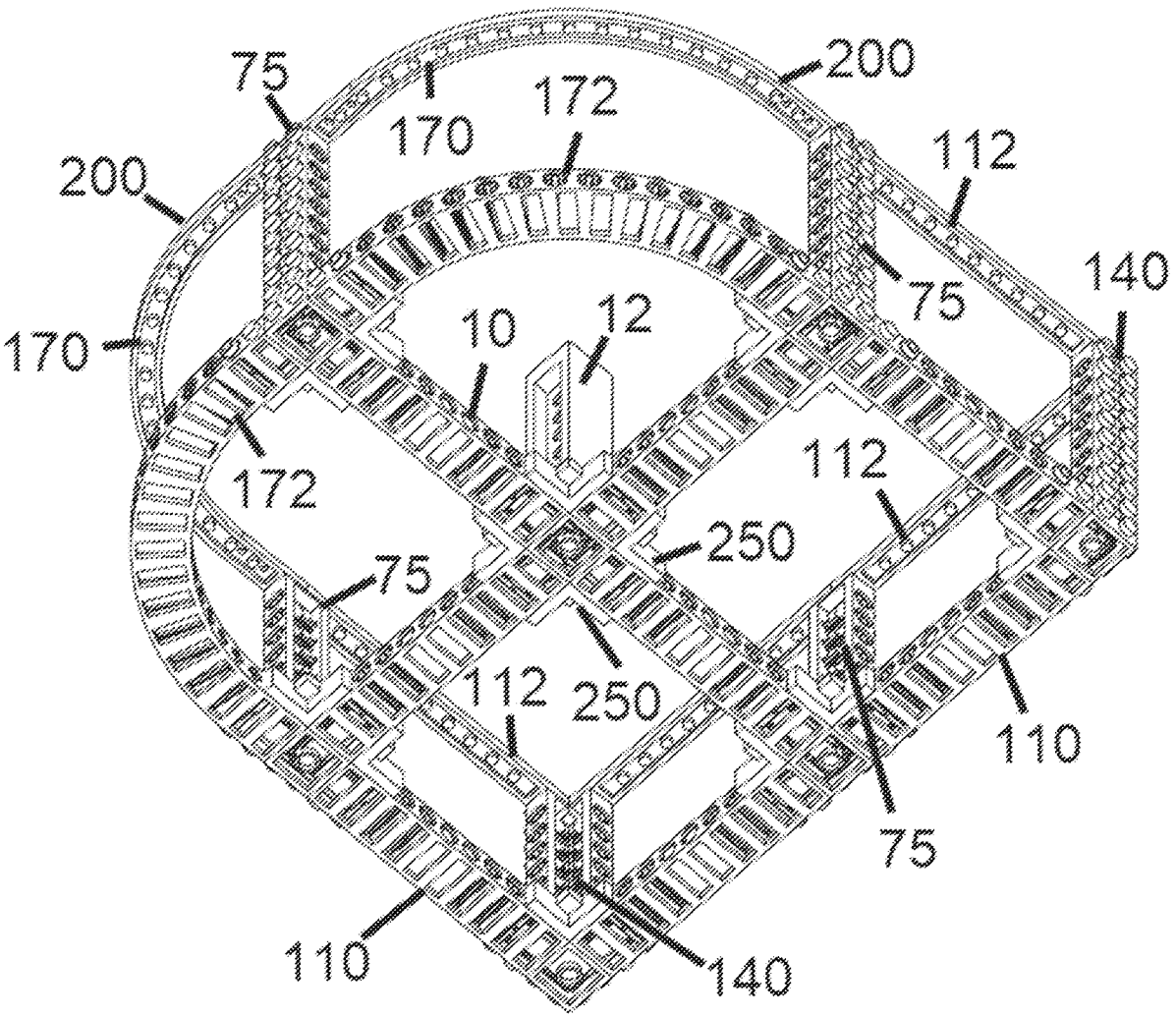
Figure 4A:
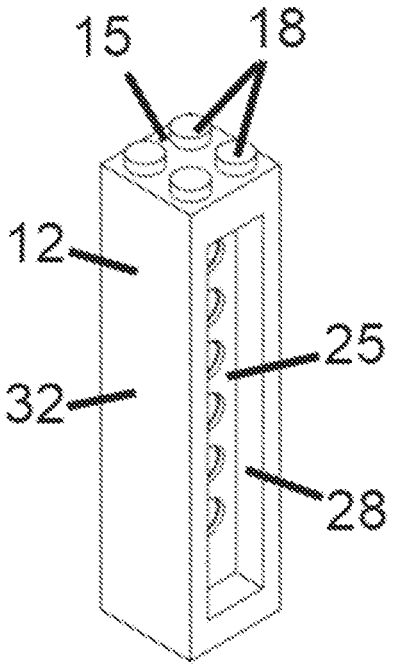
FIG. 4A is a perspective view of a center column, according to multiple embodiments and alternatives.
Figure 4B:
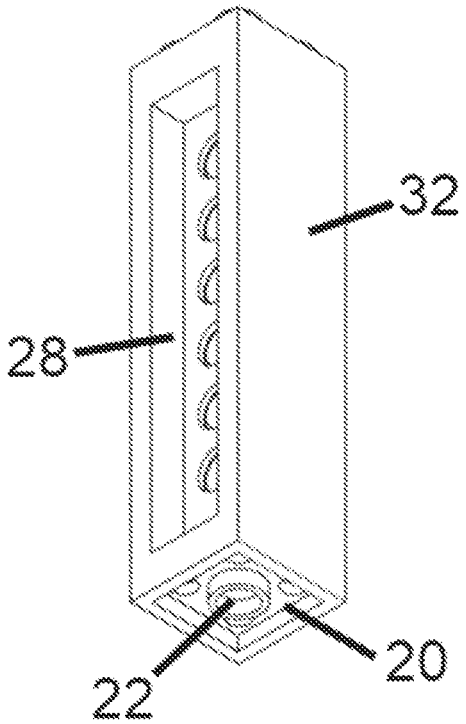
FIG. 4B is a bottom, perspective view of a center column, according to multiple embodiments and alternatives.
Figure 4C:
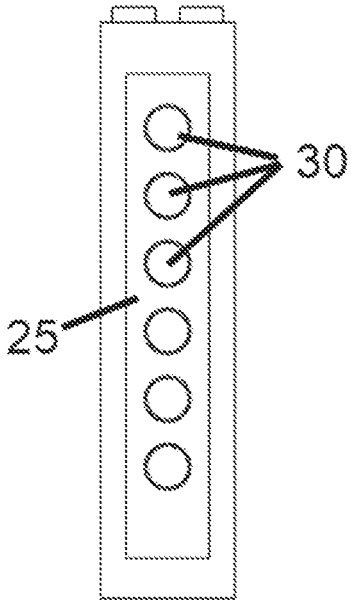
FIGS. 4C-4D are side views of a center column, according to multiple embodiments and alternatives.
Figure 4D:
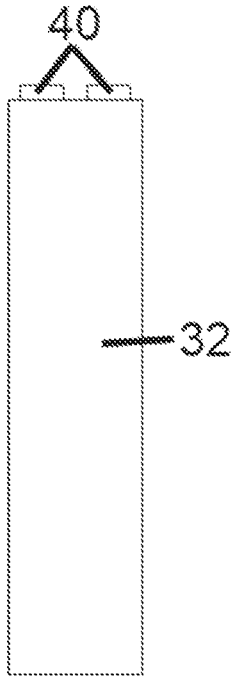

FIGS. 1A-3B illustrate the components of the system 5, according to multiple embodiments and alternatives. As shown in FIGS. 1A-1C, the top and bottom ends of a center column 12 are adapted to receive a center connector 35. As best illustrated in FIGS. 3A-3B, upon being removably secured to the center column 12, the sides of the center connector 35 align with the sides of the center column 12. In turn, the sides of the center connector 35 define at least one cross stud receiving bore being adapted to receive a cross pin 230, a cross stud 238, or other components that are sized to mate with said bore, and the sides of the center connector 35 are sized to engage a tie beam 52. In some embodiments, the tie beam 52 is connected to the center connector 35 using one or more cross pins 230. The ends of the tie beams define at least one cross stud receiving bore and are adapted to engage either the center connector 35, an outer mid-column 75, or a corner column 140. As discussed in more detail below, in some embodiments the outer mid-columns 75 comprise a bottom portion 98 which is integrally connected to a vertical portion 99. The opposing sides and front surface of the bottom portion 98 of the outer mid-column 75 define at least one cross stud receiving bore. The sides of the bottom portion 98 are sized to engage either a tie beam 52 or a curved beam 172, and the front surface of the bottom portion 98 is adapted to engage a tie beam 52. In some embodiments, the tie beam 52 and/or the curved beam 172 are connected to the outer mid-column 75 via one or more cross pins 230.

As best illustrated in FIG. 1D, in some embodiments a central column 12, a center connector 35, and at least one tie beam 52 (wherein each at least one tie beam 52 has a pair of identical opposing ends 62) interlock to form a central unit 10. In some embodiments, a plurality of outer mid-columns 75 interlock with the central unit 10, and in further embodiments, the different components of the central unit 10 are connected to one another via cross pins 230. In this manner, the center connector 35 is removably secured to the bottom of the center column 12, and a plurality of tie beams 52 are removably connected to the sides of said center connector 35 via cross pins 230. In further embodiments, a plurality of outer mid-columns are removably secured to the opposing ends of said tie beams 52 via cross pins 230. As discussed in more detail below, in some embodiments a plurality of central units 10 interlock to form a central portion of a floor and a plurality of outer mid-columns 75 interlock with the plurality of the central units along the perimeter of said central portion. In turn, tie beams 52 and front cross beams 112 span between the plurality of outer mid-columns 75 to form the perimeter of the floor.

According to multiple embodiments and alternatives, a curved beam 172 spans between the bottom portions of adjacent outer mid-columns 75. As discussed in more detail below and as best illustrated in FIG. 3A, the series of studs 178 extending from the top surface 175 of the curved beam 172 align with the studs on adjacent tie beams 52 and adjacent outer mid-columns 75, thereby permitting additional components (such as a floor surface as non-limiting example) to mount to said curved beam 172 and adjacent components. As shown in FIGS. 2-3A, a curved cross beam 200 is positioned above the curved beam 172 and spans between the top surfaces of the adjacent outer mid-columns 75. As discussed in more detail below, the ends of the outer face of said curved cross beam 200 define a half stud 210 which mates with another half stud 85 extending from the top surface 78 of the outer mid-column 75 to form a full stud. In turn, the full stud is adapted to engage and receive other components having a stud receiving bore and/or another corresponding recess. In some embodiments, a curved beam unit 170 comprises a single curved beam 172 and a single curved cross beam 200, wherein the curved beam unit 170 is adapted to be removably secured to two adjacent outer mid-columns which are removably secured to at least one central unit 10. In further embodiments, the curved beam unit 170 connects to the two adjacent outer mid-columns 75 via one or more cross pins 230. When a curved cross beam 200 is mounted to the top surface 78 of an outer mid-column 75, the curved cross beam 200 forms a flat surface with studs that is adapted to receive an additional floor.

Figure 19A:
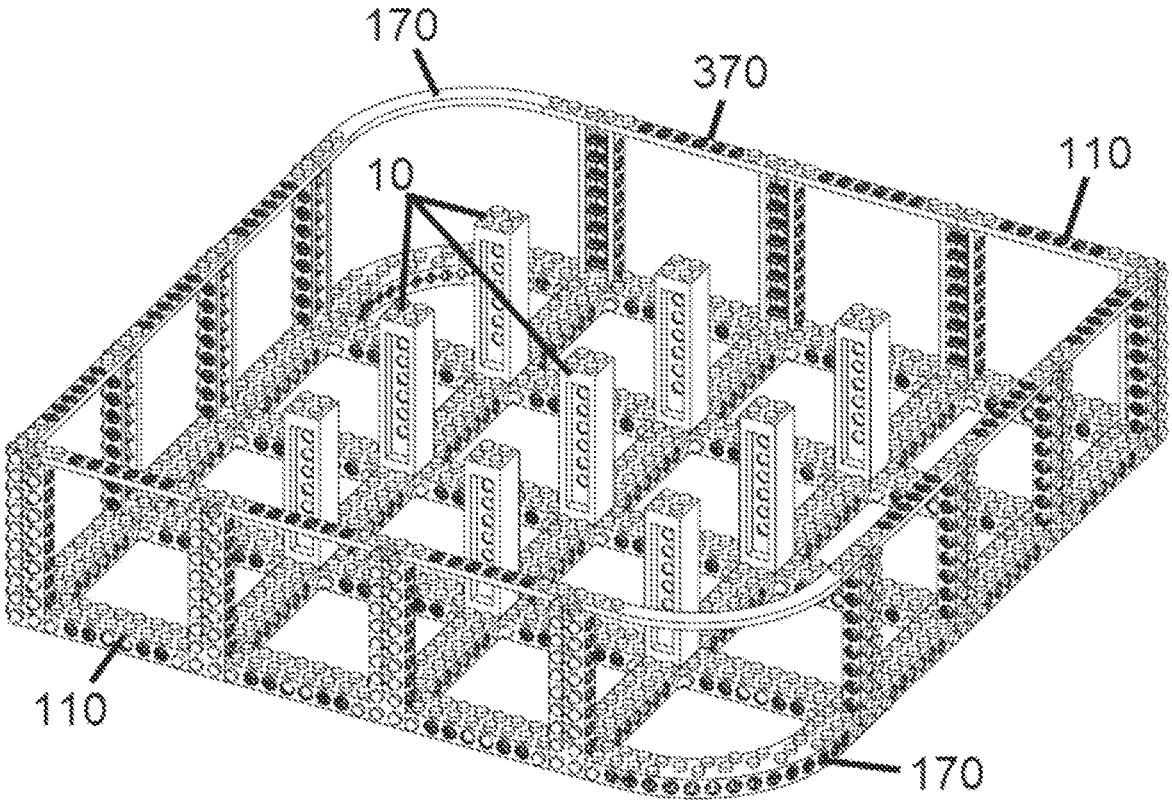
FIGS. 19A-19B are perspective views of a floor comprising a plurality of central units, a plurality of curved beam units, and a plurality of tie beam corner units, according to multiple embodiments and alternatives.

According to multiple embodiments and alternatives, a tie beam corner unit 110 comprises a pair of tie beams 52 (i.e. a first tie beam 51, 52 and a second tie beam 51, 52), and a corner column 140. In some embodiments, the tie beam corner unit 110 further comprises a pair of front cross beams 112 (positioned above said pair of tie beams 52 wherein in some embodiments the pair of front cross beams 112 comprise a first front cross beam and a second front cross beam). In some embodiments, one or more cross pins 230 connect the tie beams 52 to the corner column 140, wherein the tie beam corner unit 110 is adapted to engage two adjacent outer mid-columns 75, which are connected to at least one central unit 10, to form a corner of a single floor (as best illustrated in FIGS. 3A-3B, and 19A). In some embodiments, the pair of tie beams 52 are adapted to be removably secured to the sides of the bottom portions 98 of the adjacent outer mid-columns 75. In some embodiments, the tie beams 52 are connected to the outer mid-columns 75 via cross pins 230. In turn, the opposing ends of the pair of tie beams 52 engage a bottom portion 160 of a corner column 140 and in some embodiments, are connected via cross pins 230. As discussed below, in some embodiments the corner column 140 comprises a bottom portion 160 integrally connected to a vertical portion 161, and in other embodiments the corner column 140 comprises only a vertical portion 161. The internal sides of the bottom portion 160 define at least one cross stud receiving bore being adapted to receive a cross pin 230 or a cross stud 238, and said internal sides are further sized to receive and mate with the end of a tie beam 52. A corner block 146 is integrally mounted to the top end 142 of the corner column 140, such that the top end 142 is adapted to receive and mate with one or more front cross beams 112. In further embodiments, the corner block 146 is removably connected to the top end 142 of the corner column 140. When the at least one front cross beam 112 is mounted to the top end 142 of the corner column 140 and the top surface 78 of the outer mid-column 75, the at least one front cross beam 112, corner column 140, and outer mid-column 75 cooperate to form a flat surface (with studs) that is adapted to receive an additional floor. Furthermore, the ends of the outer face of said front cross beam 112 each define a half stud 121, wherein one of the half studs 121 mates with another half stud 85 extending from the top surface 78 of the outer mid-column 75 to form a full stud, and the other half stud 121 mates with a half stud 148 extending from the top end 142 of a corner column to form a full stud. It will be appreciated by one of ordinary skill in the art that the full stud is adapted to engage and receive other components having a stud receiving bore or a corresponding recess.

According to multiple embodiments and alternatives, the system 5 comprises at least one central unit 10, a plurality of outer mid-columns 75, a plurality of tie beam corner units 110 and/or a plurality of curved beam units 170 which are adapted to form one or more stand-alone floors, wherein said floors can be stacked upon one another to construct numerous structures as desired by the user. In further embodiments, the system 5 comprises a plurality of central units 10 which interlock to form a central portion of a floor, and a plurality of outer mid-columns 75 interlocked with the plurality of central units 10 along the perimeter of said central portion. In turn, a plurality of tie beams 52 span between the identical, lateral sides 92 of the plurality of outer mid-columns 75 and a plurality of front cross beams 112 span between the top surface 78 of the plurality of outer-mid columns 75, such that the plurality of tie beams 52, the plurality of front cross beams 112, and the plurality of outer mid-columns 75 form the perimeter of the floor. In some embodiments, at least one tie beam corner unit 110 and/or at least one curved beam unit 170 are adapted to interlock with two, adjacent outer-mid columns 75 of said central portion to form the corners of said floor.

Figure 15:
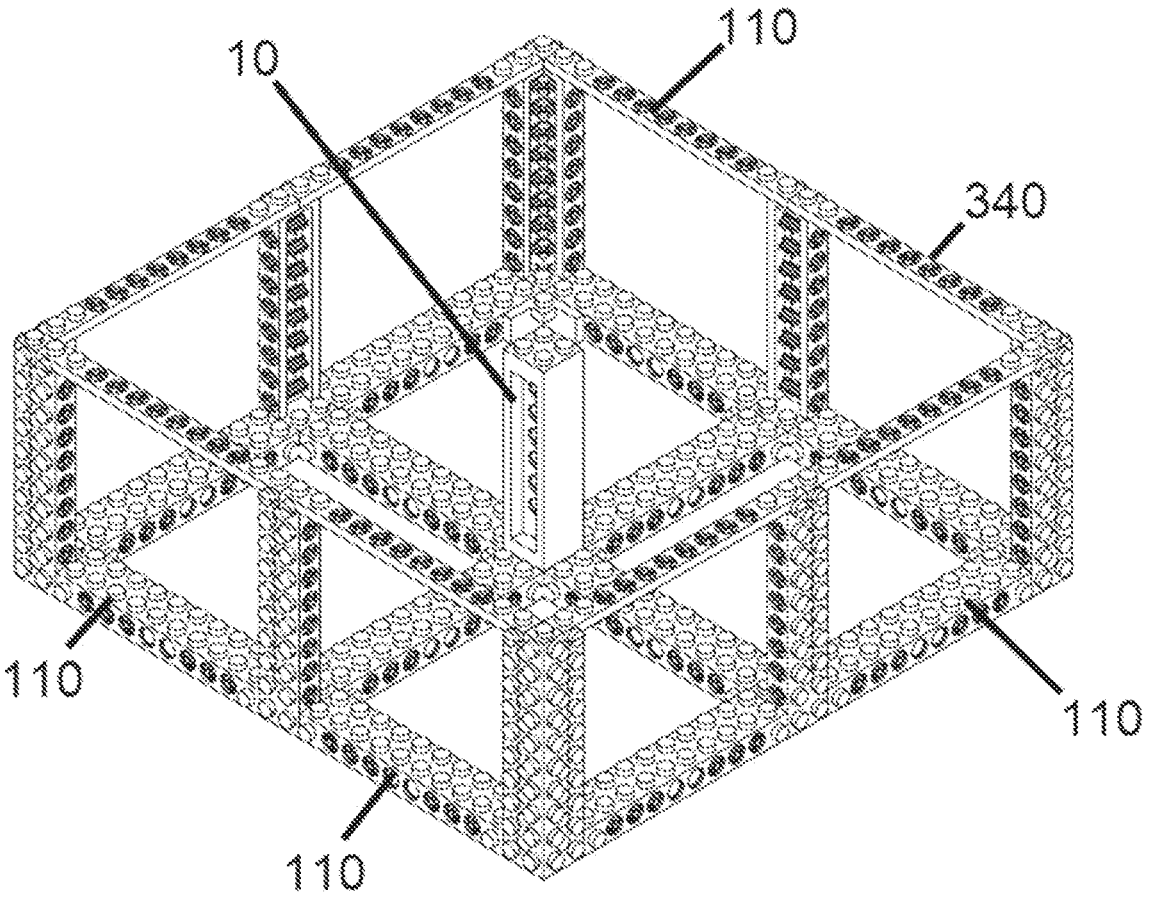
FIG. 15 is a perspective view of a floor comprising a plurality of tie beam corner units removably secured to a central unit, according to multiple embodiments and alternatives.
Figure 16:
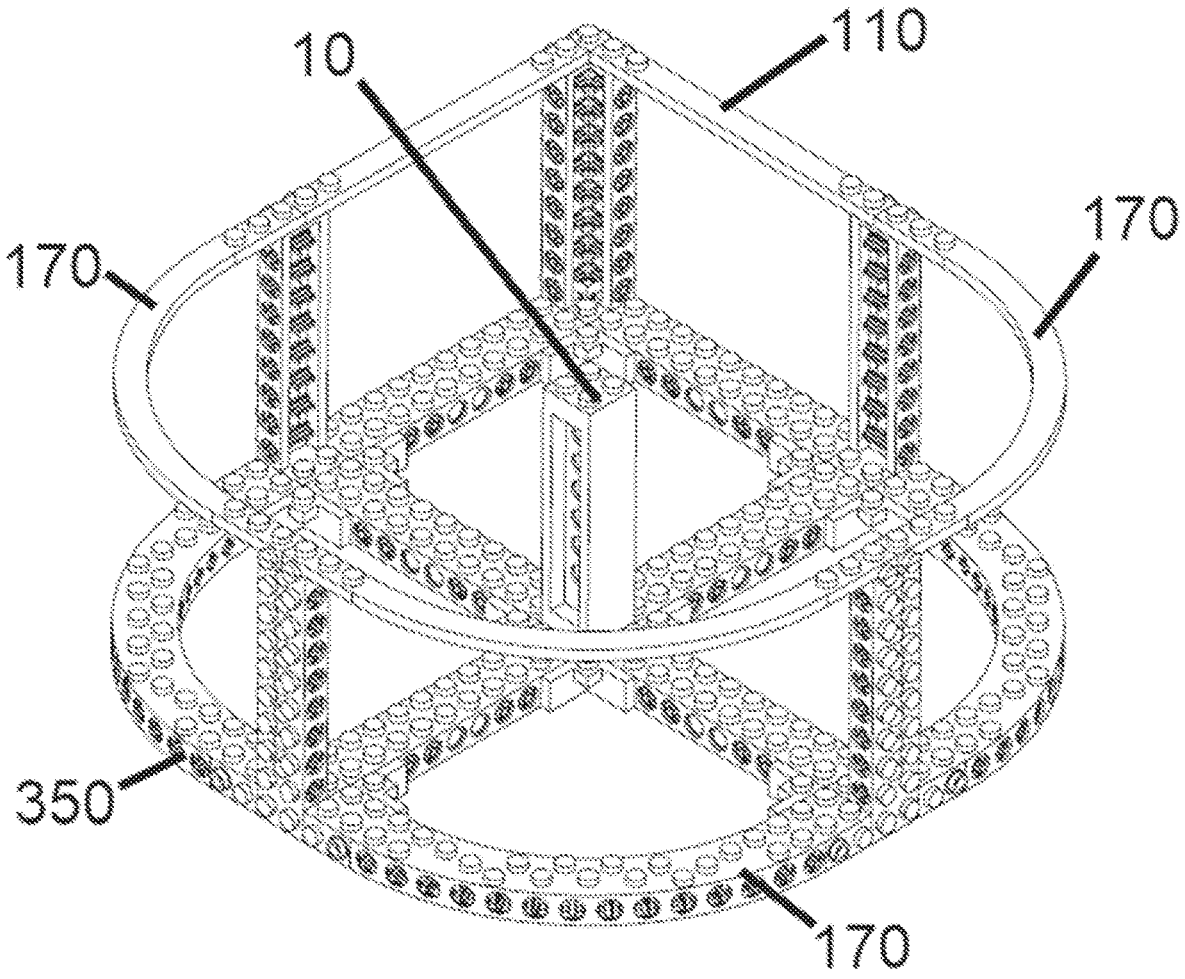
FIG. 16 is a perspective view of a floor comprising a tie beam corner unit and a plurality of curved beam units removably secured to a central unit, according to multiple embodiments and alternatives.
Figure 17:
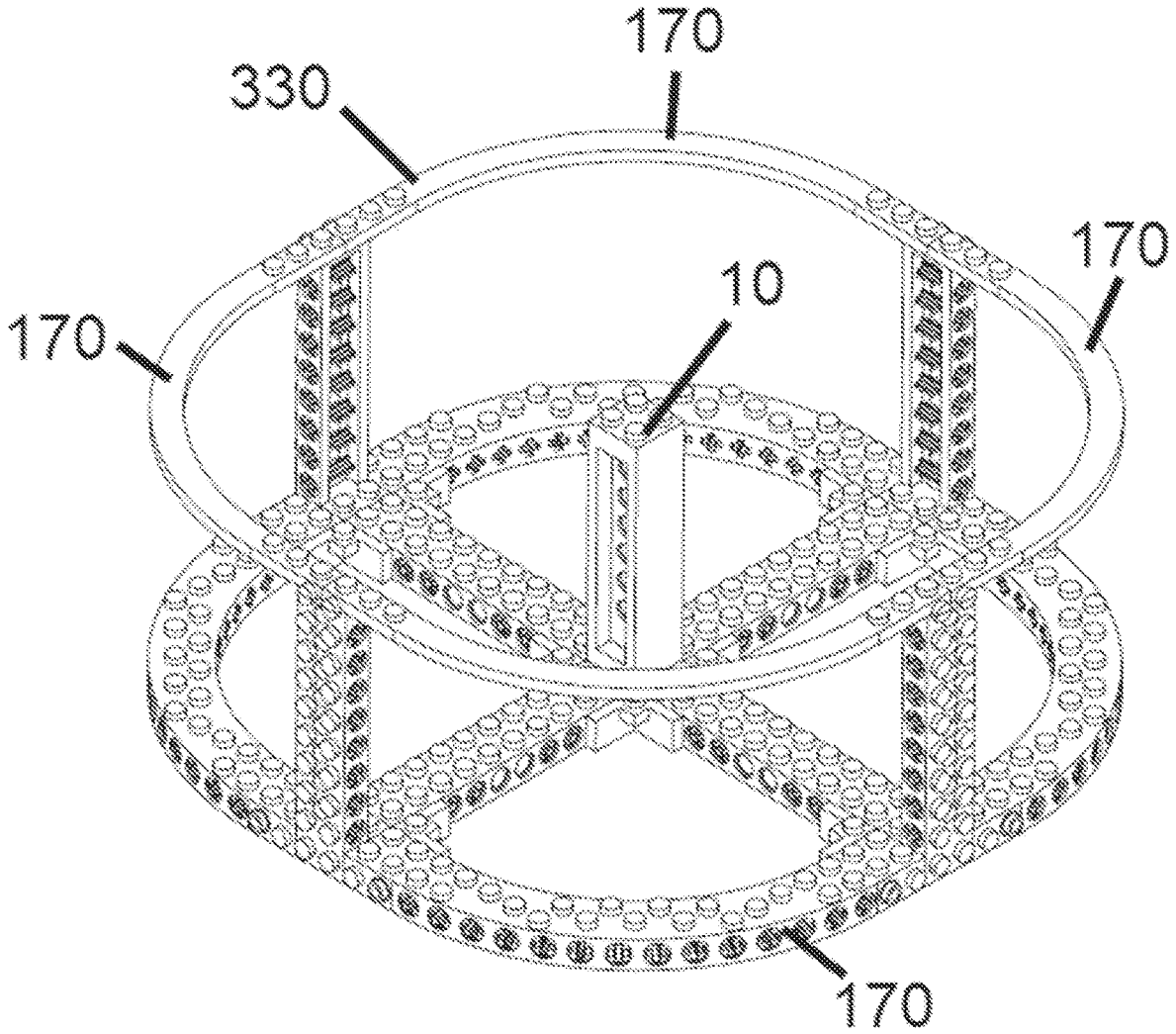
FIG. 17 is a perspective view of a floor comprising a plurality of curved beam units removably secured to a central unit, according to multiple embodiments and alternatives.
Figure 18A:
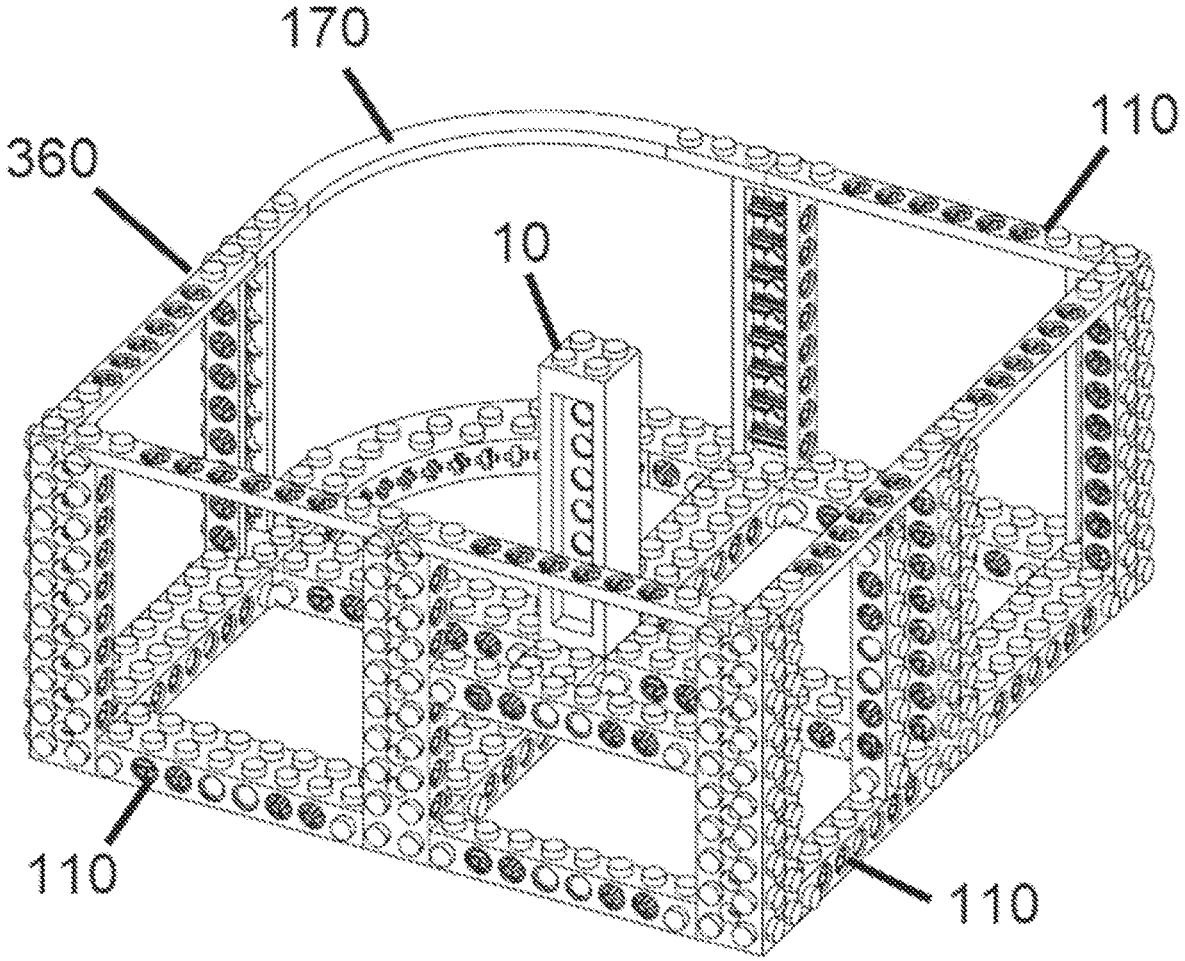
FIGS. 18A-18B are perspective views of a floor comprising a curved beam unit and a plurality of tie beam corner units removably secured to a central unit, according to multiple embodiments and alternatives.
Figure 18B:
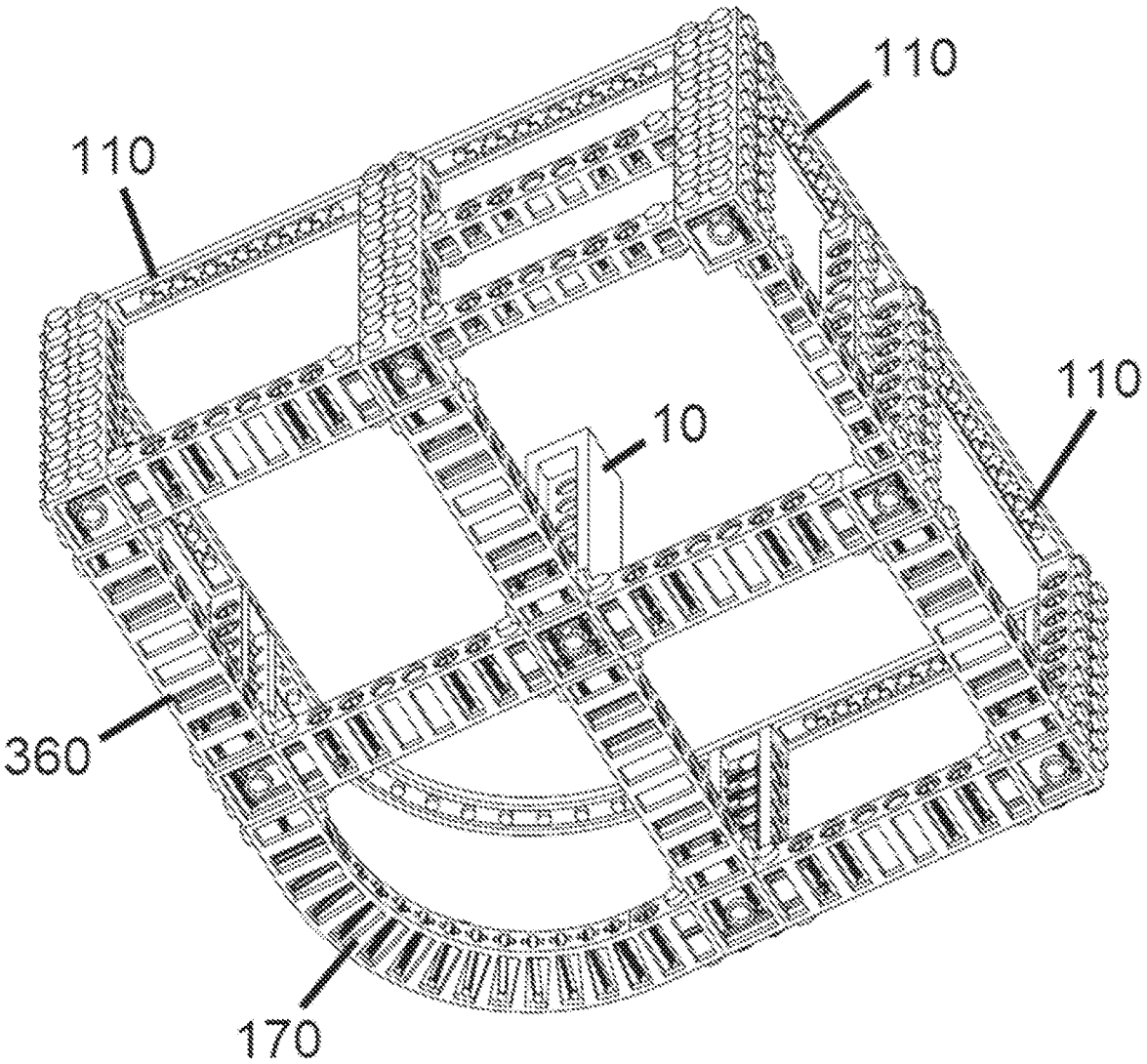
Figure 19B:
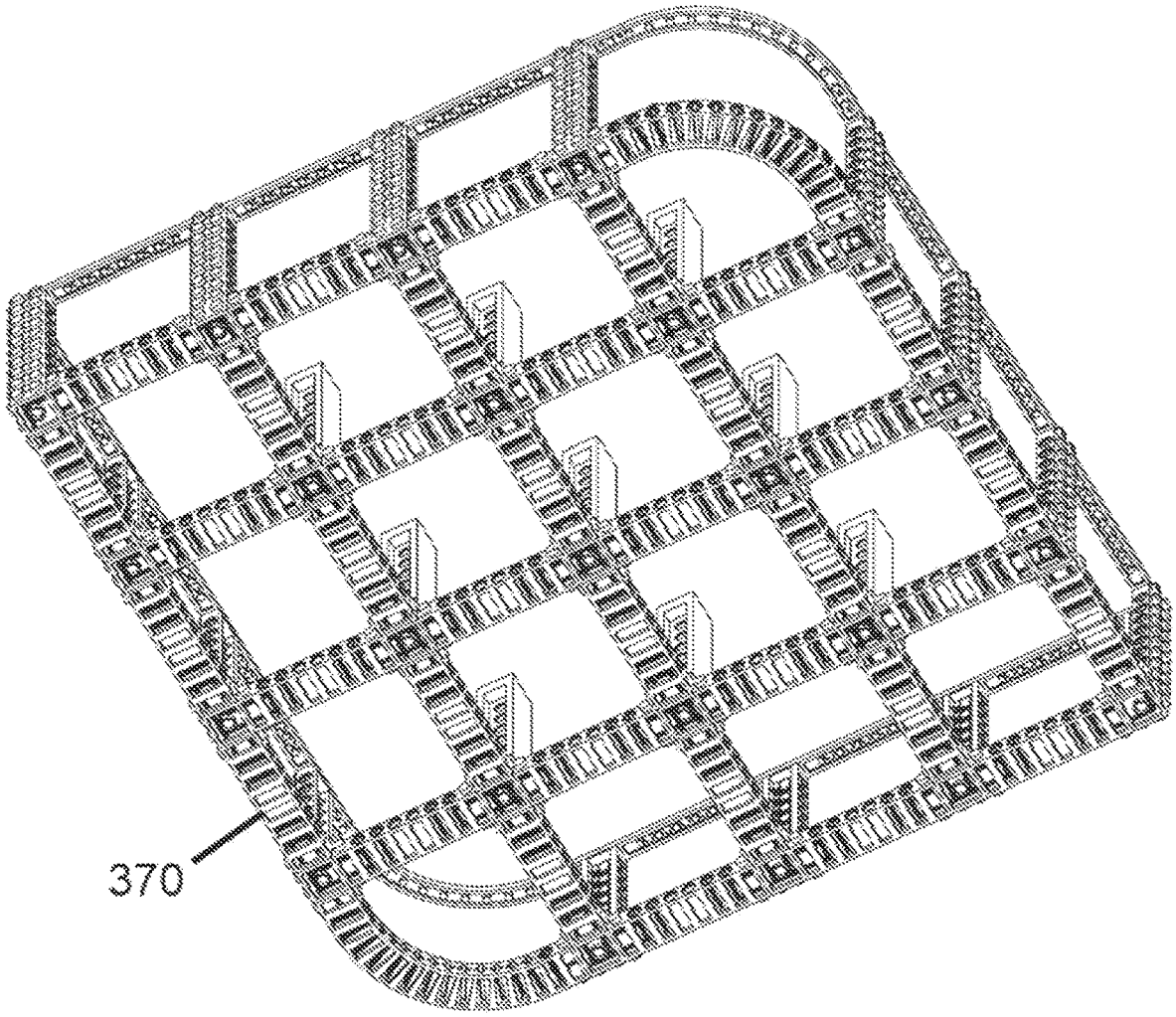
Figure 20:
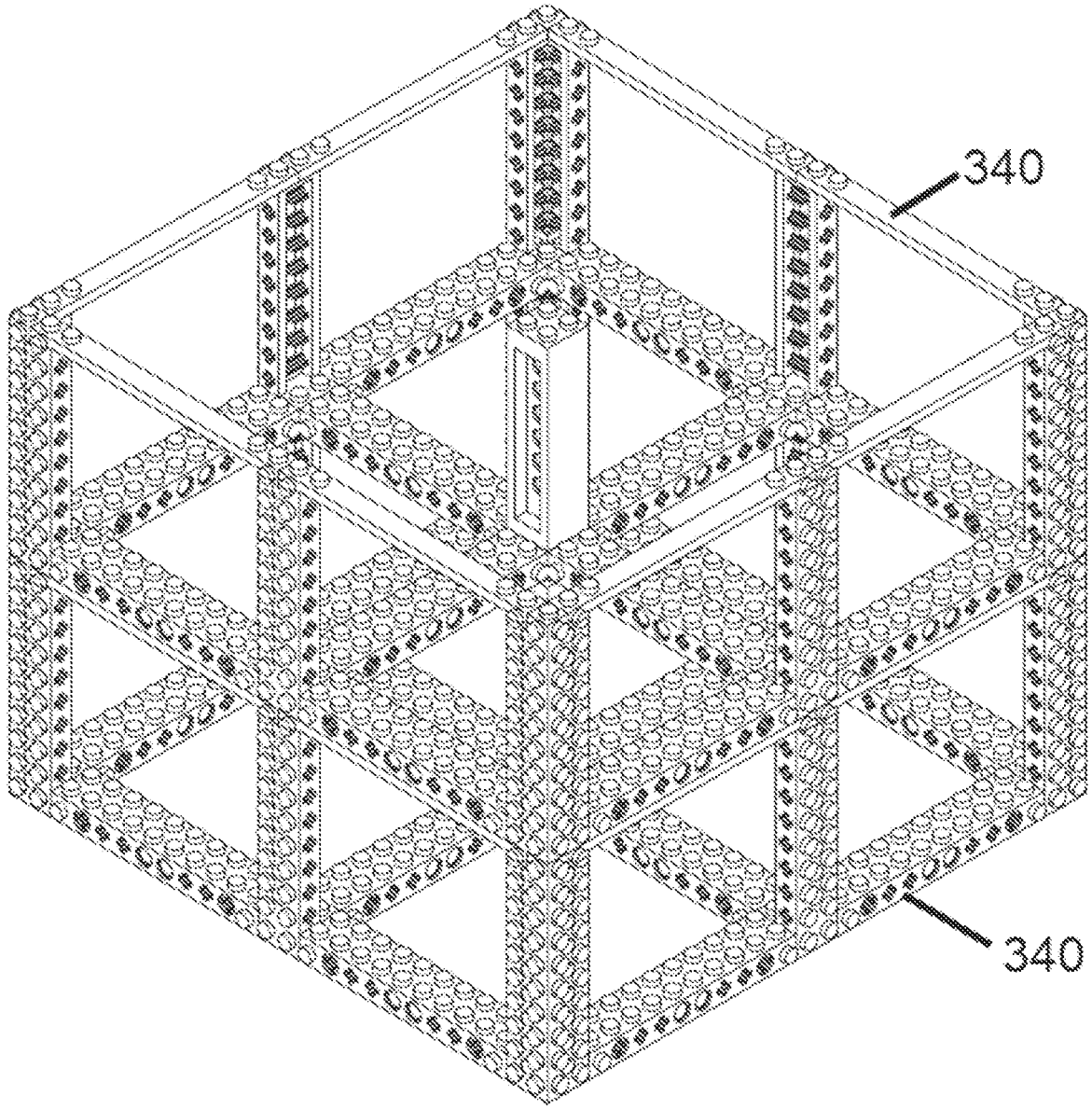
FIG. 20 is a perspective view of a pair of stacked floors, according to multiple embodiments and alternatives.
Figure 21:
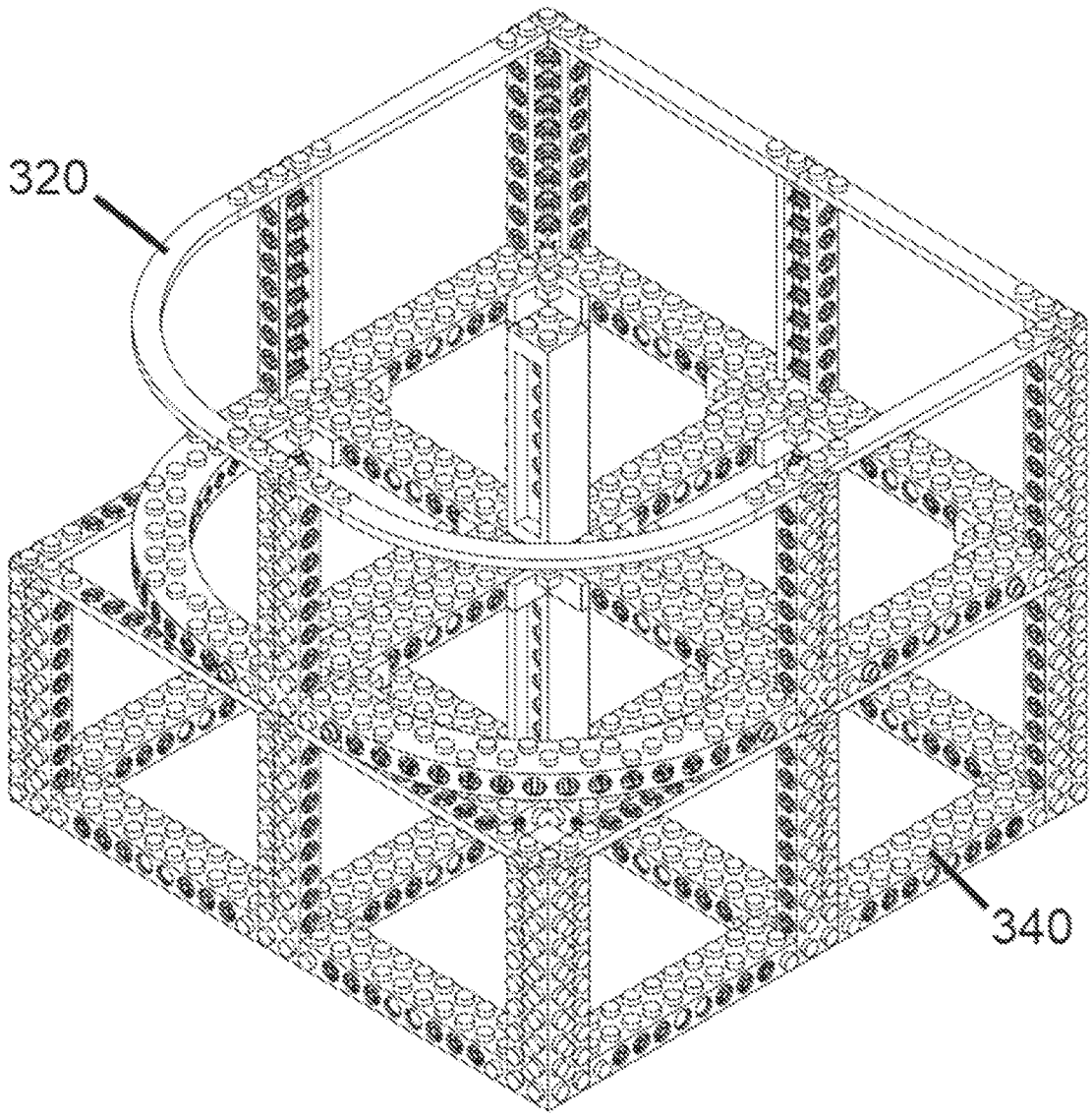
FIG. 21 is a perspective view of a pair of stacked floors, according to multiple embodiments and alternatives.
Figure 22:
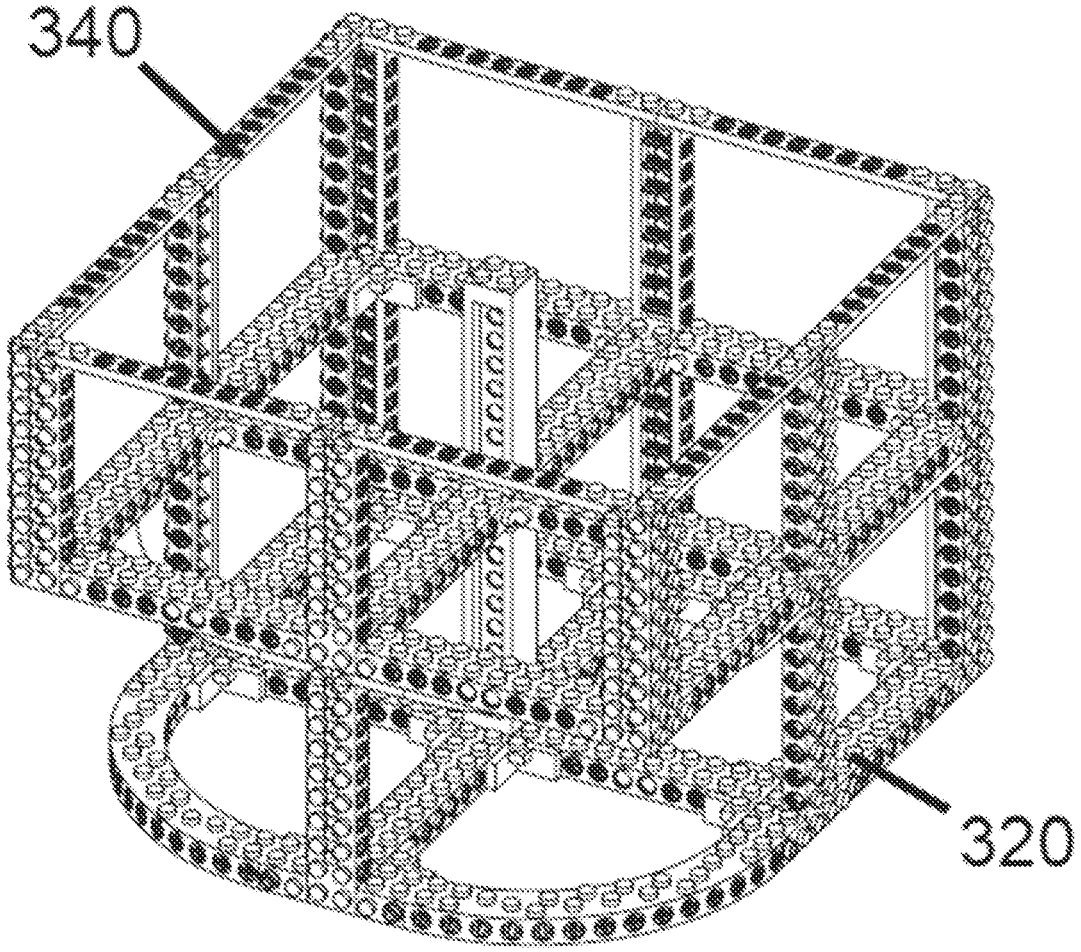
FIG. 22 is a perspective view of a pair of stacked floors, according to multiple embodiments and alternatives.
Figure 23:
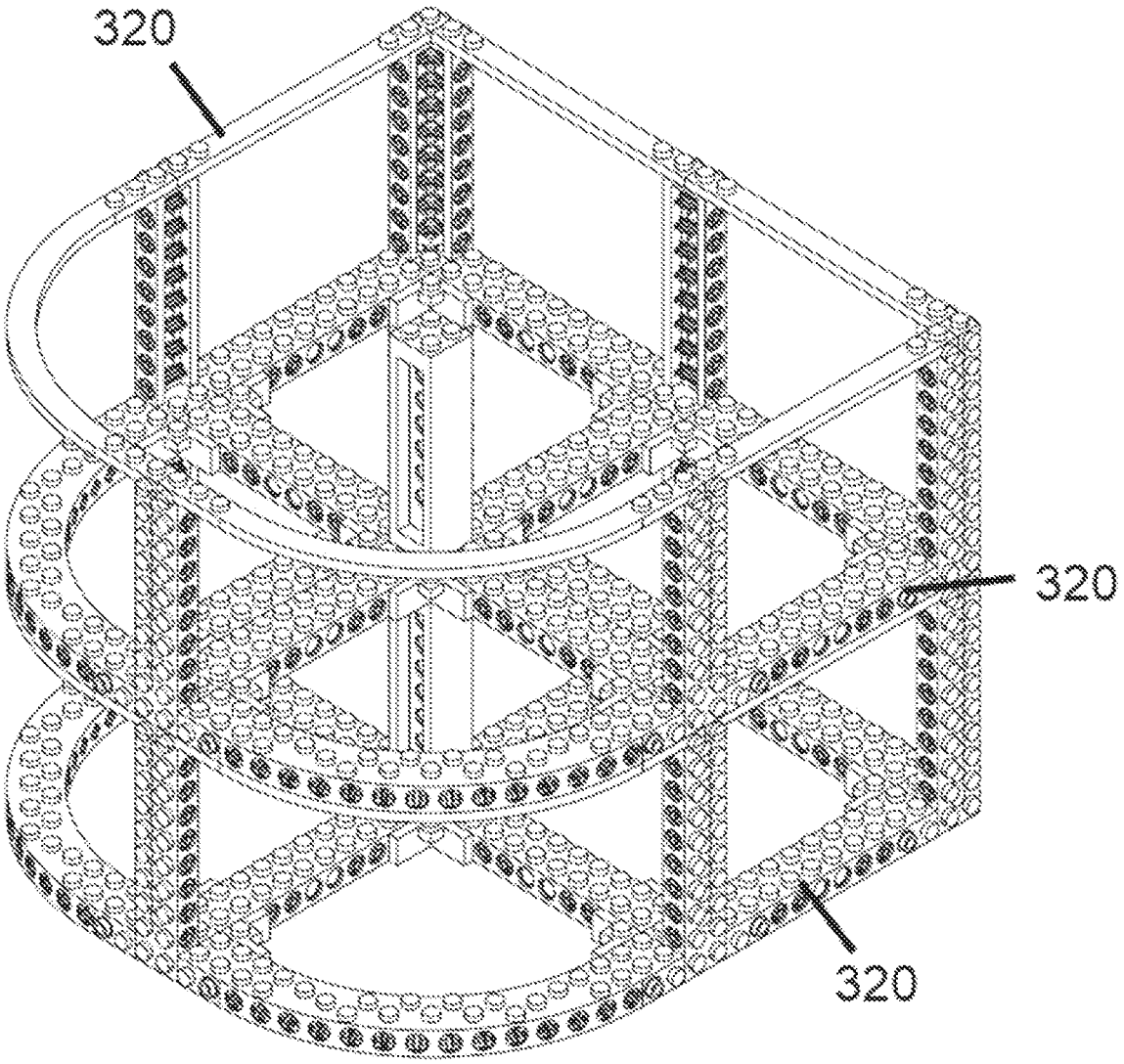
FIG. 23 is a perspective view of several stacked floors, according to multiple embodiments and alternatives.
Figure 24:
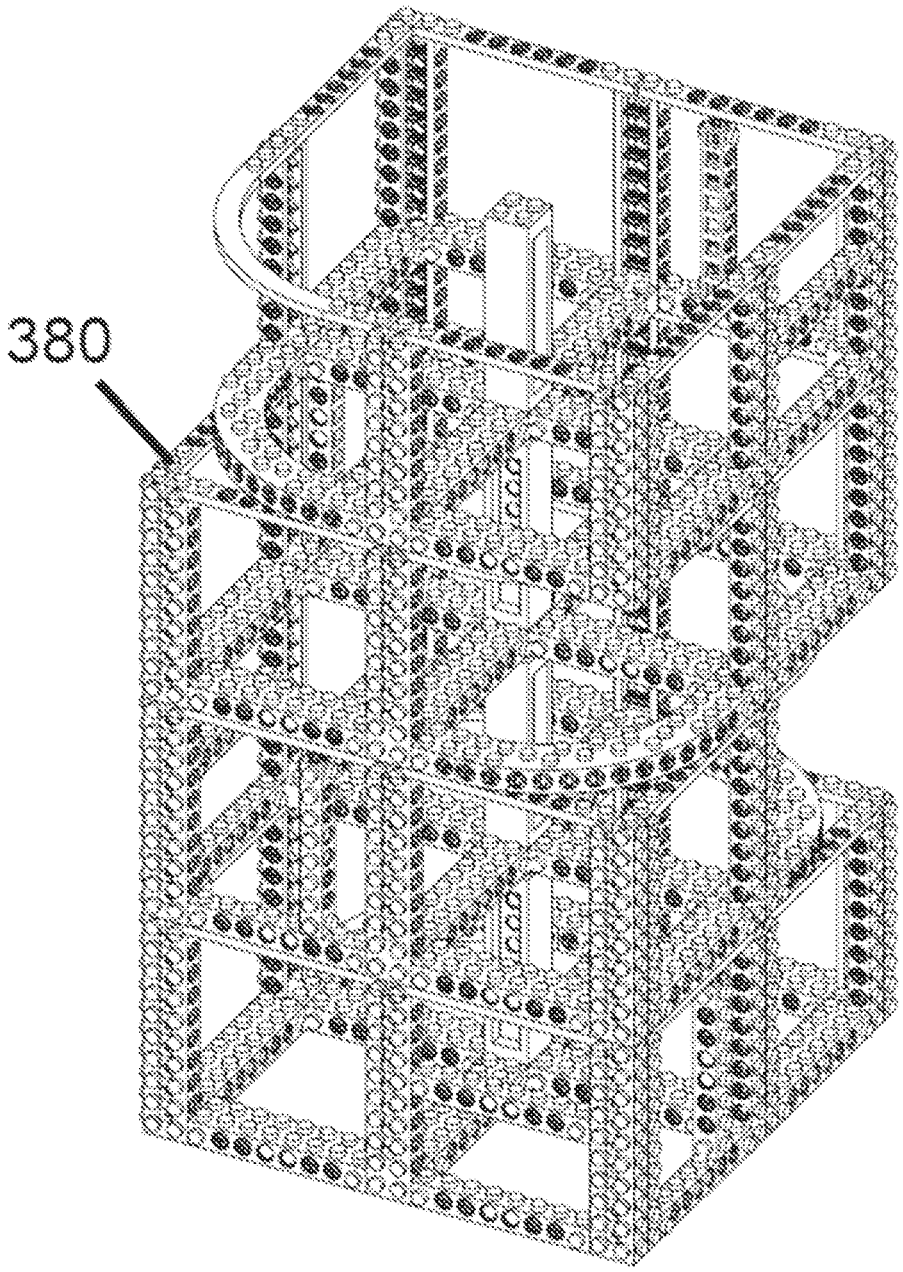
FIG. 24 is a perspective view of several stacked floors, according to multiple embodiments and alternatives.
Figure 25:
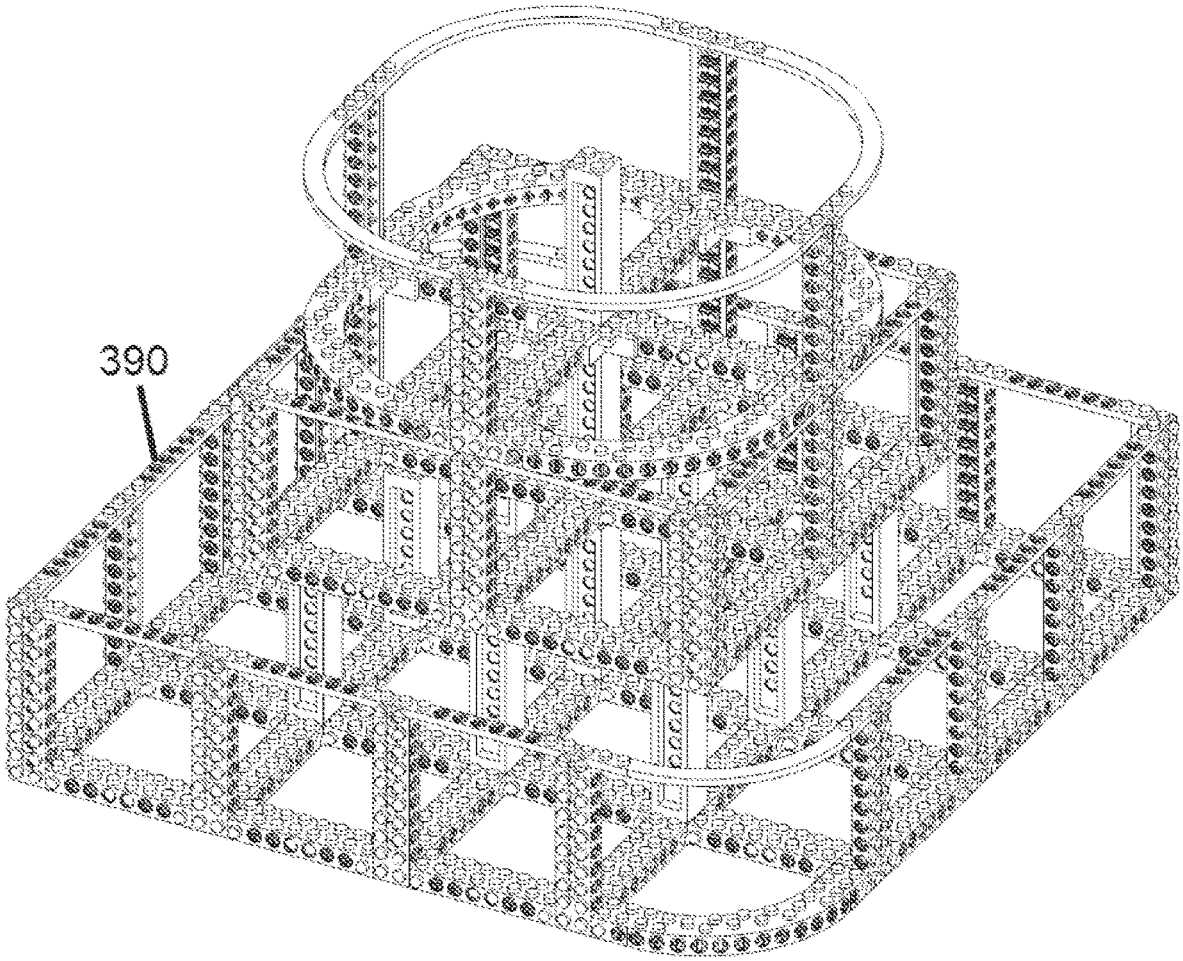
FIG. 25 is a perspective view of several stacked floors, according to multiple embodiments and alternatives.

FIGS. 3A-3B illustrate a floor 320 comprising a central unit 10 interlocked with a pair of tie beam corner units 110 and a pair of curved beam units 170. FIG. 15 illustrates a floor 340 comprising a central unit 10 interlocked with a plurality of tie beam corner units 110. FIG. 16 illustrates a floor 350 comprising a central unit 10 interlocked with a single tie beam corner unit 110, and a plurality of curved beam units 170. FIG. 17 illustrates a floor 330 comprising a central unit 10 interlocked with a plurality of curved beam units 170. FIGS. 18A-18B illustrate a floor 360 comprising a central unit 10 interlocked with a single curved beam unit 170 and a plurality of tie beam corner units 110. As discussed in more detail below, FIG. 18 also illustrates the tie beam 51 which comprises a single row of studs and is adapted to connect horizontally or vertically to other components in the system 5. FIGS. 19A-19B illustrate floor 370 comprising a plurality of central units 10 interlocked to form a central portion of floor 370, a plurality of outer mid-columns 75 interlocked with the plurality of central units 10 along the perimeter of said central portion, and a plurality of tie beams 52 and front cross beams 112 spanning between the plurality of outer-mid columns 75 to the perimeter of the floor 370. In FIGS. 19A-19B, a pair of tie beam corner units 110 and a pair of curved beam units 170 interlock with said central portion to form the corners of said floor 370. It will be appreciated by one of ordinary skill in the art that the system 5 can be used to create any number of configurations and combinations known to one of ordinary skill in the art. As illustrated in FIGS. 20-25, the floors 320, 330, 340, 350, 360, 370, and other floor configurations using the system, can be stacked upon one another to construct a variety of different three-dimensional structures and frames.

Figure 10A:
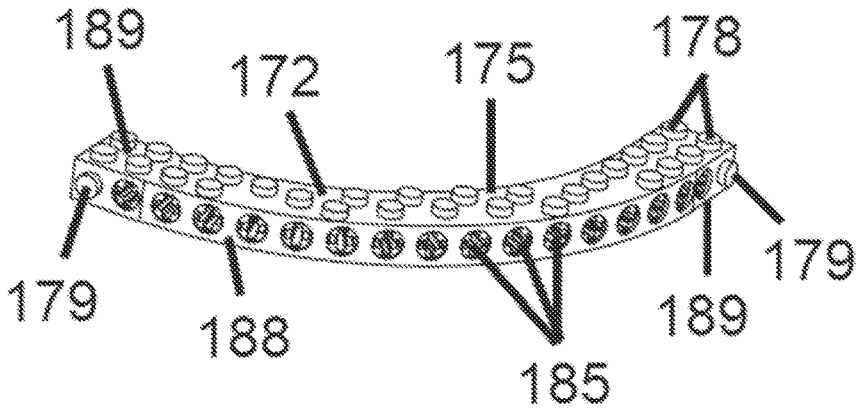
FIGS. 10A-10B are perspective views of a curved beam, according to multiple embodiments and alternatives.
Figure 10B:
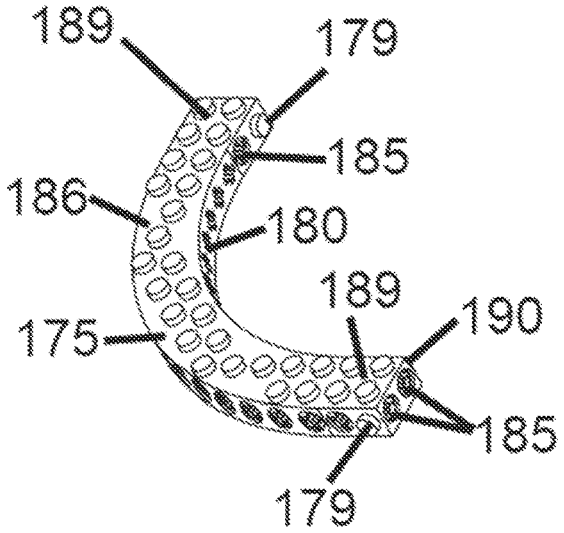
Figure 10C:
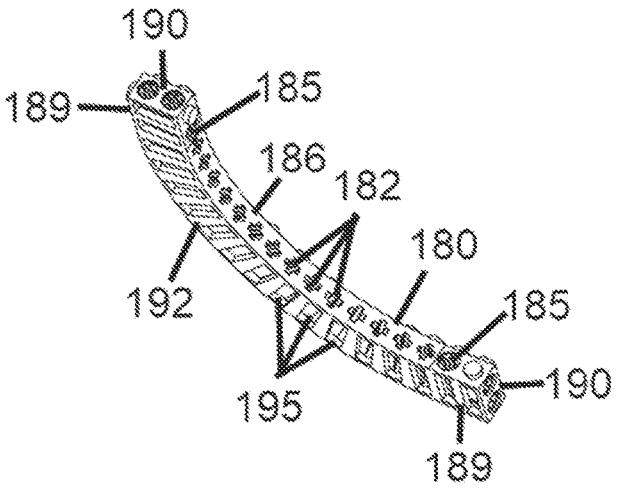
FIG. 10C is a bottom, perspective view of a curved beam, according to multiple embodiments and alternatives.
Figure 10D:
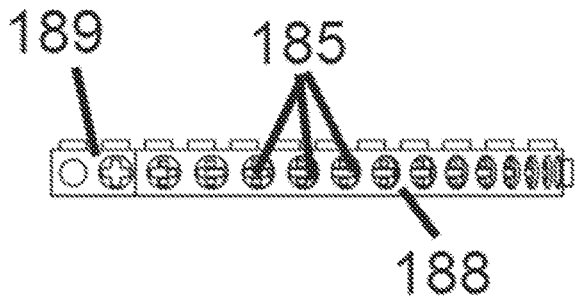
FIG. 10D illustrates an outer face of a curved beam, according to multiple embodiments and alternatives.
Figure 10E:
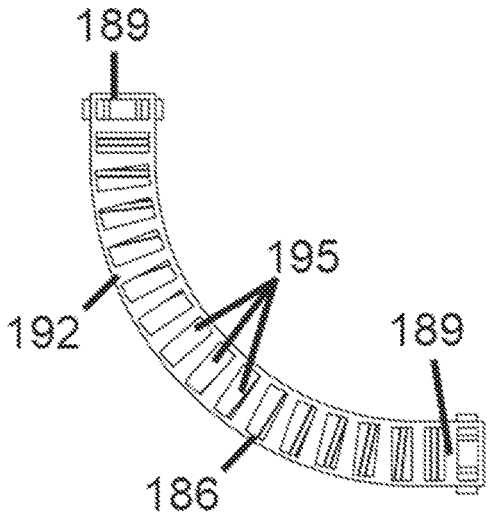
FIG. 10E is a bottom view of a curved beam, according to multiple embodiments and alternatives.

FIGS. 2, 6A-6H, and 26A-28B illustrate the single studs 73 which extend from the ends of the pair of opposing sides 60 of the tie beam 52 and the tie beam 51. As shown in FIGS. 10A-10C, in some embodiments a single stud 179 also extends from each of the sides of the end portions 189 of the curved beam 172. The single studs of the tie beams 52 and the curved beams 172 are adapted to be received within a recess 255 positioned within an external face 252 of an internal corner bracket 250. Accordingly, the internal corner bracket 250 is adapted to secure the system's internal connections with the tie beams 52 and the curved beams 172. As shown in FIGS. 2-3B (as non-limiting examples), when a pair of tie beams 52 engage a pair of adjacent sides of the center connector 35 (or the internal faces 155 of a corner column 140), the internal corner bracket 250 provides additional support for the connection by receiving the single studs which extend from the ends of the sides 60 of the tie beam 52. Likewise, the internal corner bracket 250 can be used to support other beam connections in the system 5 which occur at about a ninety degree angle, such as the connection between a tie beam 52, an outer mid-column 75, and a curved beam 172.

As illustrated in FIGS. 2-3A, in some embodiments a cross stud receiving bore is positioned proximal to the single stud which extends from each of the sides of the end portions 189 of the curved beam 172. In some embodiments, a cross stud receiving bore is also positioned proximal to the single stud which extends from the ends of the pair of opposing sides 60 of the tie beams 52, 51. When a cross stud 238 is received within said stud cross stud receiving bore (positioned adjacent to the single stud on the sides of beams 172, 52, 51), the internal corner bracket 250 is further adapted to receive said cross stud 238, as well as the single stud on the sides of beams 51, 52, 172, to provide further support for the various internal beam connections.

FIGS. 4A-14D illustrate the individual components of the system 5. As shown in FIGS. 4A-4D, the center column 12 comprises a first pair of opposing sides 25 (each defining a recess 28) and a second pair of opposing sides 32 (each having a flat surface). A plurality of borings 30 extend between the first pair of opposing sides 25 and extend along a length of the center column 12. The center column 12 further comprises a top surface 15 having a series of studs 18 (in a 2×2 pattern [i.e. two studs wide and two studs long], as a non-limiting example) and a bottom 20 having a stud receiving bore 22. The stud receiving bore 22 is adapted to receive and engage the top surface 38 of a center connector 35, and the top surface 15 of the center column 12 is adapted to receive and secure to the bottom 48 of a center connector 35.

Figure 5A:
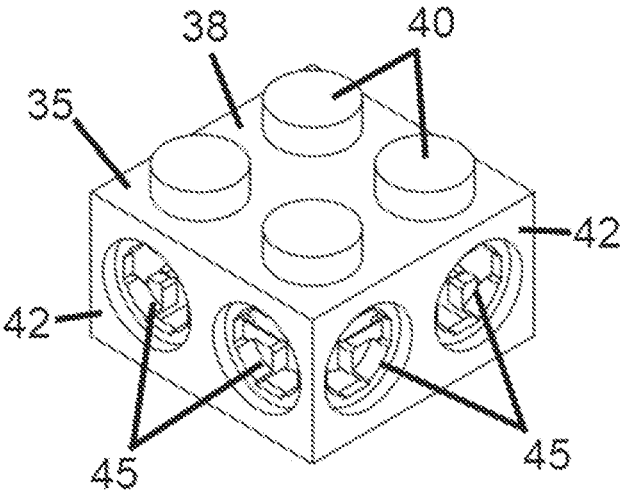
FIG. 5A is a perspective view of a center connector, according to multiple embodiments and alternatives.
Figure 5B:
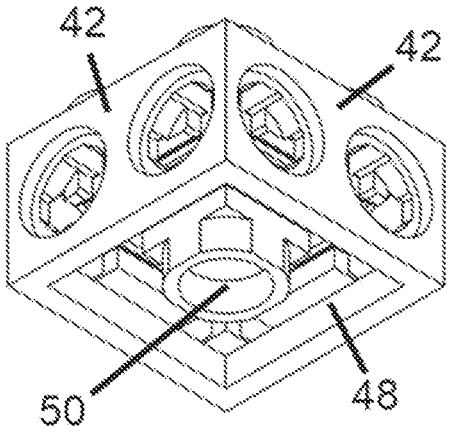
FIG. 5B is a bottom, perspective view of a center connector, according to multiple embodiments and alternatives.
Figure 5C:
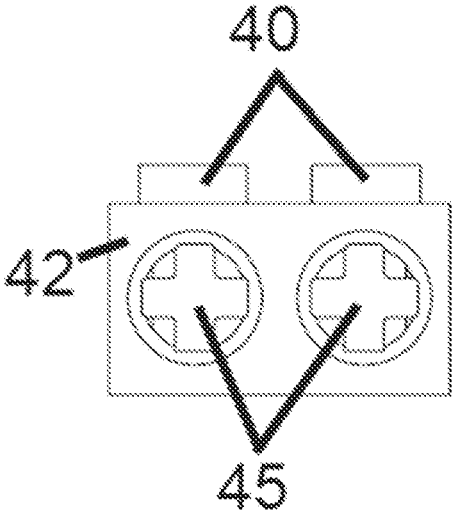
FIG. 5C is a side view of a center connector, according to multiple embodiments and alternatives.

FIGS. 5A-5C illustrate the center connector 35 having a top surface 38, a plurality of identical sides 42, and a bottom 48 defining a stud receiving bore 50. Each of the sides 42 of the center connector 35 define at least one cross stud receiving bore 45. In some embodiments, each of the sides 42 are adapted to removably receive the end 62 of a tie beam 52 such that at least one tie beam 52 extends from one of the sides of the center connector 35. The bottom 48 of the center connector 35 is adapted to attach to the top surface of a center connector 35. The top surface 38 further comprises a series of studs 40 (in a 2×2 pattern, as a non-limiting example), and said top surface 38 is adapted to connect to the bottom 20 of the center column 12. In some embodiments, the center connector 35 is integrally connected to the center column 12, such that connector 35 and center column 12 comprise a single, integral component.

FIGS. 6A-6F illustrate the tie beam 52 having a top surface 55 with a first row and a second row of studs 58 (in a 2×10 pattern as a non-limiting example), a pair of opposing sides 60, a pair of opposing ends 62, and a bottom 70. On each of the opposing sides 60, a pair of single studs 58 extend from the ends of said sides 60, a series of cross stud receiving bores 68 are positioned proximal to said single studs, and a pair of borings 65 are positioned in the middle portion of said sides 60. The borings 65 are adapted to receive any component having a corresponding shape or geometry. The pair of opposing ends 62 are adapted to engage and secure to the bottom portion 98 of an outer mid-column 75 and/or a bottom portion 160 of a corner column 140. The pair of opposing ends 62 further define at least one cross stud receiving bore 68. The bottom 70 of the tie beam 52 defines a series of recesses 72, wherein said recesses 72 are sized to receive and engage the series of studs 138 extending from the top surface 115 of a front cross beam 112 (or any number of components have one or more corresponding studs).

Figure 6A:
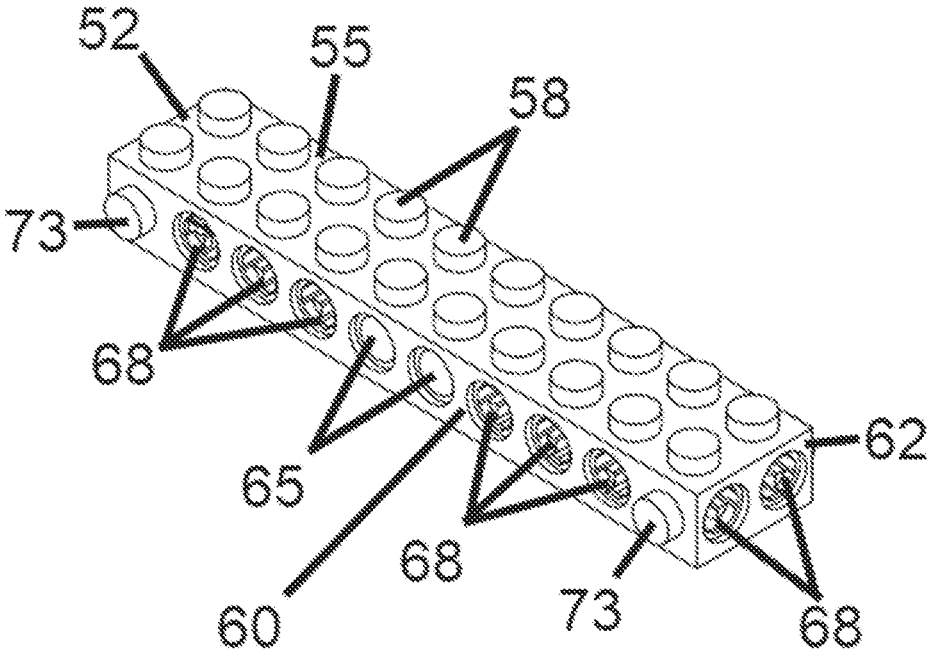
FIG. 6A is a perspective view of a tie beam, according to multiple embodiments and alternatives.
Figure 6B:
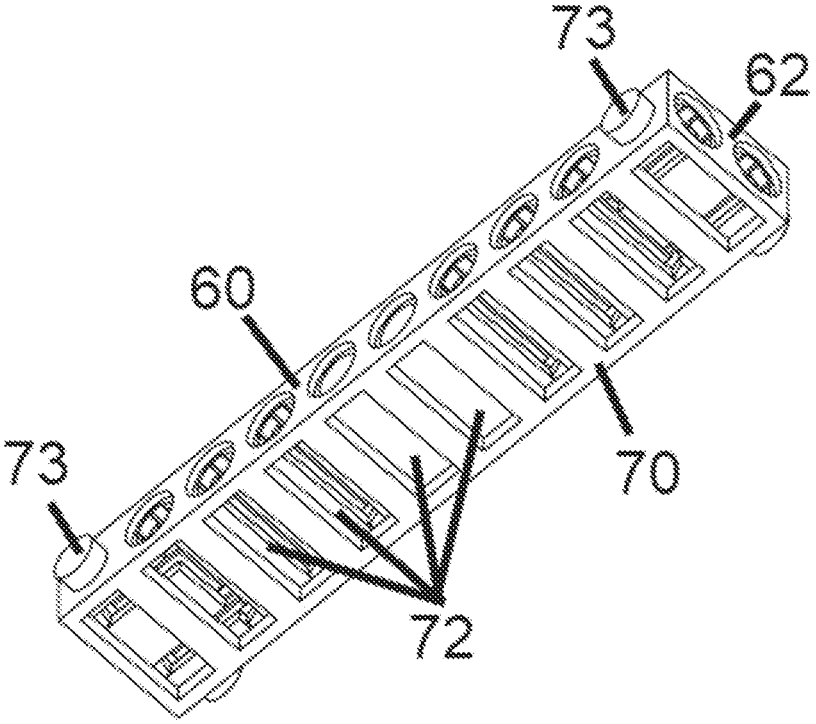
FIG. 6B is a bottom, perspective view a tie beam, according to multiple embodiments and alternatives.
Figure 6C:
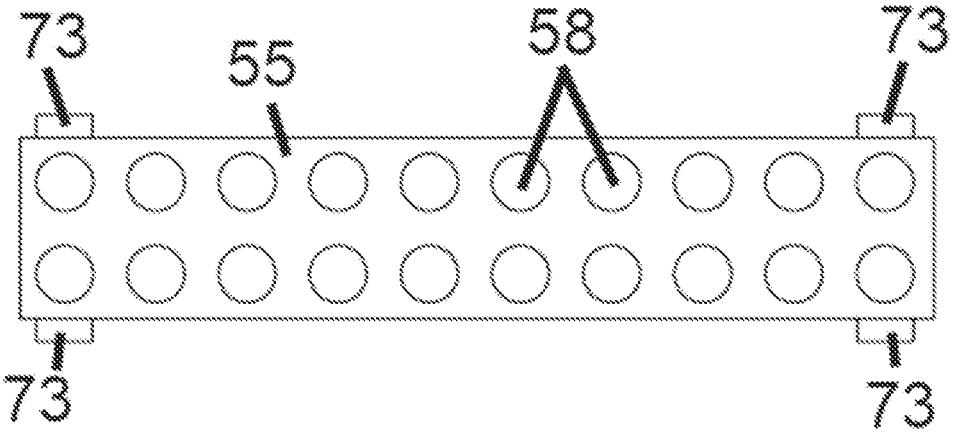
FIG. 6C is a top view of a tie beam, according to multiple embodiments and alternatives.
Figure 6D:
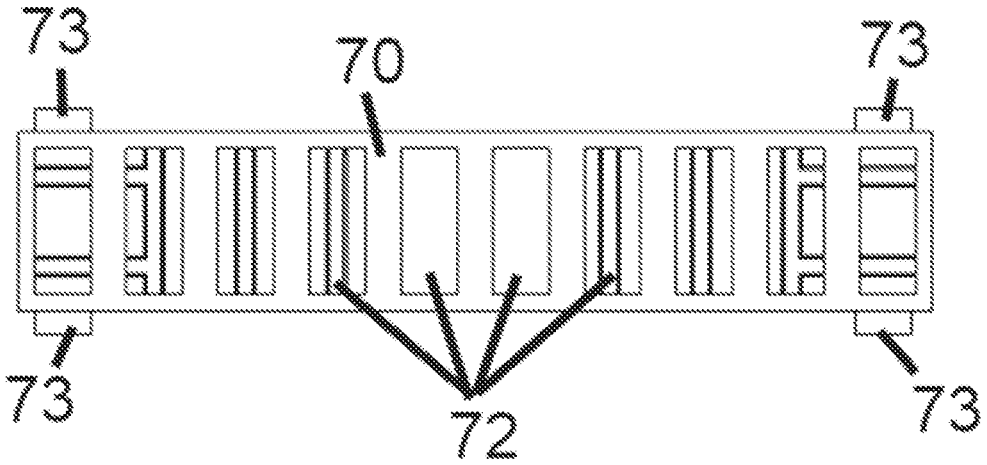
FIG. 6D is a bottom view of a tie beam, according to multiple embodiments and alternatives.
Figure 6E:
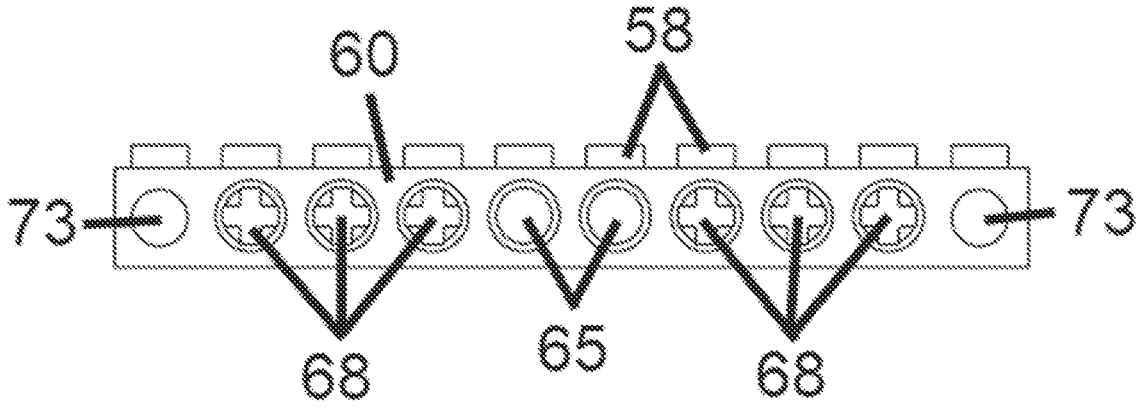
FIG. 6E illustrates a side of a time beam, according to multiple embodiments and alternatives.
Figure 6F:
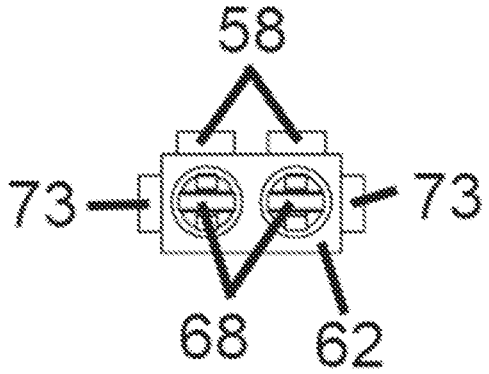
FIG. 6F illustrates an end of a tie beam, according to multiple embodiments and alternatives.
Figure 6G:
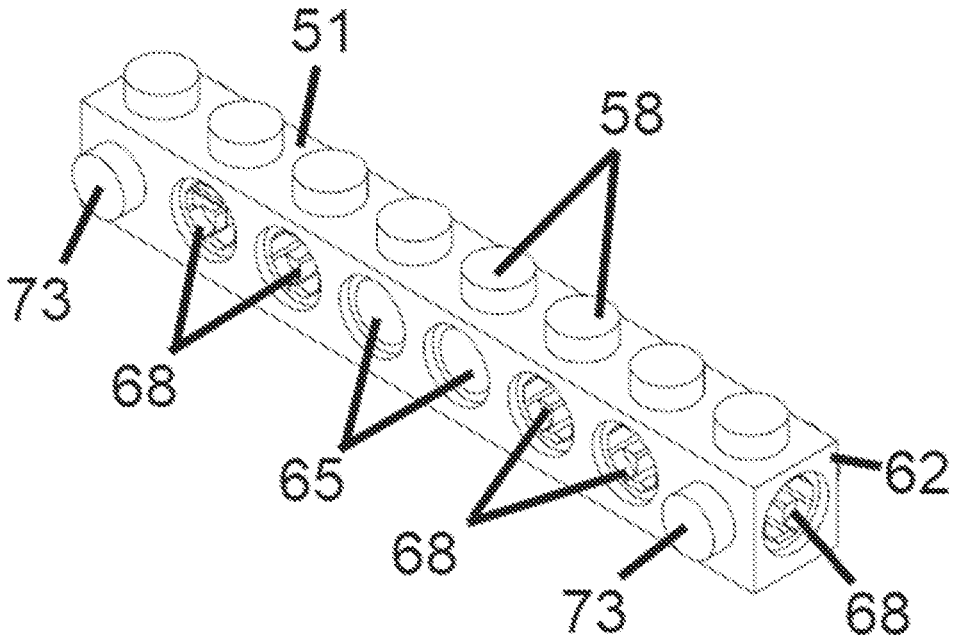
FIGS. 6G-6H illustrate perspective views of a tie beam having a single row of studs, according to multiple embodiments and alternatives.
Figure 6H:
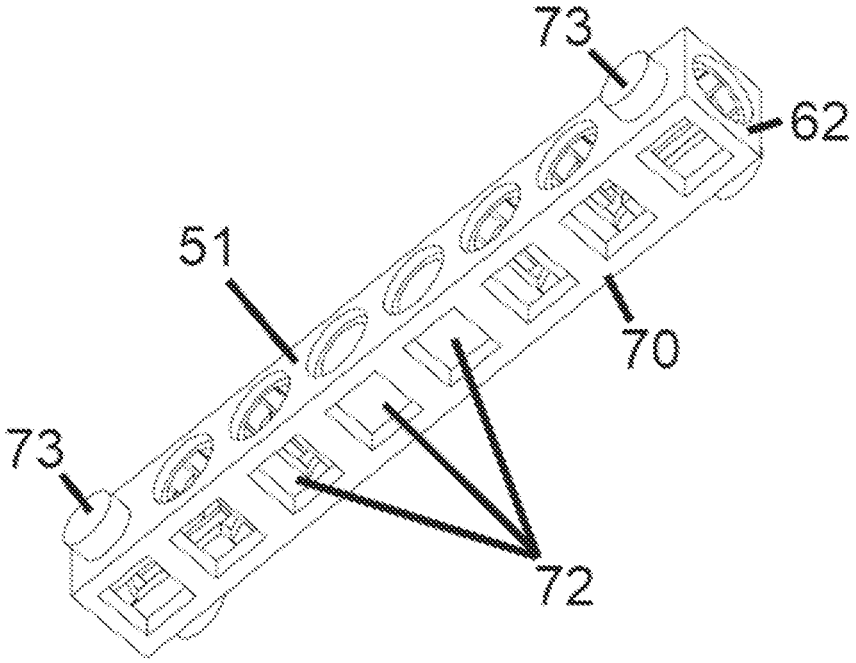

FIGS. 6G-6H illustrate the tie beam 51 having a single row of studs 58 (in a 1×8 pattern, as a non-limiting example). In some embodiments, the tie beam 51 is identically configured to tie beam 52 except tie beam 51 has a smaller width and a single row of studs 58. As best illustrated in FIGS. 18A-18B, the tie beam 51 can span horizontally between components (such as an outer mid-column 75 and a corner column 140 as a non-limiting example) or vertically (such as a front cross beam 112 and a tie beam 51 or a tie beam 52, as non-limiting examples).

Figure 7A:
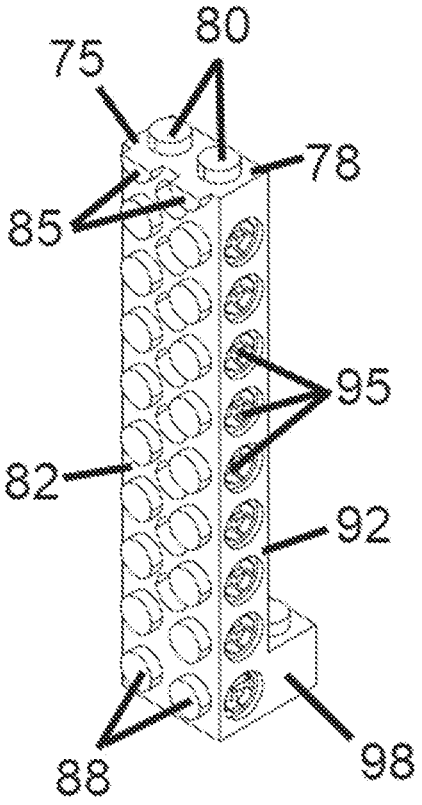
FIGS. 7A-7B are perspective views of an outer mid-column, according to multiple embodiments and alternatives.
Figure 7B:
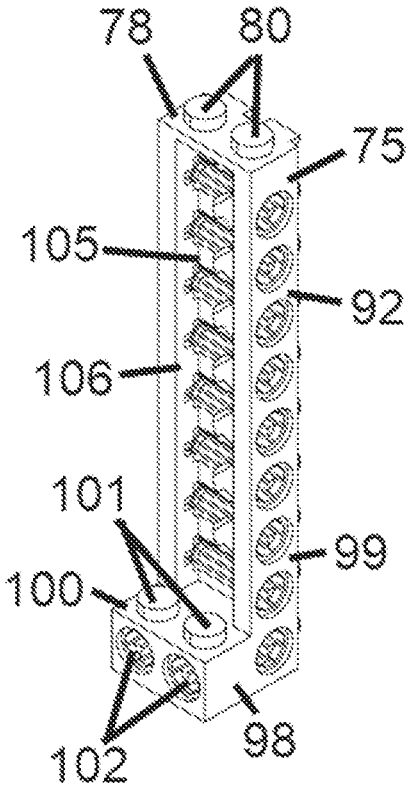
Figure 7C:
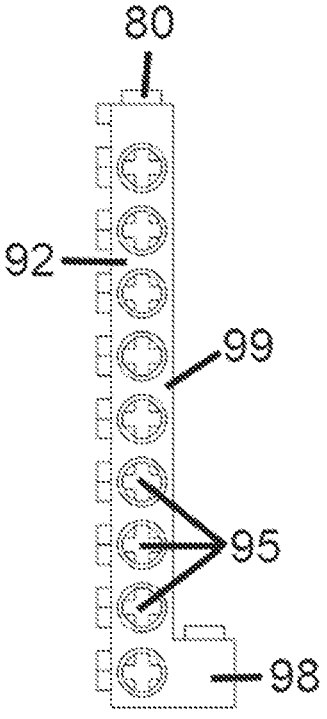
FIGS. 7C-7D are side views of an outer mid-column, according to multiple embodiments and alternatives.
Figure 7D:
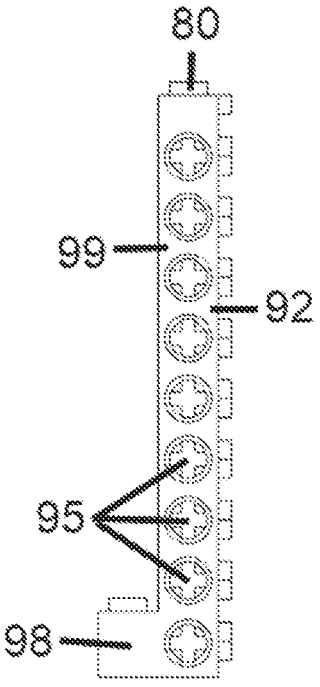

FIGS. 7A-7G illustrate the outer mid-column 75 comprising a bottom portion 98 having a cuboid shape integrally connected to a vertical portion 99. The outer mid-column 75 further comprises a top surface 78 with a pair of studs 80 (i.e. a first stud and a second stud), an external face 82, a pair of identical lateral sides 92 each having a series of cross stud receiving bores 95 along the length of said sides 92, an internal side 105 and a bottom 103. As shown in FIG. 7B, the lateral sides 92 and the internal side of the bottom portion 98 are each adapted to receive the end of a tie beam 52. In some embodiments, the adaptation at the lateral sides 92 and the internal side of the bottom portion 98 are identical and in further embodiments the adaptions are different as shown in FIG. 7B. It will be appreciated that in some embodiments, the bottom portion 98 is a separate piece from the vertical portion 99, such that the bottom portion 98 is removably secured to the bottom of the vertical portion 99.

Figure 7E:
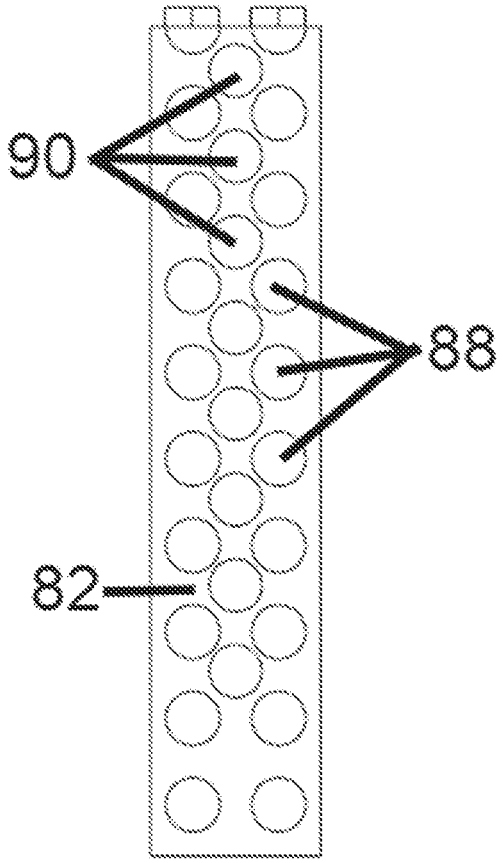
FIG. 7E is a view of an external side of an outer mid-column, according to multiple embodiments and alternatives.
Figure 7F:
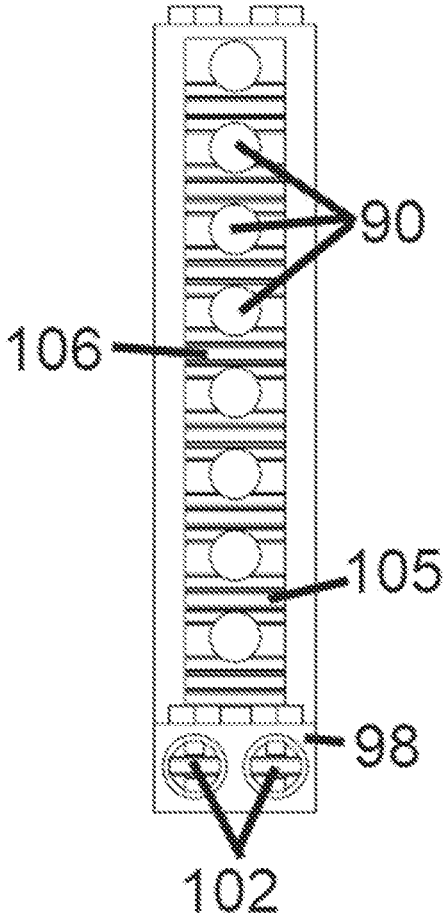
FIG. 7F is a view of an internal side of an outer mid-column, according to multiple embodiments and alternatives.
Figure 7G:
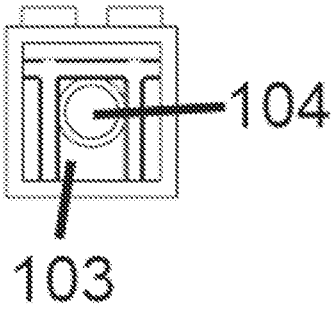
FIG. 7G is a bottom view of an outer mid-column, according to multiple embodiments and alternatives.
Figure 7H:
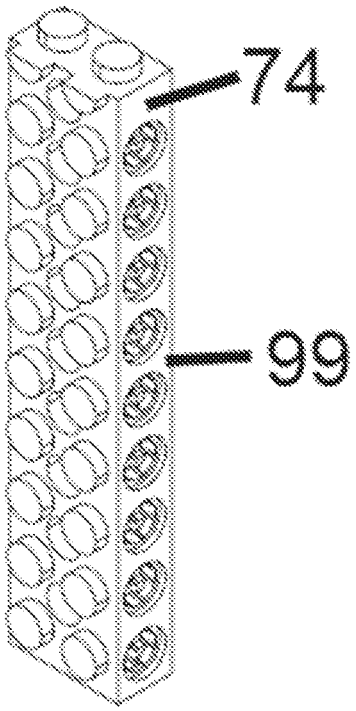
FIGS. 7H-7J are perspective views of an outer mid-column lacking a bottom portion, according to multiple embodiments and alternatives.
Figure 7I:
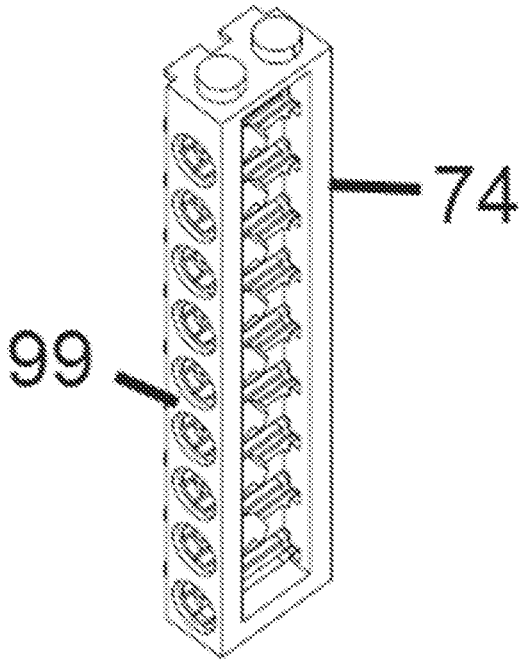
Figure 7J:
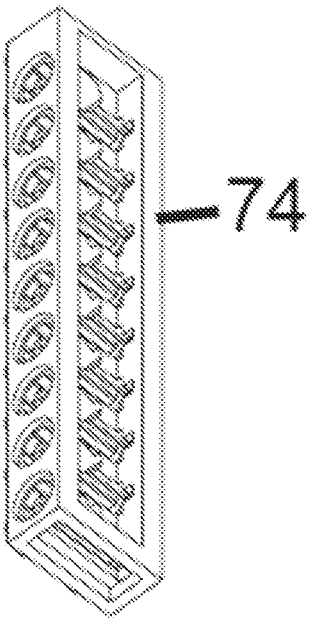
Figure 8A:
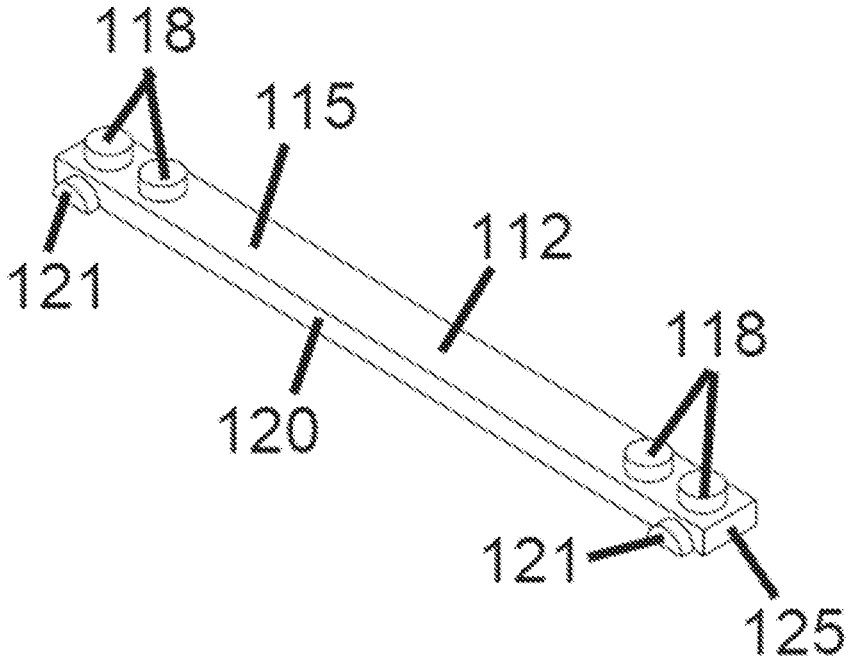
FIG. 8A is a perspective view of a front cross beam, according to multiple embodiments and alternatives.
Figure 8B:
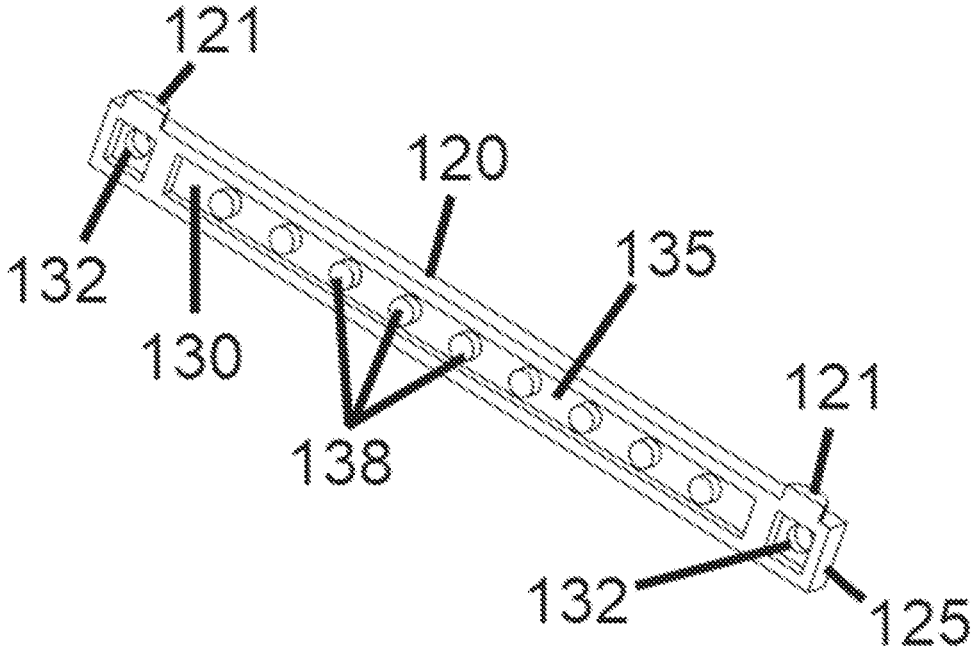
FIG. 8B is a bottom, perspective view of a front cross beam, according to multiple embodiments and alternatives.
Figure 8C:
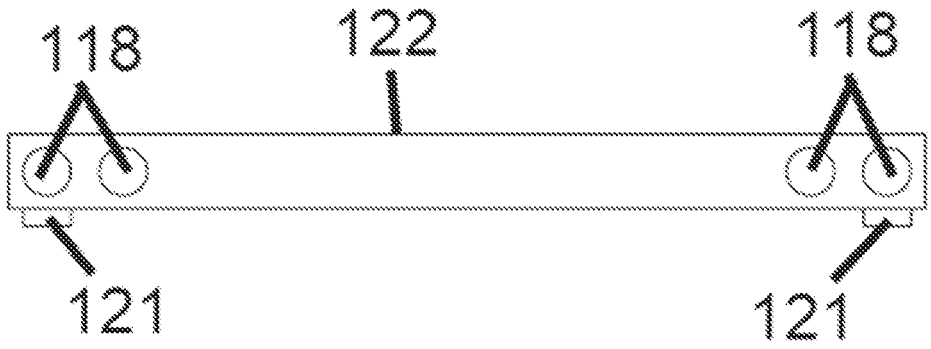
FIG. 8C is a top view of a front cross beam, according to multiple embodiments and alternatives.
Figure 8D:
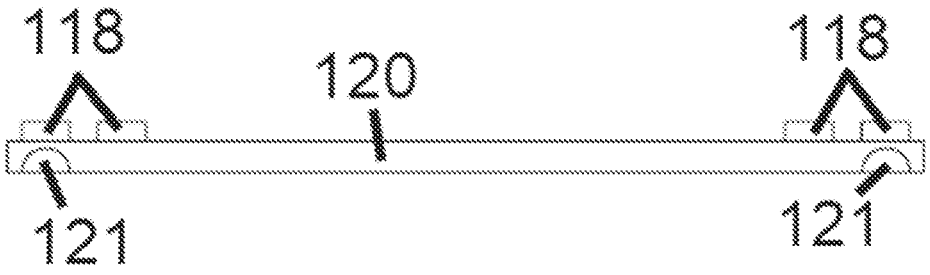
FIG. 8D illustrates an outer face of a front cross beam, according to multiple embodiments and alternatives.

As best illustrated in FIGS. 7A and 7E, the external face 82 comprises a series of studs 88 positioned in two parallel rows (in a 2×9 pattern, as a non-limiting example) and a series of borings 90 positioned between said series of studs 88 and spanning the length of said external face 82. A pair of half studs 85 (i.e. a first half stud and a second half stud) extend outward from the top surface 78 and towards the external face 82, wherein said half studs 85 are aligned with the rows of studs 88 extending from said external face 82. The half studs 85 are positioned to cooperate with corresponding half studs 121 on the front cross beam 112 and/or the half studs 210 of the curved cross beam 200 to form a full stud. The internal side 105 of the outer mid-column 75 comprises a recess 106 and a grid structure 107 to provide support for said vertical portion 99. As shown in FIG. 7F, the series of borings 90 span from the external face 82 to the internal side 105 of the vertical portion 99. The bottom portion 98 comprises a top surface 100 having a pair of studs 101, an internal side defining at least one cross stud receiving bore, and a bottom 103 having a stud receiving bore 104. The bottom 103 is adapted to mate with corresponding components having a stud, such as the pair of studs 118 extending from the ends 125 of a front cross beam 112. FIGS. 7H-7J illustrate the outer mid-column 74 comprising only a vertical portion 99 and lacking the bottom portion 98 (i.e. no ledge feature). In this manner, the outer mid-column 74 is identically configured to outer mid-column 75, except column 74 lacks the bottom portion 98 and the vertical portion 99 is extended such that the height of column 74 is equivalent to the height of column 75.

FIGS. 8A-8D illustrate the front cross beam 112 having a top surface 115, an outer face 120, an inner face 122, a pair of opposing ends 125, and a bottom 130. A pair of studs 118 are each positioned on the top surface 115 adjacent to the opposing ends 125, and a pair of half studs 121 extend from the outer face 120 adjacent to the opposing ends 125. The bottom 130 comprises a recess 135 having a series of studs 138 and a pair of stud receiving bores 132 are positioned adjacent to the ends 125.

The front cross beam 112 is adapted to span between, and removably secure with, an outer mid-column 75 and a corner column 140. In some embodiments, the pair of stud receiving bores 132 are adapted to engage a single stud, such as one of the studs 80 positioned on the top surface 78 of the outer mid-column 75 and/or one of the studs 145 on the top end 142 of the corner column 140. The half studs 121 are adapted to cooperate with corresponding half studs 85 on the top surface 78 of the outer mid-column 75 and/or the half studs 153 extending from the top end 142 of the corner column 140 to form a full stud.

FIGS. 9A-9I illustrate the corner column 140 comprising a bottom portion 160 integrally connected to a vertical portion 161 to form a generally L-shaped column. In some embodiments, the bottom portion 160 is a separate piece from the vertical portion 161, such that the bottom portion 160 is removably secured to the bottom of the vertical portion 161.

In further embodiments, the corner column 140 further comprises a top end 142, a pair of external faces 150 (i.e. a first external face and a second external face), a pair of internal faces 155 (i.e. a first internal face and a second internal face), a recess 156 positioned between said internal faces 155, and a bottom 165. Each of the external faces 150 comprises a series of studs 151 positioned in two parallel rows (in a 2×9 pattern as a non-limiting example, plus an additional stud extending from the corner block 146 which is in alignment with one of the rows of studs 151) and a series of borings 152 positioned between the series of studs 151 and extending through to the recess 156. A series of cross stud receiving bores 158 are positioned along the lengths of both internal faces 155. The corner column 140 further comprises an internal grid structure 159 to provide support for the vertical portion 161. The bottom portion 160 defines a top surface 162 positioned between the internal faces 155 and having a single stud 163. The bottom portion 160 further comprises a bottom 165 having a stud receiving bore 168. When a tie beam 52 (or beam 51) is removably secured to the bottom portion 160 of the corner column 140, the single stud 163 aligns with the first stud row or the second stud row on top of said tie beam 52 (or the stud row on the top of beam 51).

Figure 9A:
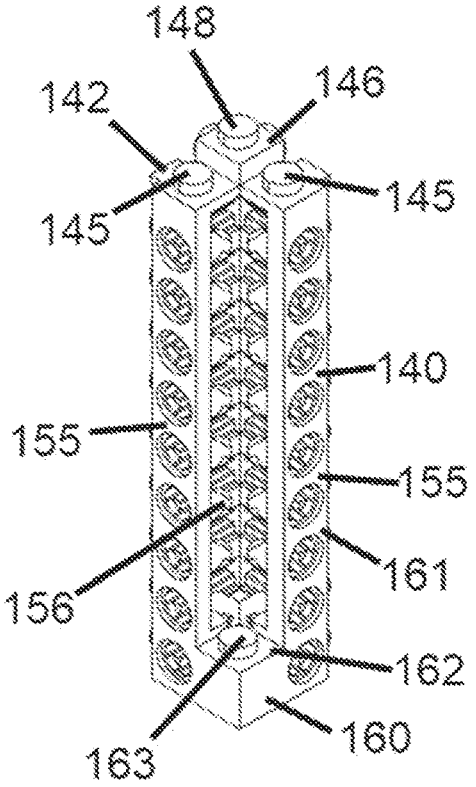
FIG. 9A is a perspective view of an internal side of a corner column, according to multiple embodiments and alternatives.
Figure 9B:
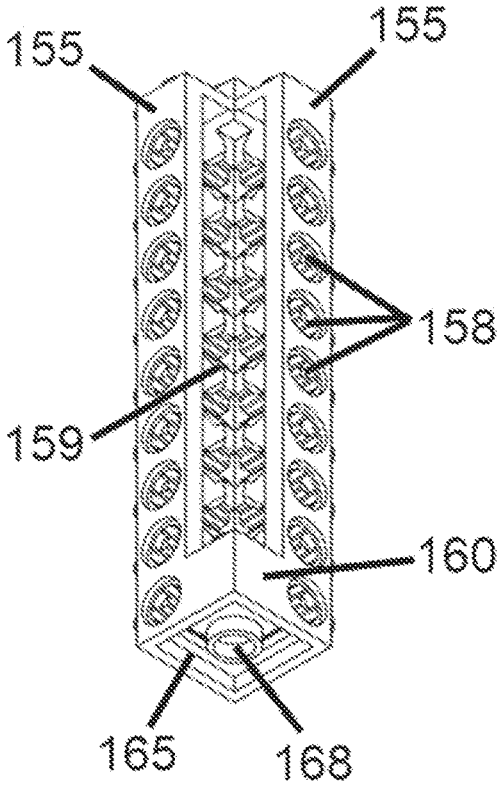
FIG. 9B is a bottom, perspective view of a corner column, according to multiple embodiments and alternatives.
Figure 9C:
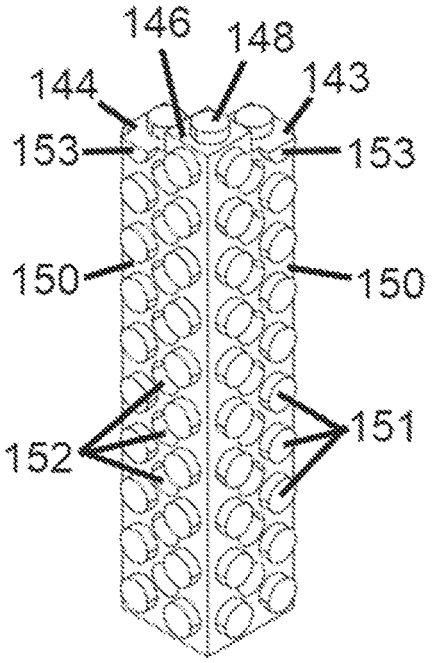
FIG. 9C is a perspective view of the external sides of a corner column, according to multiple embodiments and alternatives.
Figure 9D:
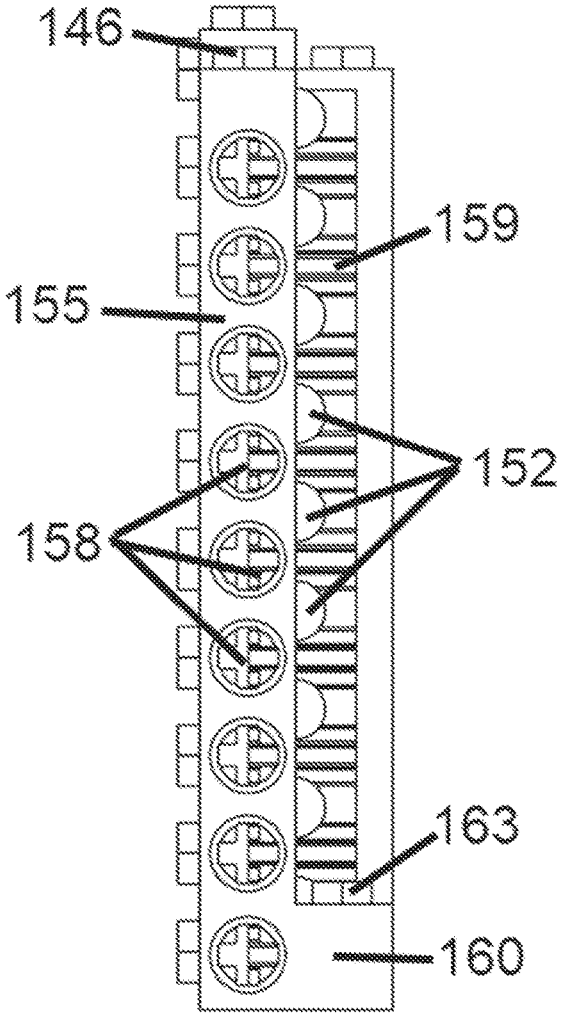
FIGS. 9D-9E illustrate the internal faces of a corner column, according to multiple embodiments and alternatives.
Figure 9E:
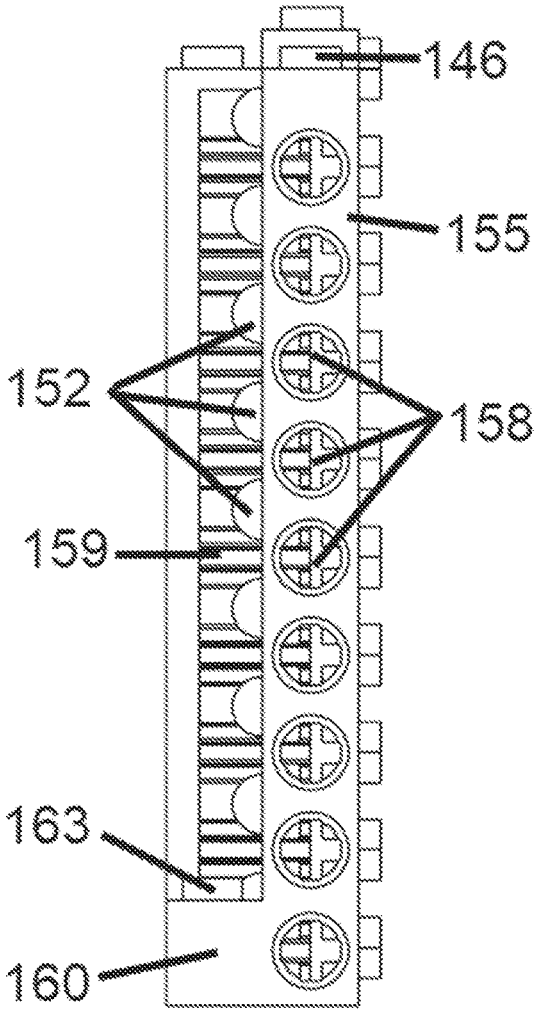
Figure 9F:
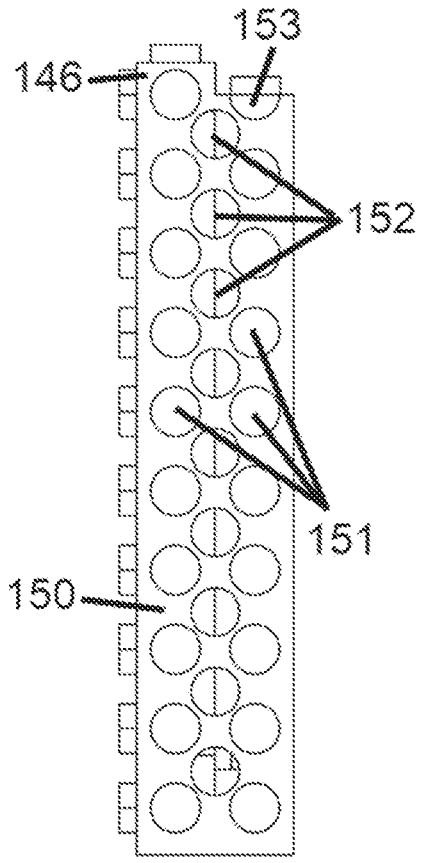
FIGS. 9F-9G illustrate the external faces of a corner column, according to multiple embodiments and alternatives.
Figure 9G:
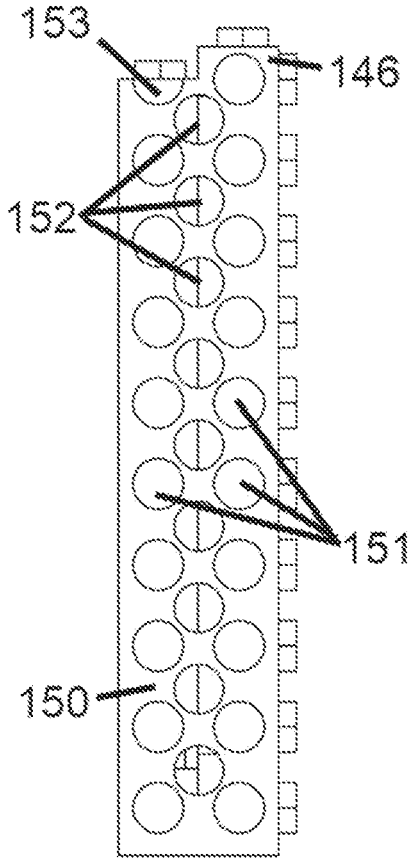
Figure 9H:
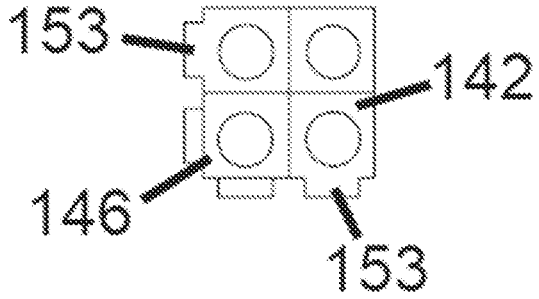
FIG. 9H is a top view of a corner column, according to multiple embodiments and alternatives.
Figure 9I:
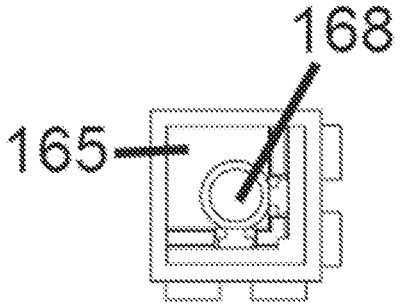
FIG. 9I is a bottom view a corner column, according to multiple embodiments and alternatives.
Figure 9J:
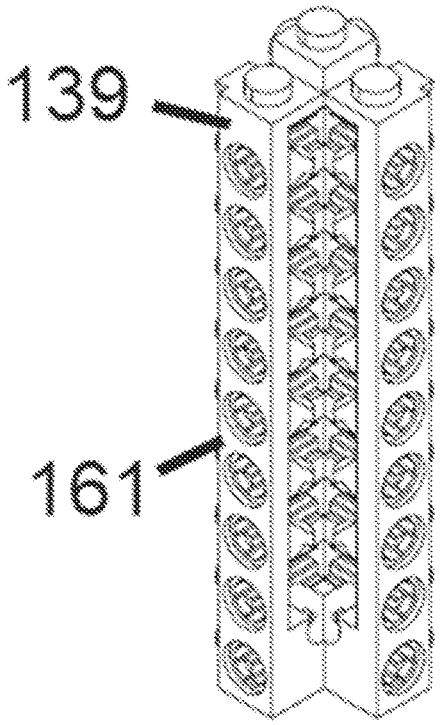
FIGS. 9J-9L are perspective views of a corner column lacking a bottom portion, according to multiple embodiments and alternatives.
Figure 9K:
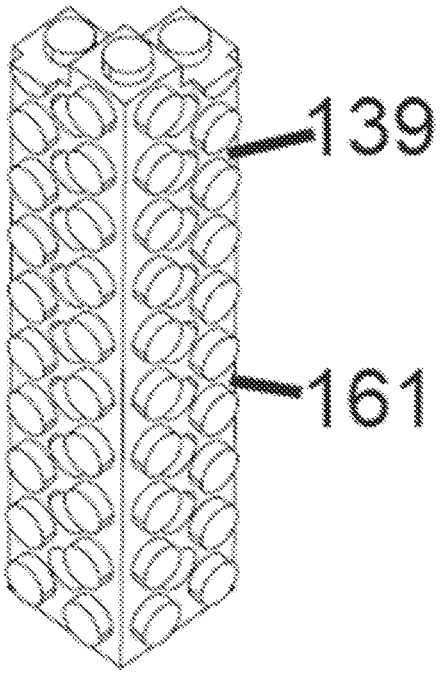
Figure 9L:
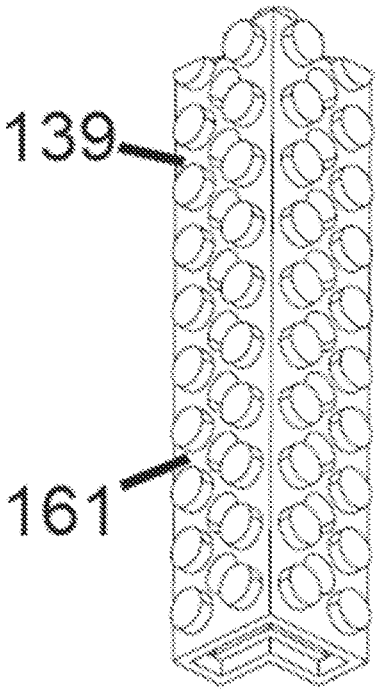

The top end 142 of the corner column 140 comprises a pair of studs 145 and a pair of half studs 153 extending from said top end 142 towards each of the external faces 150. As previously noted, the half studs 153 are adapted to mate with the half studs 121 on the front cross beam 112 and/or the half studs 210 on the curved cross beam 200 to form a full stud. A corner block 146 is integrally connected to the corner of the top end 142 and further comprises a single stud 148 on its top surface, and a pair of studs on each of the external faces 150 of said block 146. In some embodiments, the corner block 146 has a height that is equal to the height of the front cross beam 112. Accordingly, the top end 142 of the corner column 140 is adapted to receive the end 125 of a pair of front cross beams 112 and forms a flat surface (as best illustrated in FIG. 3A) that is adapted to receive a portion of an additional floor unit. As illustrated in FIG. 9C, in some embodiments the top end 142 and the corner block 146 define a first front cross beam receiving surface 143 being adapted to receive a first front cross beam 112 and a second front cross beam receiving surface 144 being adapted to receive a second front cross beam 112. A first half stud extends outwards from the first front cross beam receiving surface 143 towards the first external face of the corner column 140 and a second half stud extends outwards from the second front cross beam receiving surface 144 towards the second external face of the corner column 140. In further embodiments, a first stud extends upwards from said first front cross beam receiving surface 143 and a second stud extends upwards from said second front cross beam receiving surface 144. FIGS. 9J-9L illustrate the corner column 139 comprising only the vertical portion 161 described in detail above. In this manner, the sides of the corner column 139 are adapted to receive one or more tie beams 52, 51 and the top of said corner column 139 is adapted to receive at least one front cross beam 112. The bottom of the corner column 139 is adapted to receive one or more studs of another component.

Figure 10F:
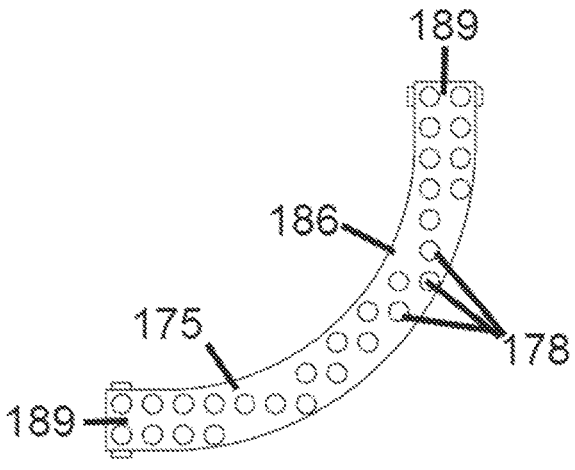
FIG. 10F is a top view of a curved beam, according to multiple embodiments and alternatives.
Figure 11A:
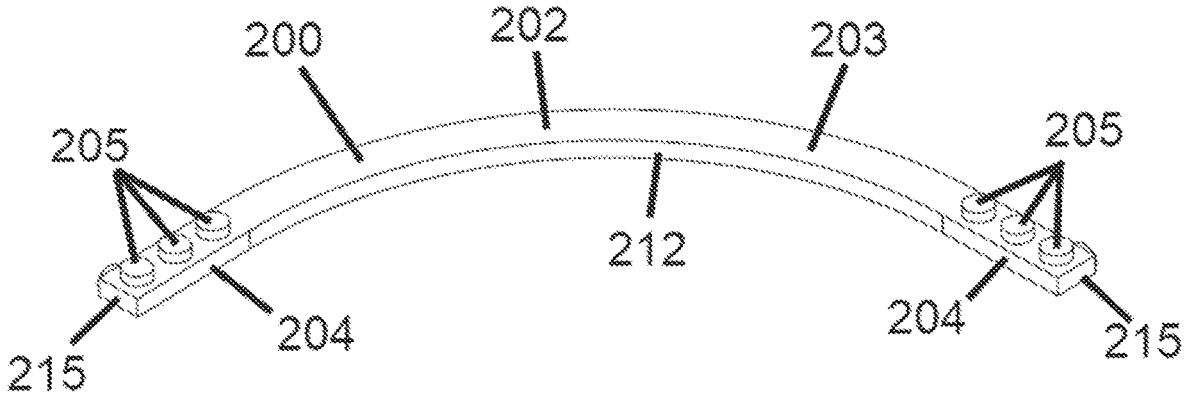
FIG. 11A is a perspective view of an curved cross beam, according to multiple embodiments and alternatives.
Figure 11B:
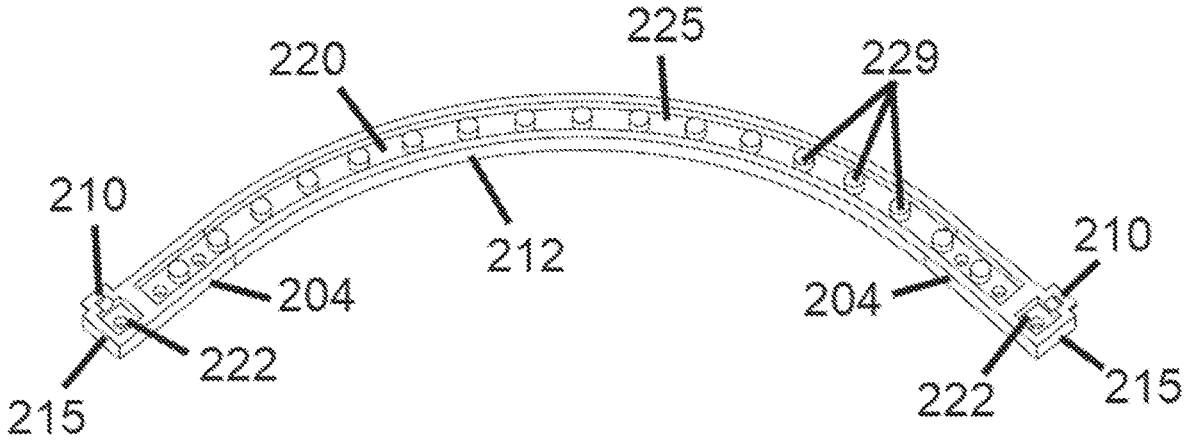
FIGS. 11B-11C are bottom, perspective views of an curved cross beam, according to multiple embodiments and alternatives.
Figure 11C:
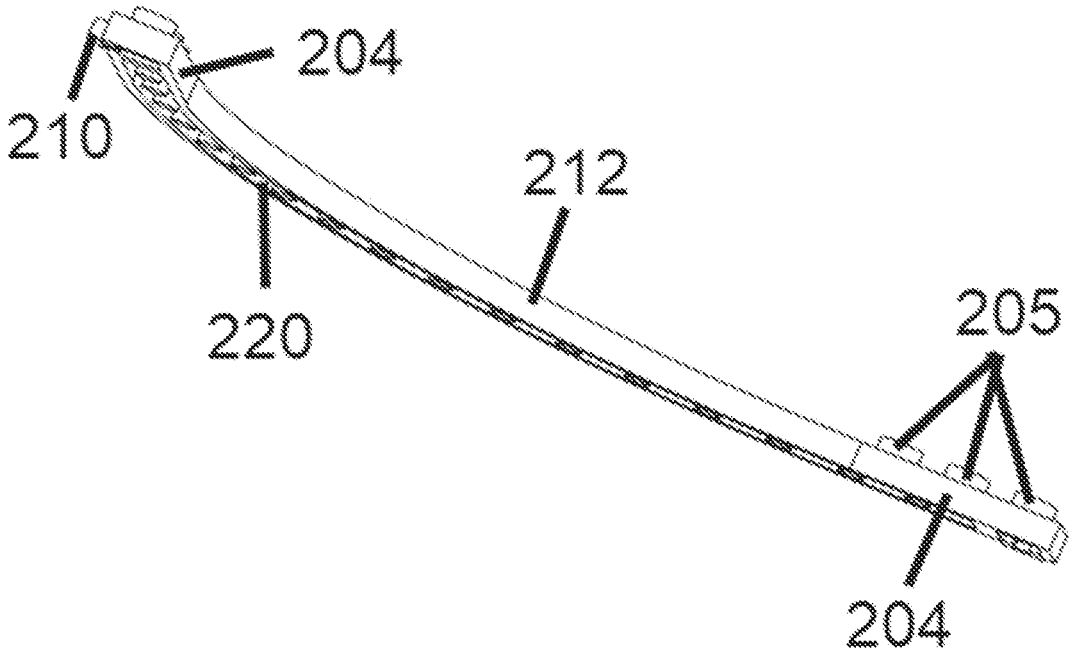
Figure 11D:
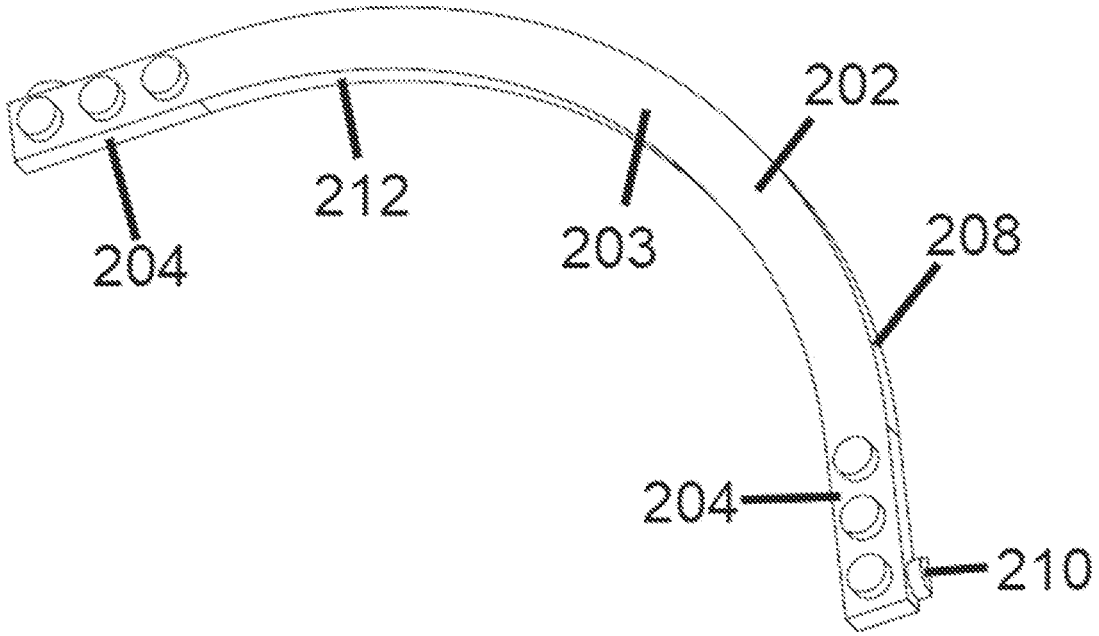
FIG. 11D is a perspective view of an curved cross beam, according to multiple embodiments and alternatives.

FIGS. 10A-10F illustrate the curved beam 172 comprising a pair of end portions 189 (having a cuboid shape) integrally connected to a curved main body 186. The curved beam 172 comprises a top surface 175, an inner face 180, an outer face 188, a pair of end faces 190, and a bottom 192. A series of studs 178 extend from the top surface 175. As best illustrated in FIG. 10F, the studs 178 are positioned in a grid pattern which align with the studs on adjacent components in the system 5 to provide connection points between the adjacent components, as well as any other compatible components, and the top surface 175 of the curved beam 172. The outer face 188 of the curved main body 186 defines a series of cross stud receiving bores 185. The outer face 188 and inner face 180 of each of the end portions 189 comprise a cross stud receiving bore 185 and a single stud 179 positioned at the ends of said faces 180, 188 and adjacent to the end faces 190. The inner face 180 of the curved main body 186 defines a series of cross pin receiving bores 182. Each of the pair of end faces 190 define at least one cross stud receiving bore 185, and are adapted to engage the sides of the bottom portion 98 of an outer mid-column 75. The bottom 192 of the curved beam 172 comprises a plurality of recesses 195.

As shown in FIGS. 2-3B, the curved beam 172 is adapted to be removably secured to the bottom portions 98 of two, adjacent outer mid-columns 75. Upon connection to said adjacent, outer mid-columns 75, the single studs 179 positioned at the ends of said outer face 188 align with the studs extending from the bottom of the external face 82 of said outer mid-column 75.

FIGS. 11A-11D illustrate the curved cross beam 200 comprising a pair of end portions 204 (each having a cuboid shape) integrally connected to a curved main body 203. The curved cross beam 200 further comprises a top surface 202, an inner face 212, an outer face 208, a pair of opposing end faces 215, and a bottom 220. In some embodiments, the top surface 202 of each of the end portions 204 comprises a series of studs 205 (in a 1×3 pattern, as a non-limiting example). The outer face 208 of each of the end portions 204 defines a single half stud 210 positioned adjacent to the end faces 215. The bottom 220 defines a recess 225 having a series of studs 228, and the bottom 220 of each of the end portions 204 define a stud receiving bore having a generally square shape that is adapted to receive a stud.

As shown in FIGS. 2-3B, the curved cross beam 200 is adapted to be removably secured to the top surface 78 of two, adjacent outer mid-columns 75. Upon connection to said outer mid columns 75, the single half studs 210 positioned on the outer face 208 of the curved cross beam 200 engage the single half studs 153 on the top surface 78 of the outer mid-columns 75 to form a pair of full studs. Furthermore, as best illustrated in FIGS. 3A and 17, the studs 205 extending from the top surface 202 of the curved cross beam 200 align with the studs 205 on the top surface 202 of another curved cross beam 200 connected to the other side of the same outer mid-column 75, and/or with the studs 118 on the top surface 115 of a front cross beam 112 that is connected to the same outer mid-column 75. The alignment of the studs provide connection points for any compatible component(s), such as an additional floor that can be stacked above the existing floor. Furthermore, the alignment of the half studs to form full studs between the curved cross beam 200 and the external face 82 of an outer mid-column 75 (or between a front cross beam 112 and an outer mid-column 75) provide connection points for components have a stud receiving bore which, upon attachment to the formed full stud, provides additional stability for the connection between said curved cross beam 200 and said outer mid-column 75, 74 (or between the front cross beam 112 and an outer mid-column 75).

Figure 12A:
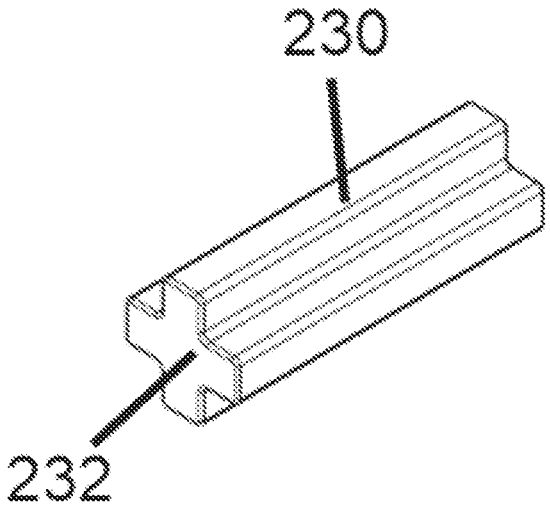
FIGS. 12A-12B are perspective views of a cross pin, according to multiple embodiments and alternatives.
Figure 12B:
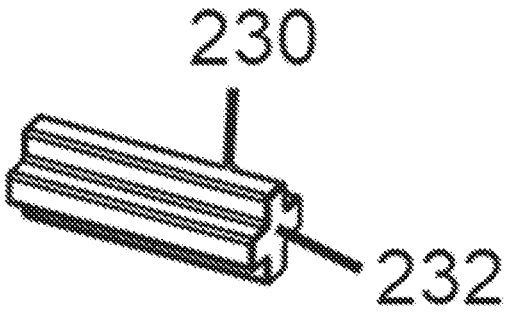

FIGS. 12A-12B illustrate a cross pin 230 have a pair of opposing ends 232. The cross pin 230 generally has an elongated plus-shape, or cross-shape, and is adapted to be received between two cross pin receiving bores or between two cross stud receiving bores. In some embodiments, the cross pins 230 span between the various component connections in the system 5 (similar to a dowel as a non-limiting example) to prevent motion or slipping. The cross pins 230 further support the stability and support for the system 5 by providing the connection points between the different components.

Figure 13A:
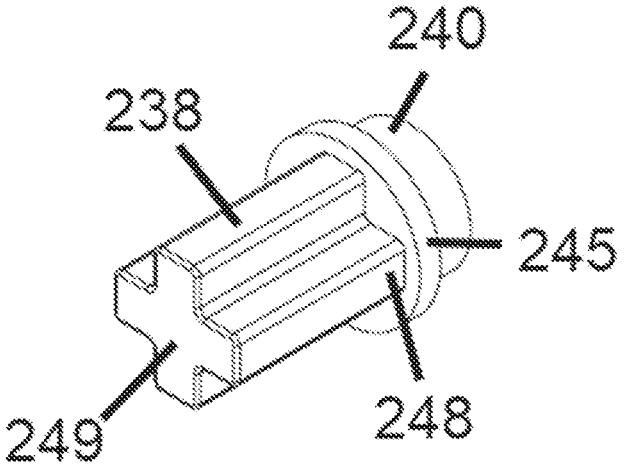
FIGS. 13A-13B are perspective views of a cross stud, according to multiple embodiments and alternatives.
Figure 13B:
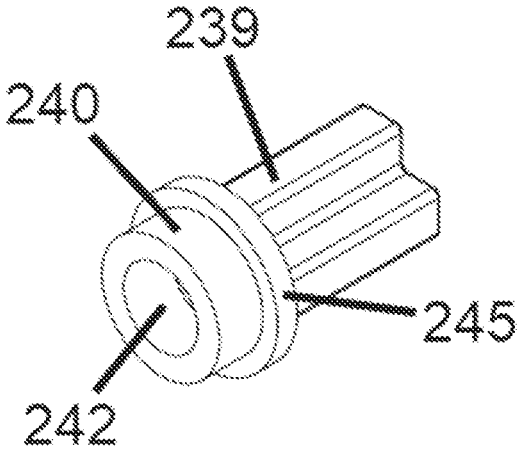
Figure 13C:
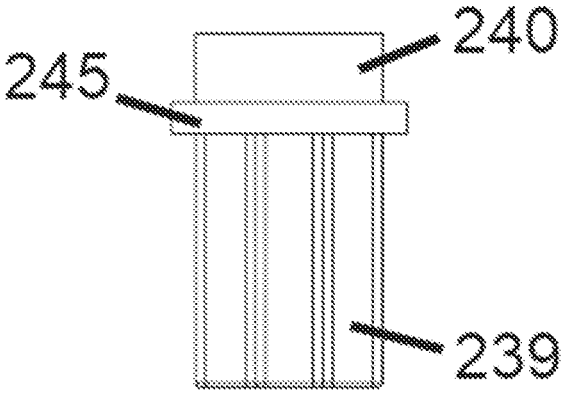
FIG. 13C is a top view of a cross stud, according to multiple embodiments and alternatives.
Figure 14A:
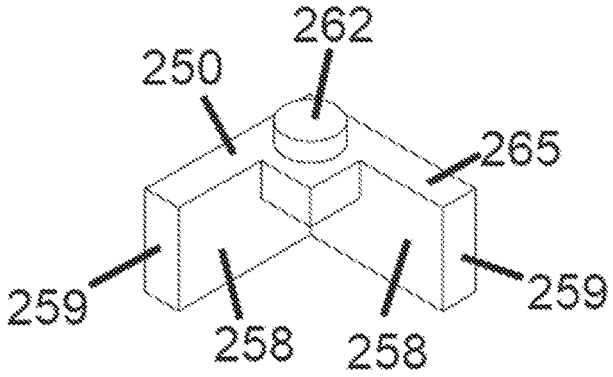
FIG. 14A-14B are perspective views of an internal corner bracket, according to multiple embodiments and alternatives.
Figure 14B:
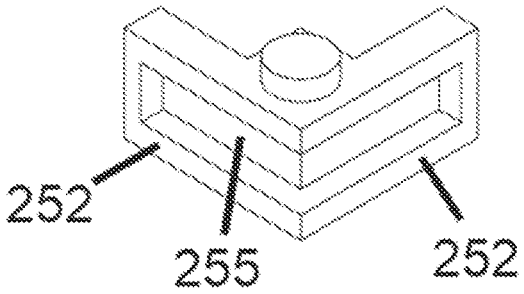
Figure 14C:
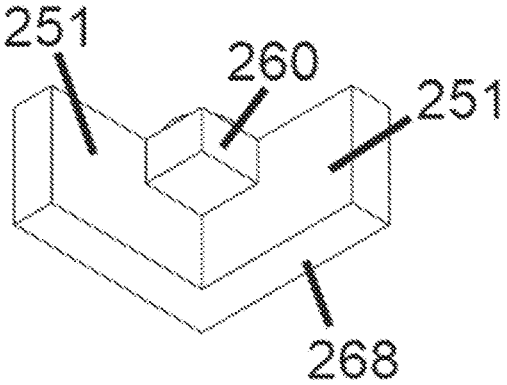
FIG. 14C is a bottom, perspective view of an internal corner bracket, according to multiple embodiments and alternatives.
Figure 14D:
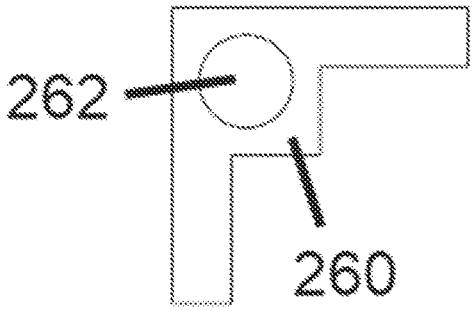
FIG. 14D is a top view of an internal corner bracket, according to multiple embodiments and alternatives.

FIGS. 13A-13C illustrate a cross stud 238 comprising a stud member 240 integrally connected to an inner face 248 of a cross pin member 239. The cross pin member 239 generally has an elongated cross-shape and further defines an outer face 249. The stud member 240 comprises a shoulder 245 and defines a bore 242. The shoulder 245 is positioned between the inner face 248 of the cross pin member 239 and the bore 242. The cross stud 238 is adapted to be received by a component of the system 5 having either a cross stud receiving bore or a cross pin receiving bore. A user can insert a cross stud 238 into said bore until the shoulder 245 engages the sides of said component. In this manner, the cross stud 238 can serve as an attachment point for additional components and is further adapted to mate with an internal corner bracket 250 to provide support for connections between beams in the system 5 which occur at about a ninety degree angle, such as the junction between a tie beam 52, an outer mid-column 75, and a curved beam 172 (as a non-limiting example).

FIGS. 14A-14D illustrate an internal corner bracket 250 comprising a pair of integrally connected walls 251 which define a pair of internal faces 258, a pair of end faces 259, a pair of external faces 252, a top surface 265, and a bottom surface 268. The pair of external faces 252 cooperate to form a recess 255, wherein the recess 255 is adapted to engage and receive a stud and/or the stud member 240 of the cross stud 238. A block member 260 is integrally connected to the pair of internal faces 258 and a single stud 262 extends from the top surface of said block member 260 (and is positioned between the internal faces 258). After the internal corner bracket 250 is received by a connection between the beams in the system 5, the single stud 262 aligns with the adjacent studs to serve as an attachment point. Furthermore, a component (such as a square panel 270 or a rectangular panel 280 as non-limiting examples), can connect to the single stud 262 and the adjacent studs on the other components to provide additional structural support for the beam connection.

As illustrated in FIGS. 2-3B and 15-19B, the interchangeable components of the system 5 are adapted to interlock to form any number of three-dimensional structures, frames, units, and a variety of stand-alone floors. As previously noted, the central unit 10 comprises a center column 12 removably connected to the top surface 38 of a center connector 35, and a series of tie beams 52 removably connected to each of the sides 42 of said center connector 35. In some embodiments, a series of outer mid-columns 75 are removably connected to the opposing ends of the tie beams 52. The tie beam corner unit 110 comprises a pair of tie beams 52 removably connected to two, adjacent outer mid-columns, a corner column 140 removably connected to the other end of the two tie beams 52, and pair of a front cross beams 112 removably secured to the top surface 78 of the two, adjacent outer mid-columns and the top end 142 of the corner column 140. The curved beam unit 170 comprises a curved beam 172 and a curved cross beam 170 removably connected to two, adjacent outer mid-columns 75.

According to multiple embodiments and alternatives, the heights of the bottom portion 98 of the outer mid-column 75, the bottom portion 160 of the corner column 140, the height of the tie beams 52, 51, the height of the curved beams 172, and the height of the center connector 35 are equivalent. The height of the vertical portion 99 of the outer mid-column 75, the height of the vertical portion 161 of the corner column 140, and the height of the center column 12 are equivalent. In some embodiments, the height of the outer mid-column 75, the corner column 139, and the height of a center column 12 secured to a center connector 35 are equivalent. Likewise, the height of the front cross beam 112, the height of the curved cross beam 200, and the height of the corner block 146 of the corner column 140 are equivalent. In this manner, one or more tie beam corner units 110 and/or one or more curved beam units 170 are removably secured to at least one central unit 10 to form the corners of a floor. In addition, the various studs in the system 5 also align to provide attachment points for other components and to provide additional stability for connections (e.g. by receiving an internal corner bracket 250 to reinforce a beam connection, as a non-limiting example).

FIGS. 3A-3B illustrate a floor 320 comprising a central unit 10 removably secured to a pair of tie beam corner units 110 and a pair of curved beam units 170. FIG. 15 illustrates a floor 340 comprising a central unit 10 removably secured to a plurality of tie beam corner units 110. FIG. 16 illustrates a floor 350 comprising a central unit 10 removably secured to a single tie beam corner unit 110 and a plurality of curved beam units 170. FIG. 17 illustrates a floor 330 comprising a central unit 10 removably secured to a plurality of curved beam units 170.

FIGS. 18A-18B illustrate a floor 360 comprising a central unit 10 removably secured to a curved beam unit 170 and a plurality of tie beam corner units 110. As previously noted, FIGS. 19A-19B illustrate floor 370 comprising a plurality of central units 10 interlocked to form a central portion of floor 370, a plurality of outer mid-columns 75 interlocked with the plurality of central units 10 along the perimeter of said central portion, a plurality of tie beams 52 and front cross beams 112 spanning between the plurality of outer-mid columns 75 to form the perimeter of the floor 370, and a pair of tie beam corner units 110 and a pair of curved beam units 170 interlocked with said central portion to form the corners of said floor 370. Accordingly, it will be appreciated that the components of the system 5 are adapted to form a variety of shapes and stand-alone floors, which can be stacked to construct any number of three-dimensional structures both horizontally and/or vertically.

As non-limiting examples, FIGS. 20-25 illustrate how the various floors 320, 330, 340, 350, 360, 370, and other floors using the components of the system 5, are adapted to stack upon one another to construct a variety of different structures. In this manner, a first floor is aligned with a subsequent floor, then the studs positioned on the top surface of said first floor are removably secured to the bottom surface of the subsequent floor. Similarly, a user can removably secure a subsequent floor to the bottom surface of the first floor. Accordingly, a user can stack and removably secure additional floors, or remove individual floors, as desired. As discussed below, the connections between floors can be further secured and stabilized using various system 5 components such as the square panel 270 and/or the rectangular panel 280 (as non-limiting examples). As will be appreciated by one of ordinary skill in the art, the central unit 10, the outer mid-columns 74, 75, the tie beams 52, 51, the front cross beams 112, the tie beam corner unit 110, and the curved beam unit 170 can interlock to construct a variety of different floors and three-dimensional structures as desired by the user.

Figure 27A:
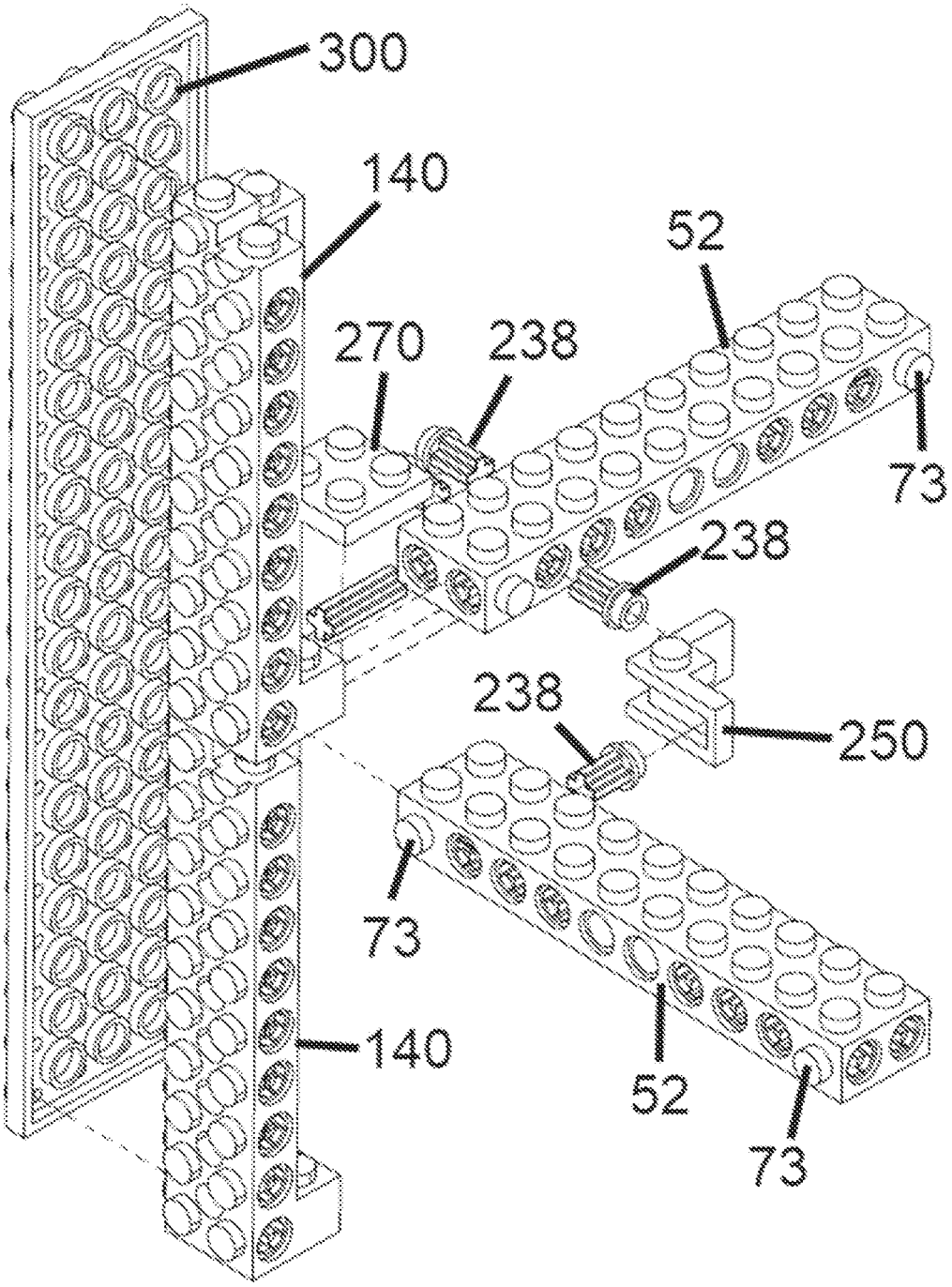
FIG. 27A is an exploded view of a structural connection and cladding, according to multiple embodiments and alternatives.
Figure 27B:
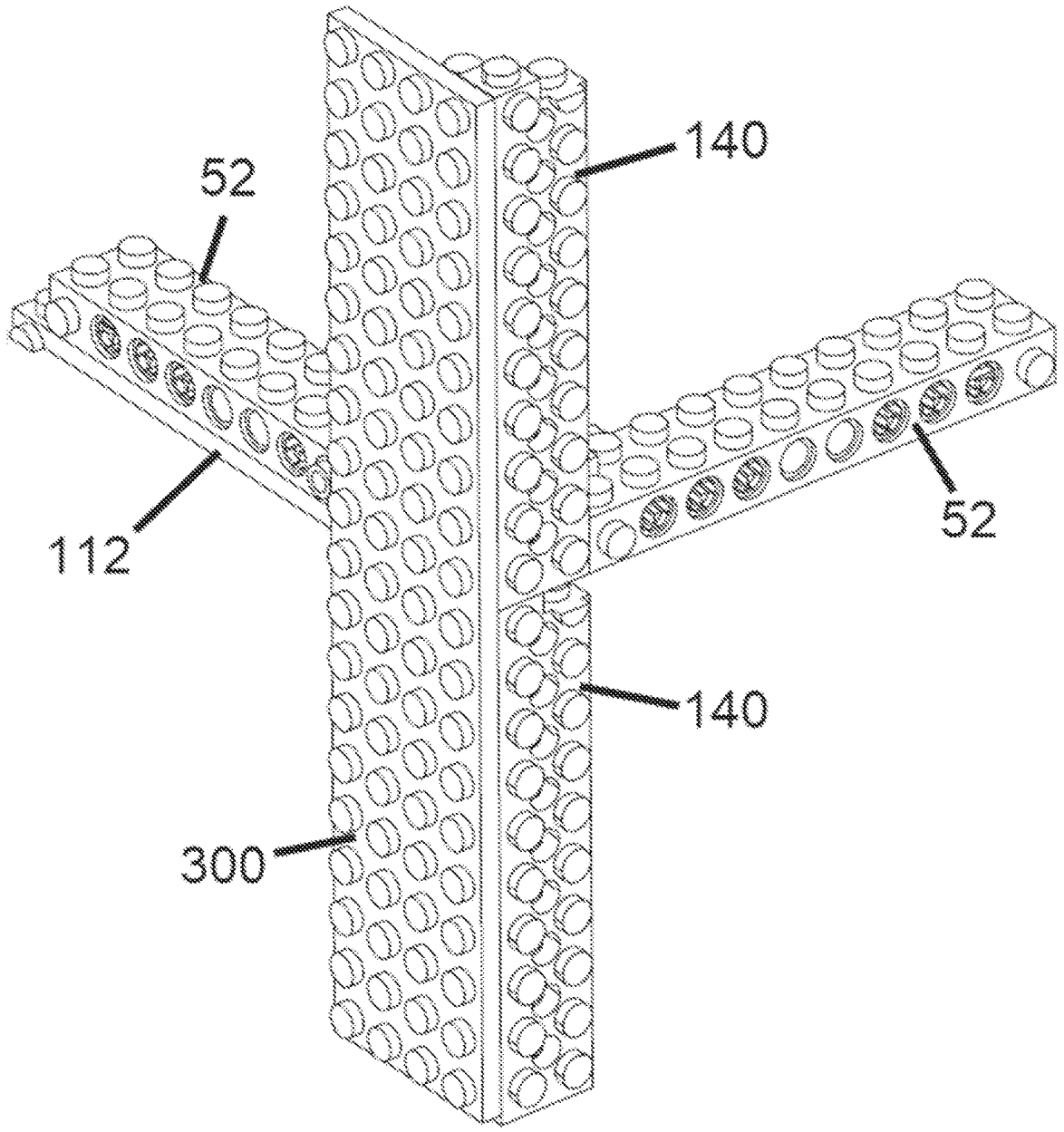
FIG. 27B is a perspective view of a structural connection and cladding, according to multiple embodiments and alternatives.
Figure 28A:
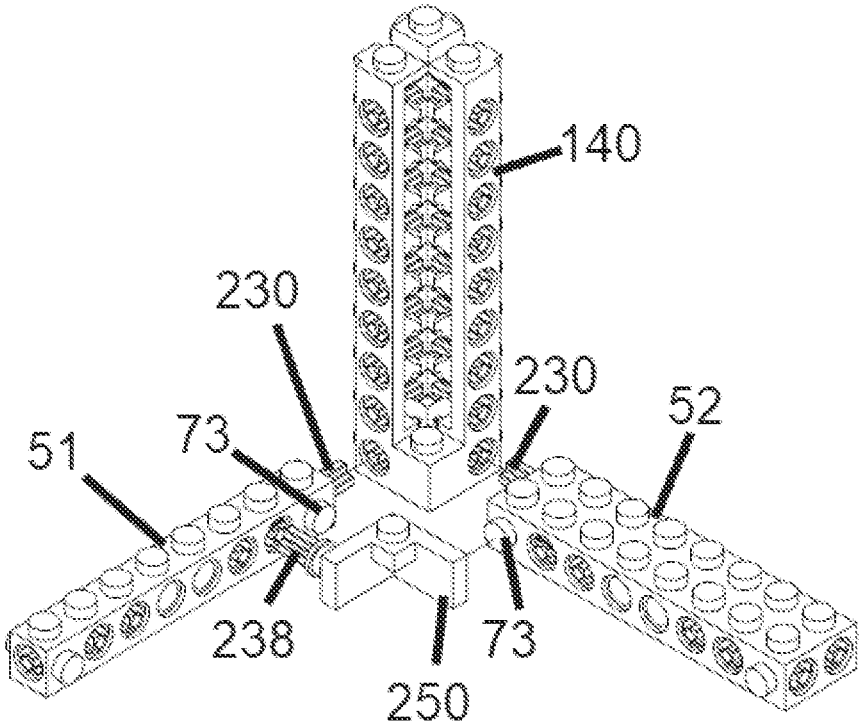
FIGS. 28A-28B are perspective views of a structural connection, according to multiple embodiments and alternatives.
Figure 28B:
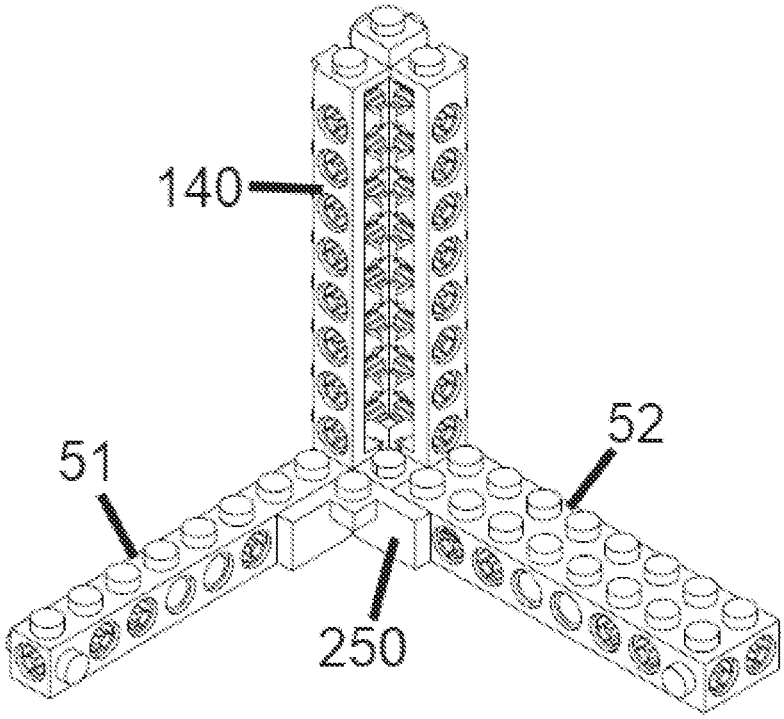

FIGS. 26A-28B illustrate a stability system 400 adapted to secure the connections between the various components and floors of the system 5. As noted above, an internal corner bracket 250 is adapted to secure an internal connection between a pair of tie beams 52 (i.e. a first tie beam 51, 52 and a second tie beam 51, 52) and a center connector 35, a pair of tie beams 52 and an outer mid-column 75, a pair of tie beams 52 and a corner column 140. The internal corner bracket is further adapted to secure the connection between a tie beam 52, an outer mid-column 75, and a curved beam 172, the connection between a pair of curved beams 172 and an outer mid-column, or any internal connection between beams 52, 172 that forms a ninety degree angle that is capable of receiving an internal corner bracket. The ends of the sides of each of the beams 52, 51, 172 define a single stud that is adapted to be received within the external faces 252 of the internal corner bracket 250. In some embodiments, a cross stud receiving bore is positioned proximal to the single stud on the sides of beams 51, 52, 172. When a cross stud 238 is received within the boring, the internal corner bracket 250 is further adapted to secure to both said stud 238 and the single stud. In the non-limiting example shown in FIGS. 26A-28B, the internal corner bracket 250 is used to secure the connection between the pair of beams 51, 52 and the corner column 140. As shown in FIGS. 28A-28B, when a tie beam 51 and a tie beam 52 are removably secured to a corner column 140 (as a non-limiting example), the internal corner bracket 250 is adapted to secure the connection between beam 51, 52, and corner column 140. In further embodiments, the various pips extending upwards from beams 51, 51 and the pip 163 extending from the top surface 142 of the bottom component 98 of column 140 align and are adapted to receive other components (such as a square panel 270 as a non-limiting example).

As shown in FIGS. 26A-27B, a corner column 140 is mounted to the top surface 202 of another corner column 140. The corner block 146 of said top surface 202 forms an opening that is adapted to receive one of the ends 125 of a front cross beam 112. The top surface 162 of the bottom portion 160 of the corner column 140 defines a stud 163 that is adapted to receive other components having a stud receiving bore, such as a square panel 270 or a rectangular panel 280. The square panel 270 comprises a top surface 272 having a series of studs 275 (in a 2×2 pattern, as a non-limiting example), a plurality of sides 278, and a bottom (not numbered) that is adapted to secure to other corresponding studs. The rectangular panel 280 comprises a top surface 282 having a series of studs 289, a pair of opposing sides (not numbered), a pair of opposing ends (not numbered), and a bottom 290 having a recess 295 with studs 292 that are adapted to secure to other studs.

Figure 26A:
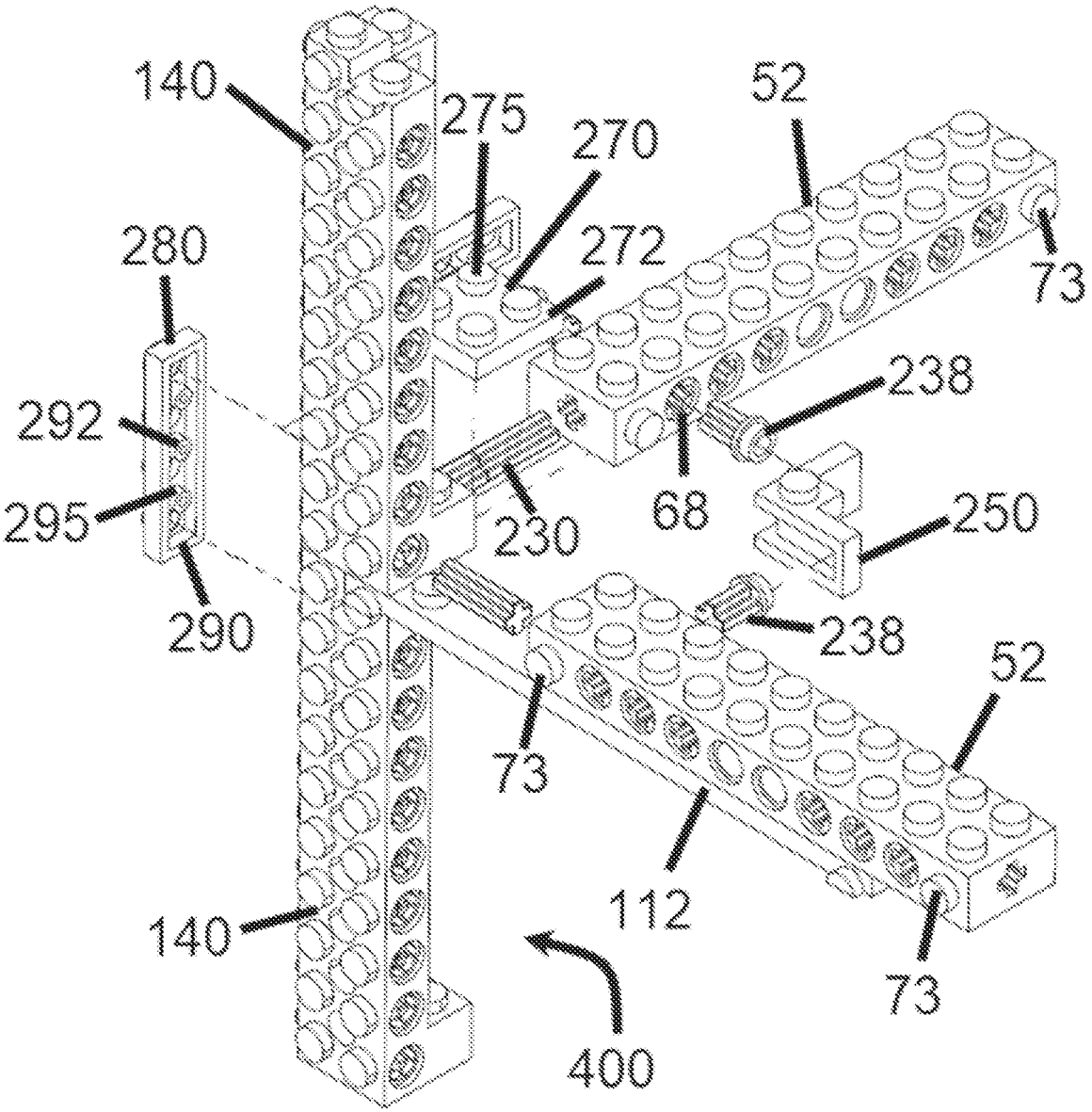
FIG. 26A is an exploded view of a structural connection, according to multiple embodiments and alternatives.
Figure 26B:
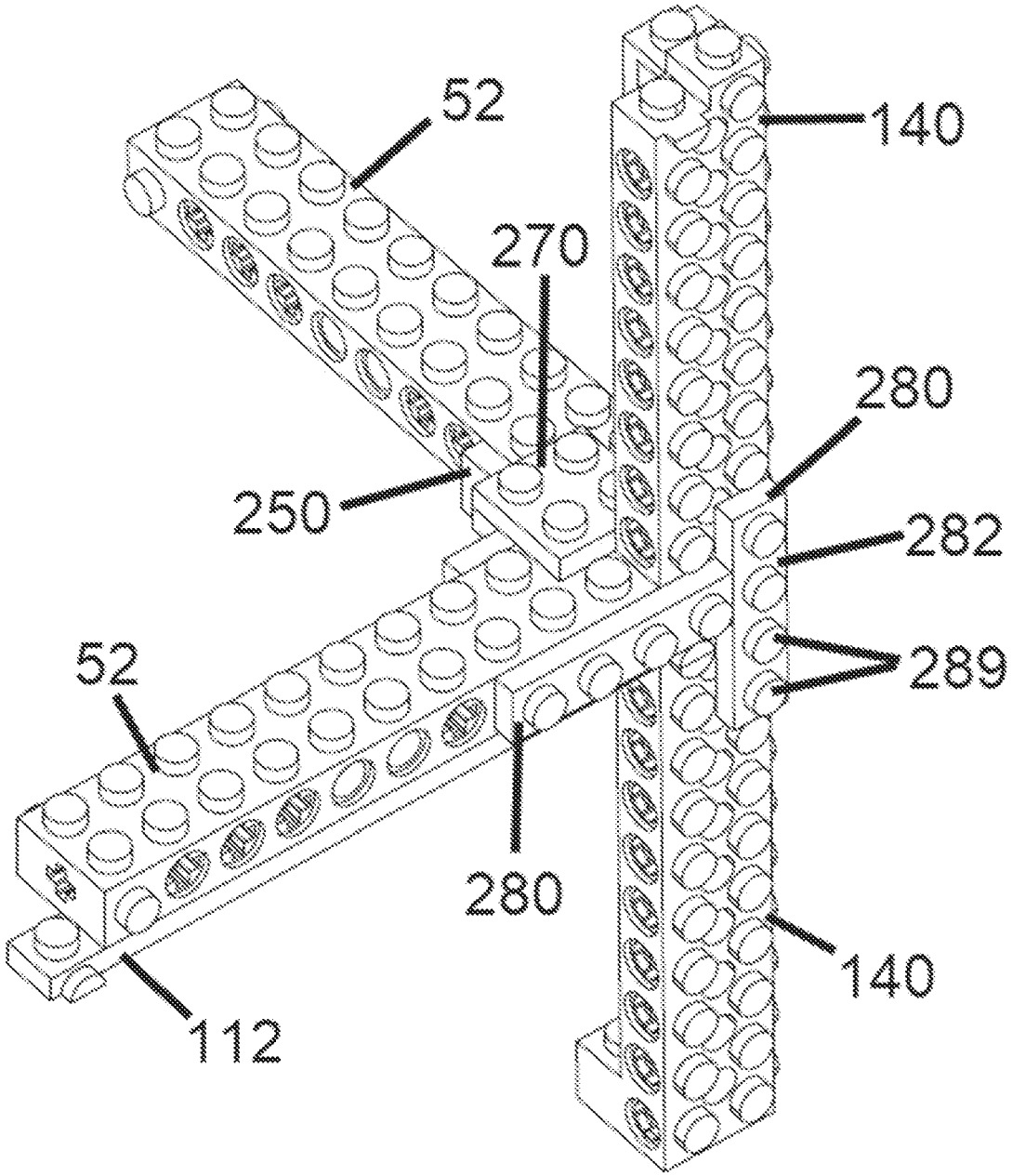
FIG. 26B is a perspective view of a structural connection, according to multiple embodiments and alternatives.

The square panel 270 and the rectangular panel 280 are adapted to support any number of connections in the system 5 that are adapted to receive panels 270, 280. As a non-limiting example, in FIGS. 26A-26B the square panel 270 is removably secured to the top surface of the pair of tie beams 52, the single stud 163 on the top surface 162 of the bottom portion 160 of the corner column 140, and the single stud 262 located on the top of the internal corner bracket 250. In this manner, the square panel 270 is removably secured to the connection between the pair of tie beams 52, the corner column 140, and the internal corner bracket 250. The same square panel 270 can be used to secure any number of connections in the system 5 that are adapted to receive said panel 270, such as the connection between an outer mid-column 75, beam 52, a curved beam 172, and an internal corner bracket 250 (as a non-limiting example). As best illustrated in FIG. 26B, the rectangular panel 280 can be utilized to secure any number of connections, such as between two corner beams 140 or between a tie beam 52 and a front cross beam 112 (as non-limiting examples).

Furthermore, based on the alignment of the studs on the various components, the system 5 is adapted to receive any number of known complementary pieces with similar geometric shapes and recesses, such as the cladding 300 illustrated in FIGS. 27A-27B, which mates with the external faces 150 of the corner columns 140 (as a non-limiting example).

In operation, a user can begin by assembling a central unit 10 which involves securing the bottom 20 of a center column 12 to the top surface 38 of a center connector 35. Next, the user inserts a cross pin 230 partly into at least one of the cross stud receiving bores 45 positioned on the sides 42 of said center connector 35. The tie beams 52 are then connected to each of the sides 42 of the center connector 35 by inserting the ends of the various exposed cross pins 230 into the at least one cross stud receiving bore 68 positioned on the ends 62 of the tie beams 52. Cross pins 230 are inserted partly into the cross stud receiving bores 68 that are positioned on the opposing ends 62 of the tie beams 52 which extend outward from the center connector 35. Once assembled, the user has the option to interlock the central beam unit 10 with one or more other central beams unit 10 as illustrated in FIGS. 19A-19B. Next, outer mid-columns 75 are secured to each of the connected tie beams 52 which extend outward from the at least one central beam unit 10 by inserting a cross pin 230 (which extends outward from the exposed end 62 of a tie beam 52) into the least one cross stud receiving bore 102 positioned on the internal side 105 of the bottom portion 98 of the outer mid-column 75, and interlocking said outer mid-columns 75 to the at least one central beam unit 10 along the perimeter of the central portion of the floor. In some embodiments, a plurality of front cross beams 112 and a plurality of tie beams 52, 51 span between the plurality of outer mid-columns 75 to form the perimeter of the floor.

If a user desires to attach at least one curved beam unit 170 to the assembled at least one central unit 10, a cross pin 230 is partly inserted into the cross stud receiving bore 95 on a side 92, and closest to the bottom 103, of an outer mid-column 75 (or 74) positioned adjacent to the corner of the assembled at least one central unit 10. A cross pin 230 is also partly inserted into the cross stud receiving bore 95 on a side 92, and closest to the bottom 103 (i.e. the receiving bore 95 defined by the bottom portion 98), of an adjacent outer mid-column 75 (or 74) of the assembled at least one central unit 10, such that the two cross pins 230 are adapted to receive a curved beam 172 (i.e. the pins both face towards the same corner). The curved beam 172 then connects to the two, adjacent outer mid-columns 75 by inserting the exposed cross pins 230 into the at least one cross stud receiving bores 185 positioned on the pair of end faces 190 of said curved beam 172. A curved cross beam 200 is then connected to the two, adjacent outer mid-columns by attaching each of the stud receiving bores 222 on the bottom of the curved cross beam 200 to one of the studs 80 positioned on the top surface 78 of the adjacent, outer mid-columns 75. Once removably secured, the half studs 210 on the outer face 208 of the curved cross beam 200 mate with the half studs 85 on the outer mid-columns 75 to form full studs. In this manner, the curved beam unit 170 is removably secured to two, adjacent outer mid-columns on adjacent sides of said central portion to form a curved corner of the floor. The user can attach additional curved beam units 170 to the at least one central unit 10 in the same manner to form one or more corners of the single floor, or alternatively, connect one more tie beam corner units 110 to the at least one central unit 10 to form the other corners of the floor If a user desires to attach at least one tie beam corner unit 110 to the assembled at least one central unit 10, a cross pin 230 is partly inserted into the cross stud receiving bore 95 on a side 92, and closest to the bottom 103 (i.e. within the bottom portion 98), of an outer mid-column 75 (or 74) of the assembled central unit 10. A cross pin 230 is also partly inserted into the cross stud receiving bore 95 on a side 92 of the bottom portion 98 of an adjacent outer mid-column 75 (or 74) of the assembled at least one central unit 10, such that the two cross pins 230 are adapted to receive the at least one tie beam corner unit 110 (i.e. the pins both face towards the same corner). A pair of tie beams 52 (or 51) are then removably secured to the adjacent outer mid-columns 75 by inserting the exposed cross pins 230 into at least one cross stud receiving bore 68 on the ends 62 of the pair of tie beams 52 (or 51). Cross pins 230 are then partly inserted into the at least one cross stud receiving bore 68 on the opposing ends 62 of the connected tie beams 52 (i.e. the exposed end). A corner column 140 is removably secured to the pair of tie beams 52 by inserting the partly exposed cross pins 230 into the pair of cross stud receiving bores 158 defined by the bottom portion 160 (i.e. the bore 158 positioned closest to the bottom 165). A pair of front cross beams 112 are then removably secured to the same adjacent outer mid-columns 75 which are connected to the pair of tie beams 52. In this manner, the pair of stud receiving bores 132 on the bottom 130 of the tie beams 52 attach to the studs 145 on the top end 143 of the corner column 140. Once the pair of tie beams 52 are removably secured to a corner column 140 and a pair of adjacent, outer mid-columns 75, one of the opposing ends 125 of each of the front cross beams 112 mates with the corner block 146 on the top end 142 of the corner column 140 to form a flat surface. In addition, the half studs 121 on the outer face 120 of the front cross beams 112 mate with the half studs 153 of the corner column 140 to form full studs. The opposing half studs 121 of the front cross beams 112 mate with the half studs 85 on the outer mid-column 75 to form full studs. As previously noted, the user can attach one or more additional tie beam corner units 110 to the assembled at least one central unit 10 to form the corners of a single floor, or alternatively, connect one or more curved beam units 170 to form the other corner(s) of the floor.

If a user desires to further secure any of the internal beam connections in the system 5, an internal corner bracket 250 can be removably secured to the single studs which are positioned next to each other at the connections between beams 51, 52, 172. As non-limiting examples (best illustrated in FIG. 2), an internal corner bracket 250 can mate with the studs on the ends of a pair of adjacent tie beams 52, 51 connected to a center connector 35, a pair of adjacent tie beams 52, 51 connected to an outer mid-column 75, a pair of adjacent tie beams connected to a corner column 140, or a curved beam 172 and a tie beam 52 (or 51) connected to an outer mid-column 75 (or 74). In addition, a cross stud 238 can be inserted next to the single studs which are positioned next to each other at the internal beam connections. The internal corner bracket 250 is further adapted to receive said cross stud 238 in the recess 255 (in addition to being adapted to receive the single stud on the side of beams 51, 52, 172). In this manner, the internal corner bracket 250 and the cross stud 238 can be used to provide additional support for the beam connections.

A user can further secure connections in the system 5 by removably attaching any number of square panels 270 and/or rectangular panels 280 as desired. As a non-limiting example, a square panel 270 can be removably secured to the stud 163 of a corner column 140, the adjacent studs 58 on a pair of tie beams 52 connected to said corner column 140, and the stud 262 on the internal corner bracket 250 (if removably secured to said pair of tie beams 52). As another non-limiting example, square panel 270 can be removably secured to one of the studs 101 on the top surface 100 of the bottom portion 98 of an outer mid-column 75, the adjacent studs 58 on a pair of tie beams 52 connected to said outer mid-column 75, and the stud 262 on the internal corner bracket 250 (if removably secured to said pair of tie beams 52). Likewise, one or more rectangular panels 280 can secure any number of connections, such as the non-limiting examples in FIG. 26A wherein a rectangular panel 280 spans between two connected corner columns 140 and a panel 280 spans between a tie beam 52 connected to a corner column 140. As non-limiting examples, the panels 270, 280 can also be used to connect to the various full studs (formed by the different half studs which mate with one another) to provide additional support to said connections.

Once the user has assembled the various floors 320, 330, 340, 350, 360, 370, and other floors using the components of system 5, each of said floors are adapted to removably secure to one another to create any number of three-dimensional structures as desired by the user. In this manner, the various studs positioned on the tops of assembled floors 320, 330, 340, 350, 360, 370, and the other configurations mate with the bottom surface of corresponding floors. To assemble the floors together, the user aligns the central units 10 and secures the studs on the top surface of one floor to the bottom surface of the next floor. The user then repeats the process to assemble the desired structure.

It will be understood that the embodiments described herein are not limited in their application to the details of the teachings and descriptions set forth, or as illustrated in the accompanying figures. Rather, it will be understood that the present embodiments and alternatives, as described and claimed herein, are capable of being practiced or carried out in various ways.

Also, it is to be understood that words and phrases used herein are for the purpose of description and should not be regarded as limiting. The use herein of "including," "comprising," "e.g.," "containing," or "having" and variations of those words is meant to encompass the items listed thereafter, and equivalents of those, as well as additional items.

Accordingly, the foregoing descriptions of several embodiments and alternatives are meant to illustrate, rather than to serve as limits on the scope of what has been disclosed herein. The descriptions herein are not intended to be exhaustive, nor are they meant to limit the understanding of the embodiments to the precise forms disclosed. It will be understood by those having ordinary skill in the art that modifications and variations of these embodiments are reasonably possible in light of the above teachings and descriptions.

What is claimed is:

1. A framing system, comprising:

a central unit having a center column, a center connector, and at least one tie beam, each at least one tie beam having a pair of identical, opposing ends;

wherein the center connector has a top, a plurality of identical sides, and a bottom, wherein the top of the center connector is adapted to be removably secured to a bottom of the center column and each of said plurality of sides is adapted to removably receive the end of the tie beam such that at least one tie beam extends from the side of said center connector;

further comprising at least one outer mid-column being adapted to be removably secured to the end of at least one tie beam extending from said center connector;

wherein the at least one outer mid-column further comprises a bottom component integrally connected to a vertical component, a top, a bottom, an external face, a pair of identical, lateral sides, and an internal side;

wherein the internal side and each lateral side of the bottom component of the at least one outer mid-column are adapted to be removably secured to the end of the at least one tie beam.

2. The framing system of claim 1, wherein the bottom component of each outer mid-column further comprises a top surface having a pair of studs, wherein the vertical component extends upwardly from said top surface and is positioned distal relative to the pair of studs;

wherein the top of each tie beam comprises a first stud row and a second stud row; and wherein the pair of studs extending from the top surface of the bottom component of each outer mid-column are configured to align with the first stud row and the second stud row the at least one tie beam when said tie beam is secured to the internal side of the bottom component of the at least one outer mid-column.

3. The framing system of claim 1, further comprising a plurality of central units interlocked to form a central portion of a floor;

wherein a plurality of outer mid-columns interlock to the plurality of central units along the perimeter of said central portion; and wherein a plurality of tie beams span between the lateral sides of the bottom component of each outer mid-column, wherein a plurality of front cross beams span between the top of each outer mid-column, wherein said plurality of tie beams, said plurality of front cross beams, and said plurality of outer mid-columns form the perimeter of said floor.

4. The framing system of claim 3, further comprising a tie beam corner unit having a first tie beam, a second tie beam, and a corner column having a pair of internal faces;

wherein said internal faces of the corner column are adapted to removably receive an end of the first tie beam and an end of the second tie beam such that the first and second tie beams extend from said pair of internal faces; and wherein said tie beam corner unit is adapted to be removably secured to a pair of adjacent outer-mid columns of the central portion to form a corner of said floor.

5. The framing system of claim 3, further comprising a curved beam being adapted to be removably secured to a pair of adjacent outer-mid columns of the central portion to form a curved corner of said floor.

6. A framing system, comprising:

a tie beam corner unit having a first front cross beam, a second front cross beam, a first tie beam, a second tie beam, and a corner column;

wherein the corner column comprises a bottom component integrally connected to a vertical component, a top end, a first external face, a second external face, a first internal face, a second internal face, and a bottom;

wherein the first front cross beam and the second front cross beam each comprise a top surface, an outer face, a pair of opposing ends, an inner face, and a bottom having a pair of opposing bottom ends, wherein the opposing bottom ends of each the pair of front cross beams are adapted to be removably secured to the top end of the corner column; and wherein the first tie beam and the second tie beam each have a pair of identical, opposing ends, wherein the opposing ends of each of the first and second tie beams are adapted to be removably secured to the internal faces of the bottom component of the corner column.

7. The framing system of claim 6, wherein a corner block extends upwardly from the top end of the corner column, said top end of the corner column defining a first front cross beam receiving surface and a second front cross beam receiving surface positioned adjacent to said corner block;

wherein the first front cross beam receiving surface is adapted to receive one of the opposing bottom ends of the first front cross beam;

wherein the second front cross beam receiving surface is adapted to receive one of the opposing bottom ends of the second front cross beam; and wherein the top end of the corner column is adapted to define a flat surface when the first front cross beam is secured to the first front cross beam receiving surface and the second front cross beam is secured to the second front cross beam receiving surface.

8. The framing system of claim 7, wherein a first half stud extends outwards from the first front cross beam receiving surface towards the first external face of the corner column;

wherein a second half stud extends outwards from the second front cross beam receiving surface towards the second internal face of the corner column;

wherein a pair of half studs extend from the ends of the outer face of each of the first front cross beam and the second front cross beam; and wherein each of the pair of half studs on said first and second cross beams is adapted to engage the first half stud or the second half stud of said corner column to form a full stud.

9. The framing system of claim 8, wherein a first stud extends upwards from said first front cross beam receiving surface and a second stud extends upwards from said second front cross beam receiving surface; and wherein the opposing bottom end of each of said first and second front cross beams define a stud receiving bore being adapted to be removably secured to the first stud or the second stud on the top end of the corner column.

10. The framing system of claim 9, wherein the bottom component of the corner column defines a top surface having a single stud positioned between the first and second internal faces of said corner column;

wherein the first and second tie beams each comprise a top surface having a series of studs, wherein said series of studs are arranged to form a first stud row and a second stud row along the length of said tie beams;

wherein the single stud on the top surface of the bottom component of the corner column aligns with the first stud row or the second stud row when a first tie beam or a second tie beam interlocks with an internal face of the bottom component of the corner column.

11. The framing system of claim 7, wherein the opposing ends of each of the first and second tie beams and the pair of internal faces of the bottom component of the corner column are identically configured; and wherein the tie beam corner unit is adapted to be removably secured to a pair of adjacent outer mid-columns of the central portion of claim 3 to form a corner of said floor.

12. The framing system of claim 11, wherein the corner column has a height equivalent to the height of said outer mid-columns of said floor;

wherein a plurality of tie beam corner units interlock with said central portion to form the corners of said floor;

wherein said floor is configured to interlock with one or more corresponding floors to form a structure.

13. The framing system of claim 11, wherein the top of each outer mid-column comprises a first stud, a second stud, a first half stud, and a second half stud, wherein the first half stud and the second half stud each extend towards the external face of each outer mid-column;

wherein each of the pair of half studs on said first and second cross beams are adapted to engage the first half stud or the second half stud on the top of each outer mid-column to form a full stud; and wherein the opposing bottom end of each of said first and second front cross beams define a stud receiving bore being adapted to be removably secured to the first stud or the second stud on the top of each outer mid-column.

14. A framing system, comprising:

a curved beam unit having a curved beam and a curved cross beam;

wherein the curved beam comprises a pair of end components integrally connected to a curved main body, a top surface, an outer face, an inner face, a pair of identical, end faces defined by said end components, and a bottom;

wherein the curved cross beam comprises a pair of end components integrally connected to a curved main body, a top surface, an outer face, an inner face, a pair of identical, end faces defined by said end components, a bottom, and a pair of stud receiving bores on the bottom of each of said end components; and wherein the curved beam unit is adapted to be removably secured to a pair of adjacent outer mid-columns of the central portion of claim 3 to form a curved corner of said floor.

15. The framing system of claim 14, wherein the top of each outer mid-column comprises a first stud, a second stud, a first half stud, and a second half stud, wherein the first half stud and the second half stud each extend towards the external face of each outer mid-column;

wherein a half stud extends from the outer face of each of the end components of the curved cross beam, wherein each of said half studs of said curved cross beam is adapted to engage the first half stud or the second half stud of said outer mid-column to form a full stud;

wherein the pair of stud receiving bores on the bottom of each end component of the curved cross beam are adapted to engage the first stud or the second half stud on the top of each outer-mid column.

16. The framing system of claim 14, wherein the pair of end faces of said end components of the curved beam are identically configured to the pair of lateral sides of the bottom component of each of the plurality of outer mid-columns;

wherein the pair of end faces of said end components of the curved beam are adapted to be removably secured to the lateral sides of the bottom component of the adjacent outer mid-columns.

17. The framing system of claim 16, wherein a plurality of curved beam units interlock with the central portion of claim 3 to form the curved corners of said floor;

wherein said floor is configured to interlock with one or more corresponding floors to form a structure.

18. The framing system of claim 16, wherein the curved beam unit is further adapted to be removably secured to a pair of adjacent outer mid-columns of the adjacent sides of the central portion of claim 11;

wherein at least one curved beam unit and at least one tie beam corner unit interlock with the central portion to form the corners of said floor;

wherein said floor is configured to interlock with one or more corresponding floors to form a structure.

* * * * *